United States Patent [19]

Berry et al.

[11] 4,029,951

[45] June 14, 1977

[54] TURBINE POWER PLANT AUTOMATIC CONTROL SYSTEM

[75] Inventors: William R. Berry, Camden; Charles L. Groves, Jr., Willingboro, both of N.J.; Eddie Y. Hwang, Wallingford, Pa.

[73] Assignee: Westinghouse Electric Corporation, Pittsburgh, Pa.

[22] Filed: Oct. 21, 1975

[21] Appl. No.: 625,625

[52] U.S. Cl. ..... 235/151.21; 444/1; 290/40 R; 60/646

[51] Int. Cl.[2] ..... F01D 19/00

[58] Field of Search ..... 235/151.21, 151.31, 235/151, 151.34, 151.3; 444/1; 290/40 R; 60/646, 64–66; 340/172.5; 415/17

[56] References Cited

UNITED STATES PATENTS

| | | | |
|---|---|---|---|
| 3,552,872 | 1/1971 | Giras et al. | 415/17 |
| 3,555,251 | 1/1971 | Shavit | 235/151 |
| 3,561,216 | 2/1971 | Moore, Jr. | 60/73 |
| 3,564,273 | 2/1971 | Cockrell | 415/17 X |
| 3,911,286 | 10/1975 | Uram | 235/151.21 X |

*Primary Examiner*—Edward J. Wise
*Attorney, Agent, or Firm*—H. W. Patterson

[57] ABSTRACT

A digital computer system for automatically controlling a turbine power plant without operator intervention is disclosed. The system controls the turbine from rolling off turning gear, through heat soak, wide range speed control, and the megawatt loading of the generator in accordance with the on-line condition of the turbine and/or generator. The rate of change of magawatt loading as well as the rate of speed under wide range speed control is automatically controlled toward an operator entered target. The I.P. rotor thermal characteristics are determined both in axial and radial directions. The on-line generator capability is determined in load control.

16 Claims, 26 Drawing Figures

| | GENERATORS | EXPECTED GEN. STATOR COIL DISCH. GAS OR $H_2O$ TEMP RISE = | GEN. STATOR COIL DISCHARGE GAS OR $H_2O$ RISE LIMIT = | $H_2$ MAX. PSIG | $H_2$ MIN. PSIG |
|---|---|---|---|---|---|
| HYDROGEN COOLED | WITH SINGLE VENT STATOR COILS 60 PSIG RATED GAS PRESSURE | $36\left(\frac{74.7}{14.7 + PSIG}\right)\left(\frac{ISA}{IS}\right)^2$ | $40 + \left(\frac{60 - PSIG}{7.5}\right)$ | 65 | 29 |
| | WITH DOUBLE VENT STATOR COILS 60 PSIG RATED GAS PRESSURE | $50\left(\frac{74.7}{14.7 + PSIG}\right)\left(\frac{ISA}{IS}\right)^2$ | $55 + \left(\frac{60 - PSIG}{15}\right)$ | | |
| | WITH DOUBLE VENT STATOR COILS 75 PSIG RATED GAS PRESSURE | $50\left(\frac{89.7}{14.7 + PSIG}\right)\left(\frac{ISA}{IS}\right)^2$ | $55 + \left(\frac{75 - PSIG}{15}\right)$ | 80 | 29 |
| | WITH WATER COOLED STATOR COILS 75 PSIG RATED GAS PRESSURE | $30\left(\frac{ISA}{IS}\right)^2$ | 31 | 80 | 44 |
| | CONVENTIONALLY COOLED | EXPECTED EMBEDDED STATOR COIL RTD RISE = $45\left(\frac{44.7}{14.7 + PSIG}\right)^{.68}\left(\frac{ISA}{IS}\right)^2$ | EMBEDDED STATOR COIL RTD RISE LIMIT = $50 + \left(\frac{30 - PSIG}{2}\right)$ | 31 | .2 |

FIG.10A

| GENERATORS | | TYPE | INDEX | GENERATOR REACTIVE CAPABILITY CURVES | | | | | | | | | | |
|---|---|---|---|---|---|---|---|---|---|---|---|---|---|---|
| | | | | ACTUAL $H_2$ PSIG | CURVE SET USED | CENTER COORDINATES | | | RADIUS | | | POWER FACTOR LINES | |
| | | | | | | C1 | C2 | C3 | R1 | R2 | R3 | LEADING | LAGGING |
| HYDROGEN COOLED | WITH SINGLE VENT STATOR COILS 60 PSIG RATED GAS PRESSURE | I | 1 | 29 to 43 | 30 PSIG | 0,0 | $0,-Y_{2.1}$ | $X_{3.1},Y_{3.1}$ | $R_{1.1}$ | $R_{2.1}$ | $R_{3.1}$ | .95 | PF1 |
| | WITH DOUBLE VENT STATOR COILS 60 PSIG RATED GAS PRESSURE | | 2 | 44 to 58 | 45 PSIG | 0,0 | $0,-Y_{2.2}$ | $X_{3.2},Y_{3.2}$ | $R_{1.2}$ | $R_{2.2}$ | $R_{3.2}$ | .95 | PF2 |
| | | | 3 | 59 to 65 | 60 PSIG | 0,0 | $0,-Y_{2.3}$ | $X_{3.3},Y_{3.3}$ | $R_{1.3}$ | $R_{2.3}$ | $R_{3.3}$ | .95 | PF3 |
| | WITH DOUBLE VENT STATOR COILS 75 PSIG RATED GAS PRESSURE | II | 1 | 29 to 43 | 30 PSIG | 0,0 | $0,-Y_{2.1}$ | $X_{3.1},Y_{3.1}$ | $R_{1.1}$ | $R_{2.1}$ | $R_{3.1}$ | .95 | PF1 |
| | | | 2 | 44 to 58 | 45 PSIG | 0,0 | $0,-Y_{2.2}$ | $X_{3.2},Y_{3.2}$ | $R_{1.2}$ | $R_{2.2}$ | $R_{3.2}$ | .95 | PF2 |
| | | | 3 | 59 to 73 | 60 PSIG | 0,0 | $0,-Y_{2.3}$ | $X_{3.3},Y_{3.3}$ | $R_{1.3}$ | $R_{2.3}$ | $R_{3.3}$ | .95 | PF3 |
| | | | 4 | 74 to 80 | 75 PSIG | 0,0 | $0,-Y_{2.4}$ | $X_{3.4},Y_{3.4}$ | $R_{1.4}$ | $R_{2.4}$ | $R_{3.4}$ | .95 | PF4 |
| | WITH WATER COOLED STATOR COILS 75 PSIG RATED GAS PRESSURE | III | 1 | 44 to 58 | 45 PSIG | 0,0 | $0,-Y_{2.1}$ | $X_{3.1},Y_{3.1}$ | $R_{1.1}$ | $R_{2.1}$ | $R_{3.1}$ | .95 | PF1 |
| | | | 2 | 59 to 73 | 60 PSIG | 0,0 | $0,-Y_{2.2}$ | $X_{3.2},Y_{3.2}$ | $R_{1.2}$ | $R_{2.2}$ | $R_{3.2}$ | .95 | PF2 |
| | | | 3 | 74 to 80 | 75 PSIG | 0,0 | $0,-Y_{2.3}$ | $X_{3.3},Y_{3.3}$ | $R_{1.3}$ | $R_{2.3}$ | $R_{3.3}$ | .95 | PF3 |
| CONVENTIONALLY COOLED | | IV | 1 | .2 to 13 | .5 PSIG | 0,0 | $0,-Y_{2.1}$ | $X_{3.1},Y_{3.1}$ | $R_{1.1}$ | $R_{2.1}$ | $R_{3.1}$ | .95 | PF1 |
| | | | 2 | 14 to 28 | 15 PSIG | 0,0 | $0,-Y_{2.2}$ | $X_{3.2},Y_{3.2}$ | $R_{1.2}$ | $R_{2.2}$ | $R_{3.2}$ | .95 | PF2 |
| | | | 3 | 29 to 31 | 30 PSIG | 0,0 | $0,-Y_{2.3}$ | $X_{3.3},Y_{3.3}$ | $R_{1.3}$ | $R_{2.3}$ | $R_{3.3}$ | .95 | PF3 |

FIG.10B

IP ROTOR HEAT FLOW CALCULATION GRID SYSTEM

TURBINE POWER PLANT AUTOMATIC CONTROL SYSTEM

CROSS-REFERENCE TO RELATED APPLICATIONS

1. "System And Method For Starting A Steam Turbine With Digital Computer Control" by Gerald E. Waldron, Ser. No. 247,885, filed Apr. 26, 1972, which relates to a digital start-up system where the start-up sequence is resumed "on the fly" after being taken out of automatic control.

2. "System And Method For Operating A Steam Turbine With Digital Computer Control Having Automatic Startup Sequential Programming" by Juan J. Tanco, Ser. No. 247,598, filed Apr. 26, 1972, which relates to a digital system in which rotor stress and/or differential expansion is compared with predetermined limits in controlling the start-up of the turbine.

3. "System And Method For Operating A Steam Turbine With Digital Computer Control And With Improved Monitoring Capability" by Donald J. Jones, Ser. No. 247,600, filed Apr. 26, 1972, which application is directed to a digital system for processing of monitored turbine operations during automatic start-up.

4. "System And Method For Organizing Computer Programs For Operating A Steam Turbine With Digital Computer Control" by Robert Uran and Juan J. Tanco, Ser. No. 247,887, filed Apr. 26, 1972 and continued as Ser. No. 391,406, filed Aug. 24, 1973, which application is directed to an automatic start-up system wherein the turbine is started, synchronized in accordance with speed control signals which is governed by turbine parameters in a predetermined priority.

5. "System And Method For Improved Steam Turbine Operation" by Robert L. Osborne, Ser. No. 331,738, filed Feb. 13, 1973, which is directed to a system where the steam flow to the turbine is controlled as a function of heat flow.

6. "Anticipative Turbine Control" by Robert L. Osborne, Ser. No. 549,568, filed Feb. 13, 1973, which application is directed to a system where the speed and acceleration of the turbine is controlled as a function of predicted future heat transfer conditions.

BACKGROUND OF THE INVENTION

The present invention relates to turbine power plants; and more particularly, to an improved system for controlling the dynamic operation of turbines automatically without operator intervention.

Turbine power systems typically include a high pressure (HP) turbine section where the steam is introduced directly from the steam generator. The steam from the HP turbine section after being reheated is introduced into a reheat turbine section, which in the case of fossil-fired steam generating systems is commonly termed the (IP) turbine section; and then into a low pressure turbine section before exhausting to the condenser. A rotor having an axial bore passes centrally through the turbine casings; and rotation of the rotor is achieved by passage of the steam over blades alternately affixed to the rotor and to the casing. The generator, which is affixed to the rotor, may be cooled by hydrogen has ($H_2$).

The rotor of the HP turbine section may be typically in the order of 24 inches in diameter, for example, and the IP turbine section, includes a rotor which may be in the order of over 40 inches in diameter. The IP rotor surface is replete with grooves and other irregularities, particularly where the turbine blades are affixed.

It is well known, that whenever the turbine is to undergo changes in speed, and the generator is to undergo changes in load, care must be taken lest damage be done either by thermal stresses, thermal expansion of adjacent parts of different rates, or by exceeding the capability of the generator. A turbine which undergoes thermal stress caused by uneven heat distribution in the rotors, tends to develop cracks at locations on the rotor most exposed to the widest and most frequent steam temperature variation. Also, such cracks will occur when the turbine is accelerated at too fast a rate when the turbine rotors are not of uniform temperatures.

The present invention is an improvement over the prior art system, as disclosed in U.S. patent application Ser. No. 408,962, which is a continuation of Ser. No. 247,887, filed by Theodore C. Giras and Robert Uran, on Apr. 26, 1972, entitled "System And Method For Starting, Synchronizing, And Operating A Steam Turbine With Digital Computer Control" and assigned to the assignee hereof, which is, in its entirety, hereby incorporated into the present application by reference. This referenced application, which discloses an automatic system for starting up a turbine includes certain details which form one part of the invention of the present system including the features of the related referenced applications (1) through (4) and shall be referred to hereinafter as the Giras application.

The Giras application includes an automatic start-up system for steam turbine power plant which controls the turbine under the thermal constraints of HP rotor stress from rolling off turning gear to synchronous speed, and the application of initial load. The system monitors plant conditions to inform the operation of dangerous conditions after the application of initial load. The Giras start-up system recognizes that the IP rotor is considered the most critical for speeds above the heat soak speed of approximately two-thirds synchronous speed when the rotor temperature is below 250° F. The rotor metal is in a brittle state below 250° F which may result in the development of cracks in the event of excessive speeds.

In the Giras system, the turbine is prevented from exceeding the heat soak speed for a period of time based upon a time versus temperature curve, which must be conservatively estimated in order to protect the turbine. Specifically, the computation of this heat soak time, or time versus temperature curve, is based conservatively on the lowest of four calculated temperatures. A comparison is made between the calculated (1) the rotor volume average temperature which existed before opening the steam inlet valves, (2) the rotor volume average temperature at 2200 rpm's, (3) the first stage turbine metal temperature before opening the steam inlet valves. (4) and the first stage metal temperature at 2200 rpm's. When the heat soak speed has been reached, the amount of heat soak time is determined, based upon the lowest temperature selected from the above for a reheat steam temperature of 500° F. Once the soak time is completed, a final check on the HP rotor volume average temperature is made before declaring that the heat soak is complete and allows the turbine to continue acceleration. In the event that the lowest of these temperatures is above 250° F, the heat soak is considered unnecessary.

After the predetermined heat soak time is completed, the system accelerates the turbine to approximately 3300 rpm's at a rate which is determined by a calculated HP rotor strain which is compared to a selected rotor strain limit. After the system automatically transfers from throttle to governor valve control at 3300 rpm's the turbine is accelerated to synchronous speed. After the applications of a minimum load, the system is supervisory only, that is, various parameters are monitored and appropriate messages are printed to assist the operator in the control of the turbine up to the desired load.

In the Giras application, the HP rotor surface thermal strain is proportional to the surface-to-volume average temperature differential and determines the acceleration of the turbine. A comparison of the present thermal strain value with previous thermal strain values determines the type of thermal transient that the rotor is undergoing, and selects the proper acceleration path to be followed. The rotor surface temperature is calculated as a function of the first stage HP steam temperature, the present heat transfer coefficient, and the history of the temperature of the rotor metal. The magnitude of the rotor strain is determined by the surface-to-volume average rotor temperature which is utilized to determine the rotor surface strain based on present and past history. The heat transfer coefficient is computed as a function of speed reaching its higher value in the speed mode at rated speed.

The system of the Giras application is advantageous in so far as it rotates to start-up of the turbine through the application of initial load; however, the heat soaking of the critical IP turbine rotor is based on a time versus temperature curve, which may result in an unnecessary elapsed time. With such elapsed heat soak time consecutively estimated, the HP rotor stress calculations provided sufficient thermal stress protection for automatic operation up to synchronous speed.

With respect to the calculation of HP rotor strain and various means for controlling the turbine in accordance with such strain, reference is made to U.S. Pat. No. 3,448,265, entitled "System And Method For Providing Steam Turbine Operation With Improved Dynamics", by William R. Berry, and assigned to the present assignee, in which there is discussed in detail the effects of thermal loading on permissible turbine operation, which is incorporated by reference herein for the purpose of indicating the background of certain aspects of the present invention. The referenced patent to Berry discloses an improved method of determining present rotor stress as a function of monitored HP turbine impulse chamber steam temperature, comparing the present stress with a predetermined stress limit, and deriving a control signal from such comparison, by which inlet steam to the HP turbine is controlled. In such a prior art system, the impulse chamber steam pressure at the HP turbine section may be further controlled by considerations of rotor bore loading or casing strain. The effects of thermal expansion and contraction of respective regions of the turbine are thus controlled as a function of calculated stress at such regions, which calculations are based upon the monitored inlet steam condition, centrifugal force loadings, and other input variables.

The Berry patent teaches that bore thermal stress calculations can be made for the reheat turbine by determining the rotor surface temperature in the inlet steam region of the reheat pressure section based upon the measured reheat inlet chamber steam temperature and the variable and lower heat transfer conductance of the reheat rotor surface in the same manner as the HP turbine.

Berry suggests that on-line rotor bore loading determinations can be eliminated in the event that a predetermined heat soak time is utilized in the start-up procedure. Berry mentions that the heat transfer conductance of the IP turbine is further determined as a predetermined function of the IP steam flow and IP steam density or pressure; that is $$K_{(US)IP} = W_S SF, P_{IP})$$

where $W_s$ = actual turbine speed, $SF = IP$ steam flow, and $P_{IP} = IP$ steam pressure, and $K_{(US)IP}$ is the heat transfer conductance of the IP rotor.

Another specific prior art example of turbine operation based upon considerations of rotor stress is disclosed in a patent to Zwicky, U.S. Pat. No. 3,446,224, issued May 27, 1969. This patent calculates rotor bore and surface stresses by means of temperature and speed measurements; and calculates safe stress margins, and applies the lowest of the surface or bore safe stress margin as either an acceleration reference signal or a load rate reference signal to control the acceleration and load of the turbine. Calculations of bore stress and bore temperature are made by periodically taking the inner casing steam temperature at three consecutive time intervals and multiplying by predetermined constants. Only the time intervals are varied according to the diameter of the rotor. In Moore, U.S. Pat. No. 3,561,216 issued Feb. 9, 1971, there is disclosed a rotor stress controlled system which calculates rotor stress in the same manner as the patent to Zwicky. In this patent, the rate of loading and the single-to-sequential transfer of the valves is governed by the highest stress of all the calculated thermal stresses. U.S. Pat. No. 3,577,733 issued to Manuel on May 4, 1971 discloses a method of loading a steam turbine and transferring between partial arc and full arc steam admission modes during loading while maintaining a constant rate of heating.

In each of the prior art examples, different systems are disclosed for preventing either cyclic variations in the temperature of the turbine rotors or for calculating rotor stress in order that a turbine may be operated without undue thermal strain. These patents recognize that the greatest thermal differences occur in the high pressure rotor because of differentials in steam temperature and small diameter of the rotor; and the patents to Berry and Zwicky suggest that such stress can be calculated with respect to the reheat turbine rotor as well as the high pressure turbine rotor by taking a longer time for heat conductance.

An automatic turbine control system which controls the turbine without operator intervention up to application of a desired operator entered load must be efficient in its operation; and take into consideration any undesirable conditions of operation that would tend to shorten the life of the component parts of the plant. In so doing the system should have versatility such that the undesirable conditions can be prevented, or rectified without interrupting turbine operation. In furtherance thereof, it is desirable that the system can increase or decrease the rate of loading in accordance with such conditions up to an operator entered medium.

The thermal stress of the rotors, both HP and IP should be considered for such a system, as well as the constraints of the electric generator. Also, such a system should control in real-time through all phases of its operation, with proper predictions of what will occur in the event the system is controlling the plant at a certain rate of increased load.

In determining the thermal stress of the IP turbine rotor, such as system should provide for the critical stress points that exist axially along the rotor as well as provide for different stresses for different types of blade mountings.

SUMMARY OF THE INVENTION

Broadly, the present invention relates to computer controlled system for controlling the operation of a turbine power plant from cold or hot start-up to the application of full megawatt load without the necessity of personal intervention. The system provides for accelerating the turbine from zero speed through heat soak speed and synchronous speed in accordance with the real-time thermal stresses in both the HP and IP rotor. During such control the system can vary the rate of acceleration by either stopping acceleration altogether, holding it constant, increasing it or decreasing it. In response to placing the generator on-line, the system varies the loading rate by either stopping further loading altogether, holding it constant, increasing it, or decreasing it in accordance with the generator capabilities as well as the HP and IP thermal constraints.

In one aspect, the system includes the determination of heat distribution in both an axial and radial direction for the IP rotor to account a stationary and moving blade.

BRIEF DESCRIPTION OF THE DRAWINGS

FIG. 10A and 10B is a flow chart of the speed demand and acceleration load/rate control program P07 of the system of FIG. 3;

DESCRIPTION OF THE PREFERRED EMBODIMENT

Electric Power Plant and Steam Turbine System

Figure 1:
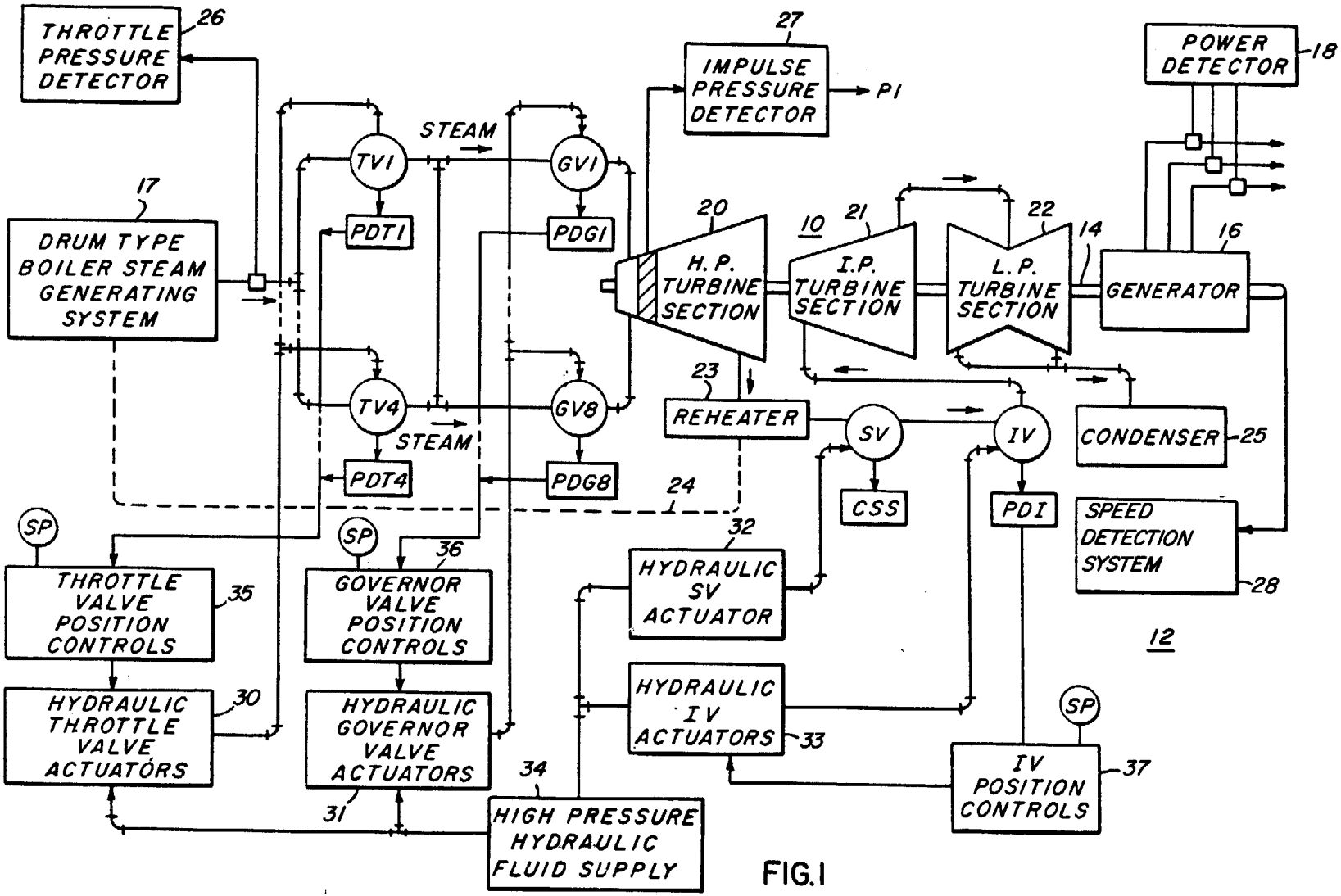
FIG. 1 is a schematic block diagram of a typical turbine power plant operated in accordance with the principles of the present invention.
Figure 2:
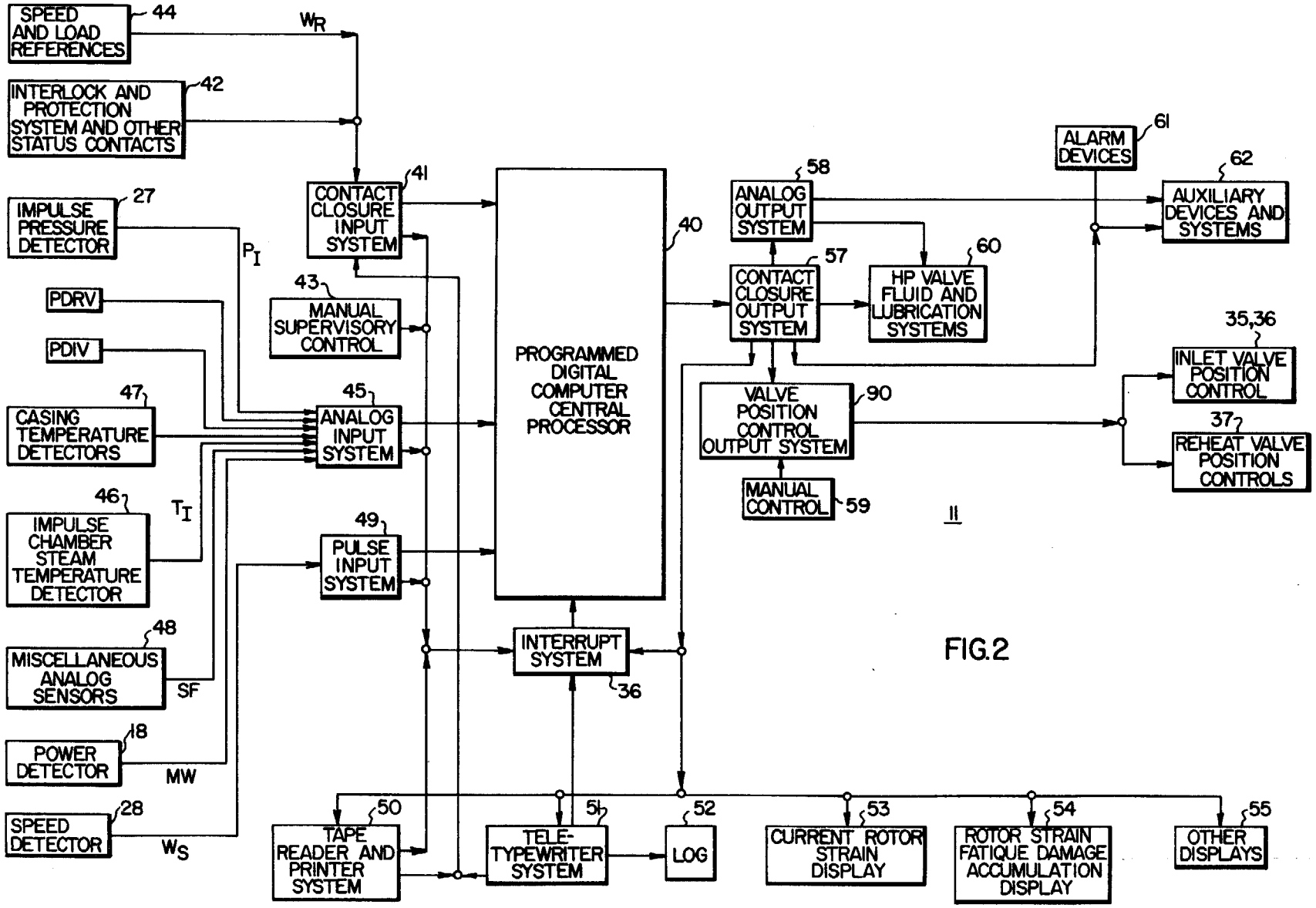
FIG. 2 is a schematic block diagram of a typical control system structure for embodying the principles of the present invention.

Referring to FIGS. 1 and 2, a large single reheat steam turbine 10 (FIG. 1) constructed in a well-known manner and operated by a control system 11 (FIG. 2) in a fossil electric power plant 12 in accordance with the principles of the invention is shown. As will become more evident through this description, other types of steam turbines and electric power plants can also be operated in accordance with the principles of the invention. The turbine 10 and its control system 11 and the electric power plant 12 are like those disclosed in the copending Giras application incorporated by reference herein.

The turbine 10 is provided with a single output shaft 14 which drives a conventional large alternating current generator 16 to produce three-phase electric power sensed by a power detector 18. Typically, the generator 16 is connected through one or more breakers per phase to a large electric power network and when so connected causes the turbo-generator arrangement to operate at synchronous speed under steady state conditions. Under transient electric load change conditions, system frequency may be affected and conforming turbo-generator speed changes would result.

After synchronism, power contribution of the generator 16 to the network is normally determined by the turbine steam flow which in this instance is supplied to the turbine 10 at substantially constant throttle pressure. The constant throttle pressure steam for driving the turbine 10 is developed by a stream generating system 17 which may be provided in the form of a conventional drum or once-through type boiler, for example, operated by fossil fuel such as pulverized coal, natural gas or oil.

In this case, the turbine 10 is of the multistage axial flow type and it includes a high pressure section 20, an intermediate pressure section 21, and a low pressure section 22. Each of the turbine sections may include a plurality of expansion stages provided by stationary vanes and an interacting bladed rotor connected to the shaft 14.

The turbine 10 in this instance employs steam chests of the double ended type, and steam flow is directed to the turbine steam chests (not specifically indicated) through four main inlet valves or throttle inlet valves TV1–TV4. Steam is directed from the admission steam chests to the first high pressure section expansion stage through eight governor inlet valves GV1–GV8 which are arranged to supply steam to inlets arcuately spaced about the turbine high pressure casing to constitute a somewhat typical governor valve arrangement for large fossil fuel turbines.

In applications where the throttle valves have a flow control capability, the governor valves GV1–GV8 are typically all fully open during all or part of the startup process and steam flow is then varied by full arc throttle valve control. At some point in the start-up and loading process, transfer is normally and preferably automatically made from full arc throttle valve control to full arc governor valve control because of throttling energy losses and/or reduced throttling control capability.

In the partial arc mode, the governor valves are operated in a predetermined sequence usually directed to achieving thermal balance on the rotor and relatively reduced rotor blade stressing while producing the desired turbine speed and/or load operating level. For example, in a typical governor valve control mode, governor valves GV5–GV8 are jointly operated from time to time to define positions producing the desired total steam flow. After the governor valves GV1–GV8 have reached the end of their control region, i.e. upon being fully open or at some overlap point prior to reaching fully open positions, the governor valves GV5–GV8 are sequentially placed in operation in numerical order to produce continued steam flow control at higher steam flow levels. This governor valve sequence of operation is based on the assumption that the governor valve controlled inlets are arcuately spaced about the 360° periphery of the turbine high pressure casing.

In the described arrangement with throttle valve control capability, the preferred turbine start-up and loading method is to raise the turbine speed from the turning gear speed of about 2 rpm to about 80% of the synchronous speed under throttle valve control, then transfer to full arc governor valve control and raise the turbine speed to the synchronous speed, then close the power system breakers and meet the load demand with full or partial arc governor valve control.

After the steam has crossed past the first stage impulse blading to the first stage reaction blading of the high pressure section, it is directed to a reheater system 23 which is associated in heat transfer relation with the steam generating system 17 as indicated by the reference character 24. With a raised enthalpy level, the reheated steam flows from the reheater system 23 through the intermediate pressure turbine section 21 and the low pressure turbine section 22. From the latter, the vitiated steam is exhausted to a condenser 25 from which water flow is directed (not indicated) back to the steam generating system 17.

To control the flow of reheat steam, one or more reheat stop valves SV are normally open and closed only when the turbine is tripped. Interceptor valves IV (only one indicated), are also provided in the reheat steam flow path.

In the typical fossil fuel drum type boiler steam generating system, the boiler control system operates the boiler so that steam throttle pressure is controlled to be substantially constant or within a predetermined range of values. A throttle pressure detector 26 of a suitable conventional design senses the steam throttle pressure for data monitoring and/or turbine or plant control purposes. If desired in nuclear or other plant applications, turbine control action can be directed to throttle pressure control as well as or in place of speed and/or load control.

In general, the steady state power or load developed by a steam turbine supplied with substantially constant throttle pressure steam is proportional to the ratio of first stage impulse pressure to throttle pressure. Where the throttle pressure is held substantially constant by external control, the turbine load is proportional to the first stage impulse pressure. A conventional pressure detector 27 is employed to sense the first stage impulse pressure for assigned control usage in the turbine control 11.

A speed detection system 28 is provided for determining the turbine shaft speed for speed control and for frequency participation control purposes; and can for example include a reluctance pickup (not shown) magnetically coupled to a notched wheel (not shown) on the turbo-generator shaft 14. In the present case, plurality of sensors are employed for speed detection.

Respective hydraulically operated throttle valve actuators 30 and governor valve actuators 31 are provided for the four throttle valves TV1–TV4 and the eight governor valves GV1–GV8. Hydraulically operated actuators 32 and 33 are also provided for the reheat stop and interceptor valves SV and IV. A high pressure hydraulic fluid supply 34 provides the controlling fluid for actuator operation of the valves TV1–TV4, GV1–GV8, SV and IV. A lubricating oil system (not shown) is separately provided for turbine plant lubricating requirements.

The inlet valve actuators 30 and 31 are operated by respective electrohydraulic position controls 35 and 36 which form a part of the control system 11. If desired, the interceptor valve actuators 33 can also be operated by a position control (not shown). Respective valve position detectors PDT1–PDT4 and PDG1–PDG8 are provided to generate respective valve position feedback signals which are combined with respective valve position setpoint signals SP to provide position error signals from which are generated the output control signals.

The setpoint signals SP are generated by a controller which also forms a part of the control system 11. The position detectors are provided in suitable conventional form, for example they may be linear variable differential transformers which generate negative position feedback signals for algebraic summing with the valve position setpoint signals SP.

The combination of an amplifier, converter, hydraulic actuator 30 or 31, and the associated valve position detector and other miscellaneous devices form a local analog electrohydraulic valve position control loop for each throttle or governor inlet steam valve as shown in the Giras application.

A description of the various control loops is included in the Giras application, the details of which form no part of the present invention.

Referring to FIG. 2, the programmed digital computer control system 11 operates the turbine 10 with improved dynamic performance characteristics, and can include conventional hardware in the form of a central processor 40 and associated input/output interfacing equipment such as that sold by Westinghouse Electric Corporation and described in detail in "Westinghouse Engineer", May, 1970, Volume 30, No. 3, pages 88 through 93. As will be apparent from the description hereinbelow, the control system of this invention may utilize, for performing the indicated calculations, any general purpose programmable computer, special purpose computer or microprocessors having real-time capability, in combination with the control apparatus illustrated in FIG. 1 and the required interface equipment, or equivalents thereof, as illustrated in FIG. 2. Also, it is to be understood that special purpose analog computer apparatus may be utilized for making the specific calculations required to practice this invention in controlling the operation of any particular turbine.

The interfacing equipment for the computer processor 40 includes a conventional contact closure input system 41 which scans contact or other similar signals representing the status of various plant and equipment conditions. Such contacts are generally indicated by the reference character 42 and might typically be contacts of mercury wetted relays (not shown) which are operated by energization circuits (not shown) capable of sensing the predetermined conditions associated with the various system devices. Status contact data is used in interlock lock functioning in control or other programs, protection and alarm system functioning, programmed monitoring and logging and demand logging, functioning of a computer executed manual supervisory control 43, etc.

The contact closure input system 41 also accepts digital load reference signals as indicated by the reference character 44. The load reference 44 can be manually set by the operation to define the desired megawatt generating level and the computer control system 11 of the present invention controls the turbine 10 to increase the load for supplying the power generation demand.

Input interfacing is also provided by a conventional analog input system 45 which samples analog signals from the plant 12 at a predetermined rate such as 15 points per second for each analog channel input and converts the signal samples to digital values for computer entry. The analog signals are generated by the power detector 18, the impulse pressure detector 27, the valve position detectors PDIV and DDRV temperature detectors 46 and 37, and miscellaneous analog sensors 48, various steam flow detectors, other steam temperature detectors, miscellaneous equipment operating temperature detectors, generator hydrogen coolant pressure and temperature detectors, etc. A conventional pulse input system 49 provides for computer entry of pulse type detector signals such as those generated by the speed detector 28. The computer counterparts of the analog and pulse input signals are used in control program execution, protection and alarm system functioning, programmed and demand logging, etc.

Information input and output devices provide for computer entry and output of coded and non-coded information. These devices include a conventional tape reader and printer system 50 which is used for various purposes including, for example, program entry into the central processor core memory. A conventional teletypewriter system 51 is also provided and it is used for purposes including, for example, logging printouts as indicated by the reference character 52. Alphanumeric and/or other types of displays 53, 54 and 55 are used to communicate rotor strain, and other information as described hereinafter.

A conventional interrupt system 56 is provided with suitable hardware and circuitry for controlling the input and output transfer of information between the computer processor 40 and the slower input/output equipment. Thus, an interrupt signal is applied to the processor 40 when an input is ready for entry or when an output transfer has been completed. In general, the central processor 40 acts on interrupts in accordance with a conventional executive program. In some cases, particular interrupts are acknowledged and operated upon without executive priority limitaations.

Output interfacing is provided for the computer by means of a conventional contact closure output system 57 which operates in conjunction with a conventional analog output system 58 and with a valve position control output system 90. A manual control 49 is coupled to the valve position control output system and is operable therewith to provide manual turbine control during computer shutdown and other desired time periods.

Certain computer digital outputs are applied directly in effecting program determined and contact controlled control actions of equipment including the high pressure valve fluid and lubrication systems as indicated by the reference character 60, alarm devices 61 such as buzzers and displays, and predetermined plant auxiliary devices and systems 62 such as the generator hydrogen coolant system. Computer digital information outputs are similarly applied directly to the tape printer and the teletypewriter system 51 and the display devices 53, 54 and 55.

Other computer digital output signals are first converted to analog signals through functioning of the analog output system 58 and the valve position control output systems. The analog signals are then applied to the auxiliary devices and systems 62, the fluid and lubrication systems 60 and the valve controls 50 in effecting program determined control actions. The respective signals applied to the steam valve controls 35, 36 and 37 are the valve position setpoint signals SP to which reference has previously been made.

General Organization

Figure 3:
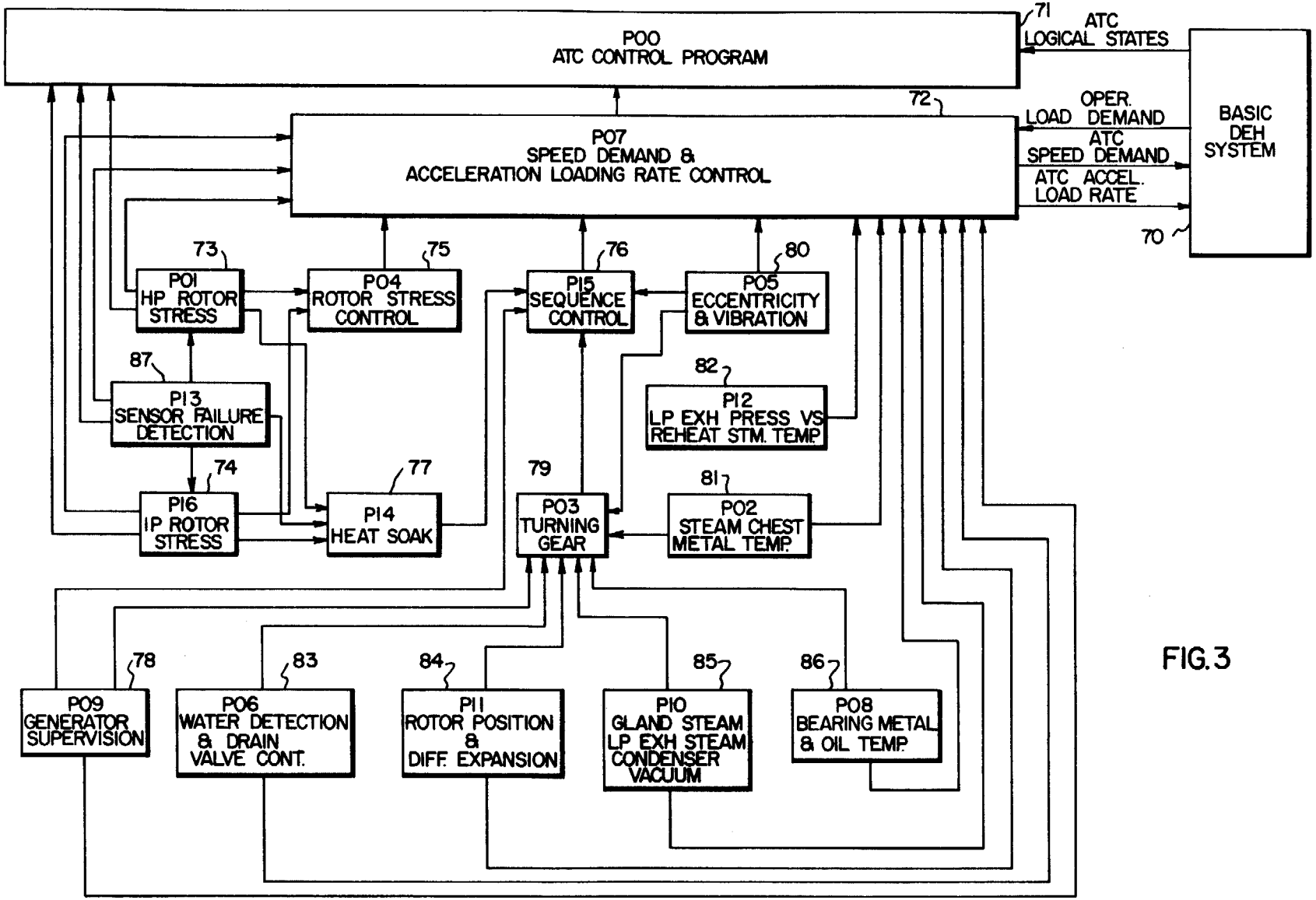
FIG. 3 is a schematic block diagram of an automatic turbine control system illustrating the overall organization of an automatic turbine start-up and loading rate control system of the present invention.

Referring to FIG. 3, the automatic turbine control system is included in and is part of the digital electrohydraulic (DEH) control system referred to at 70, one form of which is described in the copending Giras application incorporated by reference herein. The Giras application also includes the description of an automatic turbine start-up (ATS) system as previously described herein; and where certain details of the ATS system of the Giras application are common to or utilized in the system of the present invention, such details are described herein sufficient to enable an understanding of the system of the present invention.

A program POO referrd to at 71 is controlled by the auxiliary synchronizer probram of the basic DEH system referred to at 70. This program receives logical states from the basic DEH and conrols the operation of each of the various subprograms of the automatic turbine control (ATC) system, periodically, as described in connection with FIGS. 4A and 4B. A program PO7 referred to at 72 provides an input to the basic DEH system 70 for controlling the speed demand of the turbine and the acceleration and rate of loading of the generator. The basic DEH system 70 provides an input to the program PO7 corresponding to the operator's load demand of the turbine generator. The program PO7 provides such speed, acceleration and loading rate under the constraints of the various subprograms PO1, through PO6 and PO8 through P16 as described.

In each of the flow charts for the programs are triangular blocks having a legand prefixed with a particular program designation, such as PO1 followed by the letter M and a number. Each triangular block represents a message given to the operator of the system either by typewriter or indicator light. In describing the programs, reference to the indicator blocks are omitted with the last of indication given following the description of the particular program.

A program PO1 referred to at 73 calculates the information relative to the high pressure rotor. Such calculations include the high pressure rotor surface temperature and the volume average temperature of the rotor and the effective temperature differential between the rotor surface and the rotor volume average temperature. Also, it calculates the stress limits for loading and the stress limits during wide range speed control. A program P16, referred to at 74 computes the IP rotor surface temperature, bore temperature, the volume average temperature, and the effective temperature difference between the IP rotor surface temperature and the volume average temperature. This program P16 also sets the IP rotor effective temperature difference limit.

A program PO4 which provides for rotor stress control is referred to at 75; and provides input to the program PO7 referred to at 72 for controlling the load upon the generator in accordance with the HP rotor stress and the IP rotor stress from the programs PO1 and P16.

A program P14 referred to at 77 which determines the length of time that the turbine will run at a constant heat soak speed is controlled by the IP rotor stress program P16 of block 74 and the HP rotor stress program PO1 of block 73. A program PO9 referred to at block 78 calculates and determines the various generator parameters which are utilized in the loading rate control of the turbine generator.

The remaining portions of the system are mentioned merely as to their general function with respect to the effective operation of the automatic turbine control system of the present invention, and the details of the remaining programs form no part of the present invention. For example, a program PO3 referred to at 79 checks all the conditions that hold the turbine unit from rolling off turning gear. A program PO5 referred to at 80 analyzes present vibration inputs from the turbine and takes action in accordance with a previously determined vibration trend.

A program PO2 referred to at 81 checks the temperature differences across the steam chest wall and controls the turbine to avoid extreme stresses caused thereby. A program P12 referred to at 82 controls the turbine in accordance with the difference between the LP exhaust pressure and the reheat steam temperature. A program PO6 referred to at 83 controls the turbine in accordance with any water detection and drain valve contingencies. A program P11 referred to at 84 checks the rotor position longitudianlly in the casing and differential expansion to control the turbine under automatic turbine control. A program P10 referred to at 85 checks the gland steam, LP exhaust steam, and condenser vacuum in the automatic turbine control system. A program PO8 referred to at 86 checks the bearing metal and the oil temperature with respect to the automatic control of the turbine. A program P13 referred to at 87 scans the analog sensors that are provided for determining the HP rotor and IP rotor stress and determines whether or not there is a sensor failure that would prevent the proper operation of the ATC system; and finally program P15 functions to govern the sequence of the ATC system operation from turning gear through the heat soaking period to synchronization and control of the loading of the generator. For example, from the speed signal of the base DEH, it checks the actual speed, and from the program P14 it determines if the heat soak is complete, and appropriately sets the target speed to the next plateau at a rate determined by rotor stress. It provides for automatic synchronization at 3600 rpm, after reaching a certain speed; and when the breaker is initially closed, the rate index is set to a particular rate of loading depending on the present rotor stress.

Figure 4A:
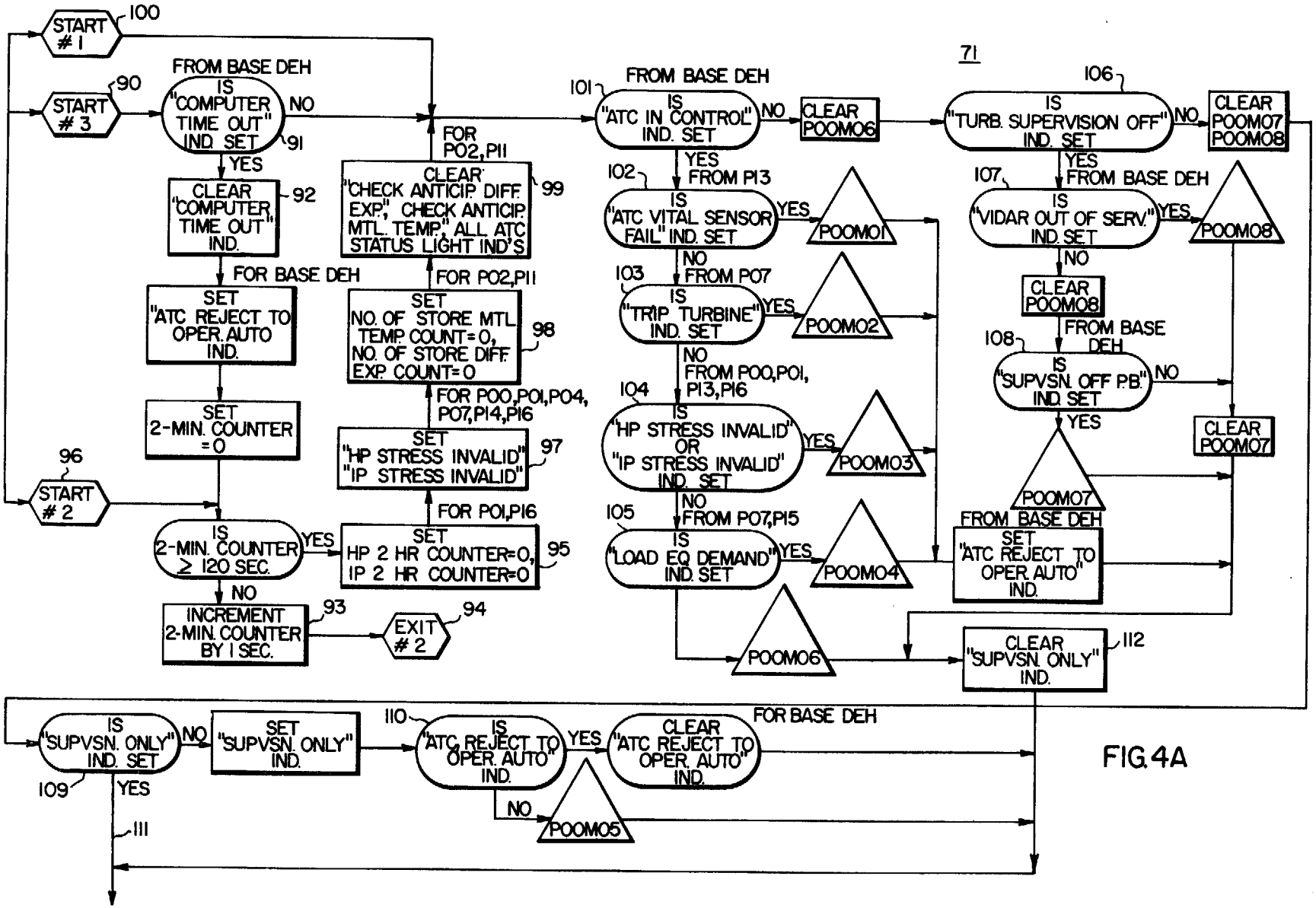
FIG. 4A and 4B is a flow chart of the automatic turbine control program POO of the system of FIG. 3.
Figure 4B:
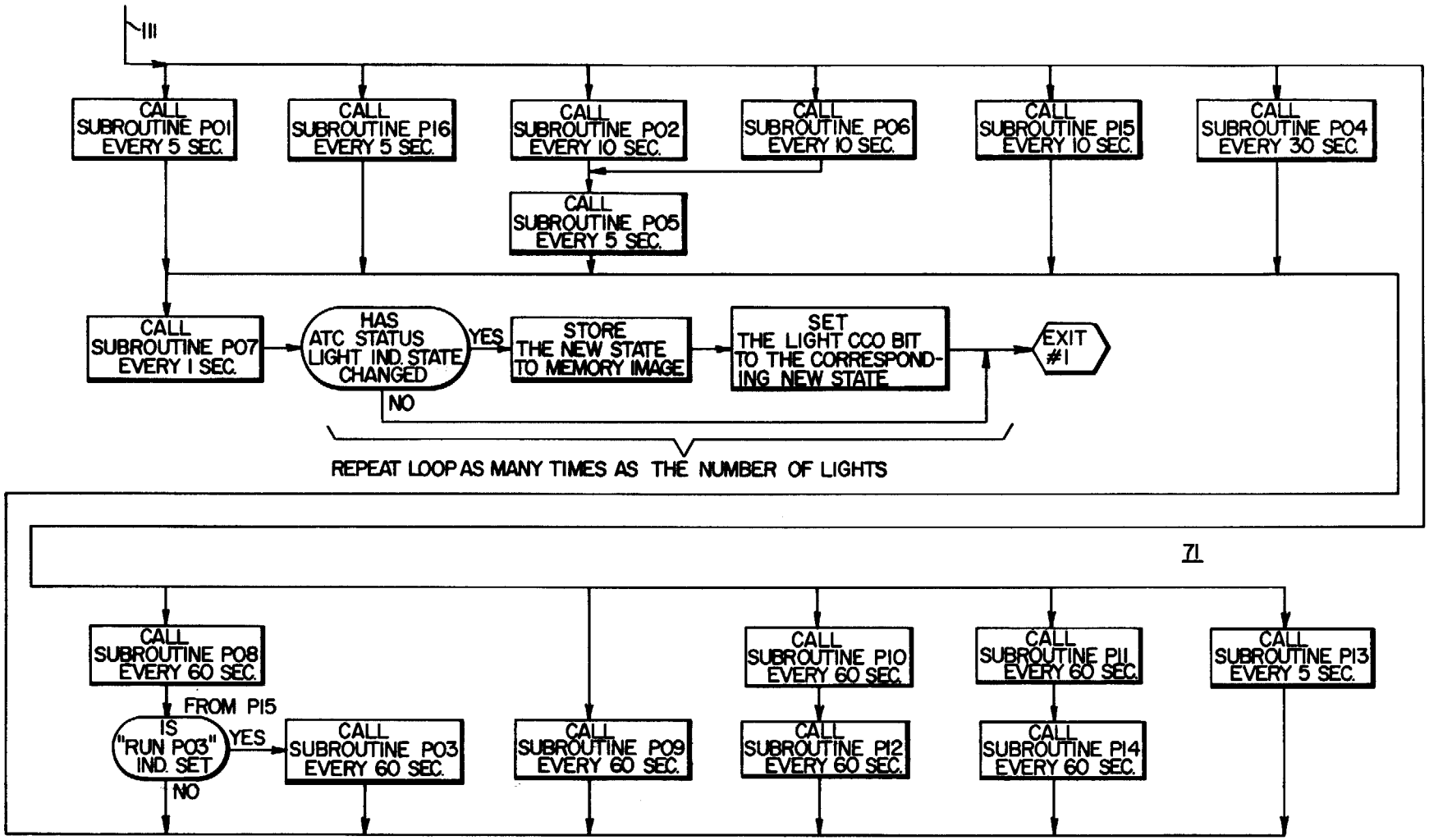

Referring to the program PO0 in FIGS. 4A and 4B, which is operated every second by the synchronizer of the DEH system, initiates the operation of every other program PO1 through P16 shown in block form in FIG. 3. Prior to placing the automatic turbine control system in operation, the computer is operated for a period of 2 hours in order that all of the calculations which are made may be verified. During this time, the various sensors are checked for validity and appropriate message printed out or indicator lights lit advising the operator of the condition of the system. In the event that any of the calculations associated with the HP stress are invalid, but those associated with the IP stress may be valid for exmple, then the automatic turbine control system will not control the turbine but merely be in a supervisory condition so that the operator may start the turbine, but ignore any information regarding the condition of the HP turbine. Although the flow charts of FIGS. 4A and 4B together with their appropriate legends are self-explanatory, with respect to many details, it should be pointed out that intially when the computer is turned on, the program is commenced at 90 to commence the 2-hour time count of the computer. A flag referred to at 91, which is set by the base DEH system to indicate the beginning of the time period is recognized by the program; and if the flag is set, the "computer timeout" flag is cleared as denoted at 92, which is communicated to the base DEH system. Then the "operator automatic" flag is set and a 2-minute counter is set to zero to begin a 2-minute count prior to the 2-hour count previously mentioned to insure that various message writers and other peripheral equipment are in operation. Then each time that the program is run for the first 2 minutes, the 2-minute counter is incremented by 1 second as shown at 93, and the program exits at 94. At the end of the 2-minute period, the HP 2-hour counter and the IP 2-hour counter are set to zero as shown at 95. During the 2 minute period, the program is started each second at 96. During this period, various values are cleared in the system and various flags are set. For example, as shown at 97, "HP stress invalid" and "IP stress invalid flags" are set. As shown at 98, metal temperature counts that may be stored in the computer and differential expansion counts are set to zero as shown at 98; and all automatic turbine control "status light" flags as well as the "anticipated differential expansion" and "anticipated metal temperature" flags are cleared as shown at 99. At the end of the 2-minute period, the program commences each second at block 100 and bypasses the previously described blocks to directly check at 101, whether the DEH has commanded the automatic control to be in control of the operation of the turbine at the end of the 2-hour period. The program then checks at 102 through 105, various flags relating to the integrity and condition of the system. In the event such flags are set, appropriate messages are printed out as denoted by the legended triangles POOMO1 through POOMO6. For example, if the flag is set at 102, the message printed out advises the operator that a vital sensor is out of service. If the flag is set at 103, the operator is advised that a turbine trip condition exists. If the flag is set at 104, the operator is advised that the rotor stress calculations are invalid, and if the flag is set at 105, the operator is advised that the ATC system is not in control; because the operator has initiated such an action by making the actual load demand logical to the load. In the event that the operator has not pushed the button to put the ATC in control as shown at 101, the program checks to determine whether it is to be under turbine supervision; and if the operator has operated such a control as shown at 106, the program then checks other conditions as shown in blocks 107, 108, 109 and 110. Appropriate messages are printed out as indicated by triangular blocks POOMO7 and POOMO8. Thus, for the first two hours of computer operation, the ATC system will permit the operator to start up the system under an operator automatic condition with such system merely printing out the various values for supervisory purposes only and not for controlling the turbine. Referring to FIG. 4B, the program path at 111 at the output of blocks 109 and 112 (FIG. 4A) operate the subroutines PO1 through P16 periodically as shown in each of the appropriately legended blocks.

Figure 5A:
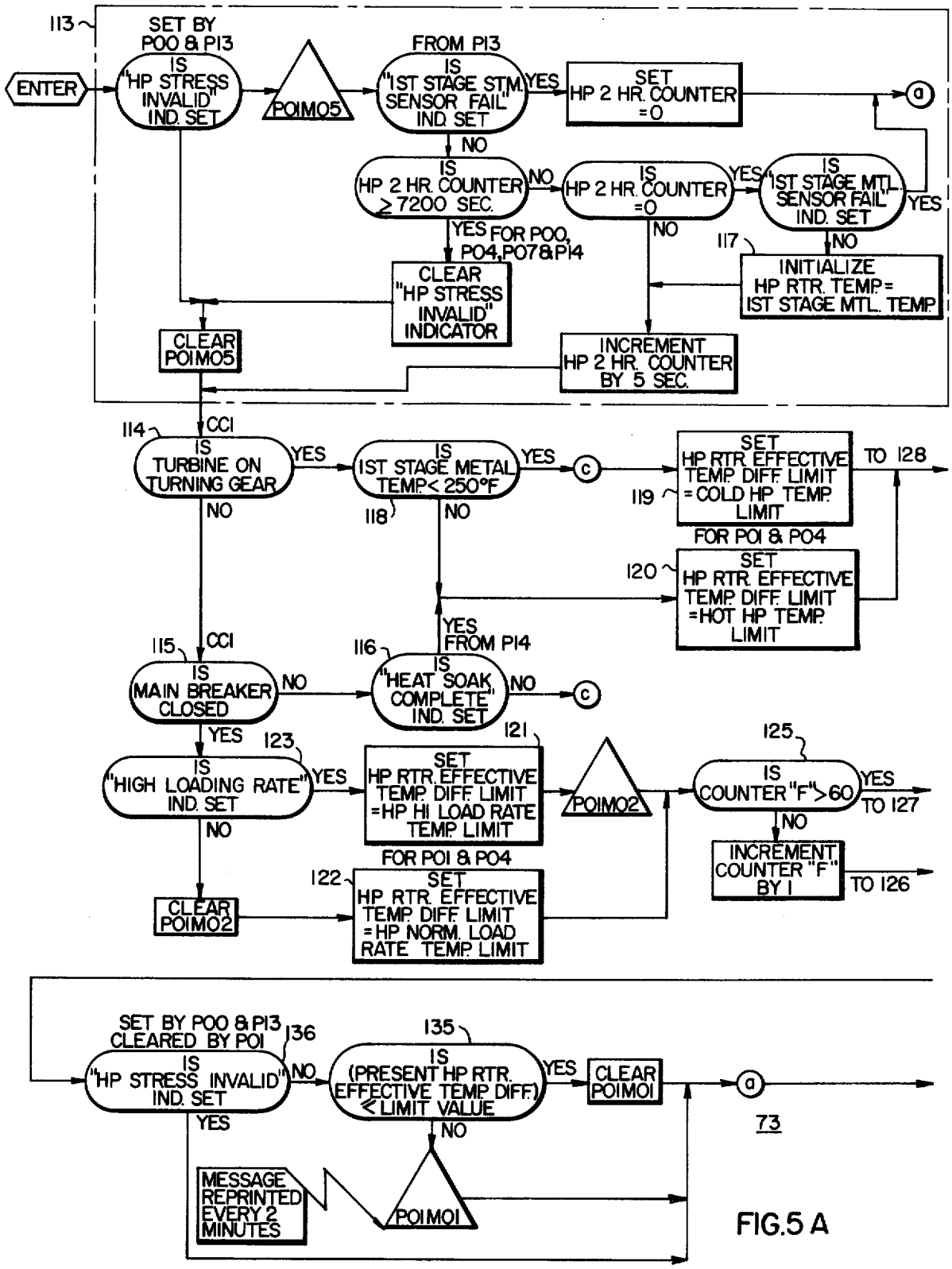
FIG. 5A and 5B is a flow chart of the HP rotor stress program PO1 of the system of FIG. 3.
Figure 5B:
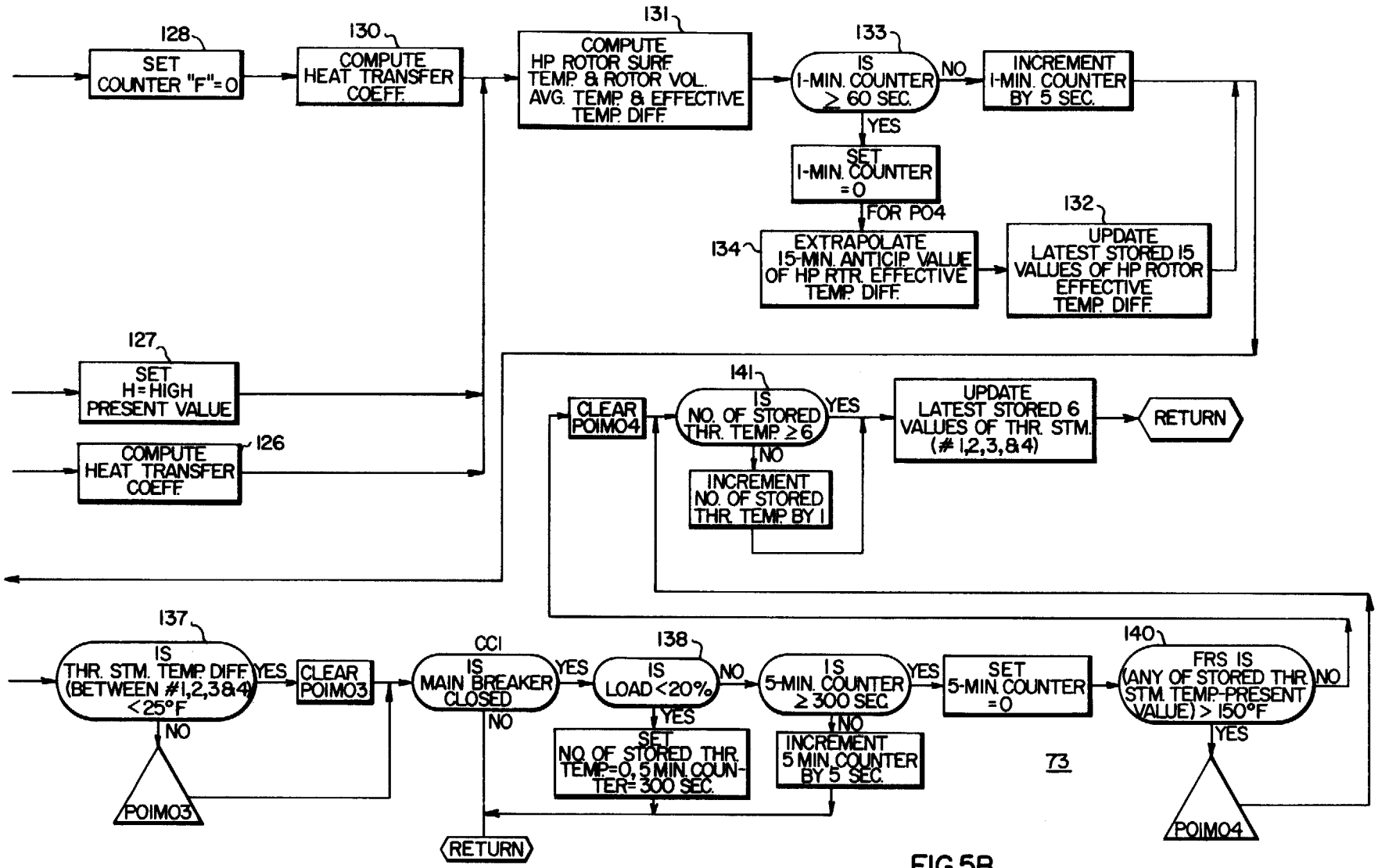

Referring to FIGS. 5A and 5B, the HP rotor stress program PO1, which is called every 5 seconds by the program PO0 utilizes in its calculations, various sensed inputs associated with the high pressure turbine. These include the first stage metal temperature, the first stage steam temperature, and the throttle steam temperature. After checking the time since start-up, and the various "invalid" flags, accomplished by the decision blocks within dashed line 113, the program PO1 checks the operating condition of the turbine generator at 114, 115 and 116 to determine whether it is on turning gear, wide range speed control, or whether the heat soak time is completed. At the beginning of the previously mentioned 2-hour counting period, the high pressure rotor temperature is intialized with the value of the first stage metal temperature as shown at 117. Also, if the first stage metal temperature is less than 250° as shown by dicision block 118, then the HP rotor effective temperature difference limit is set equal to the cold HP temperature limit, or in other words indicates to the system that this is a "cold"]start. In the event that the first stage metal temperature is greater than 250°, the temperature difference limit is set to equal a hot HP temperature limit, indicating a "hot " start. In the event that 115 indicates that the main breaker is open and the heat soak time is complete at 116, then the "hot" start limit is set at 120.

The system also provides for a high loading rate and a normal loading rate. An effective temperature differential limit for a high loading rate i different than the one for the normal loading rate, which permits the operator, for certain situations, to increase the load on the generator more rapidly than normal. This capability is shown at 121 and 122 when are controlled by a "high loading rate" flag as shown at 123. A 5-minute counter is provided as shown at 125 which computes a heat transfer coefficient as shown at 126. Once the counter has run for the 5-minute period, the computed heat transfer coefficient is held at its present value as shown at 127. In the event that the main breakers should open, the heat transfer coefficient is recomputed for the 5-minute period. At the output of the blocks 119 and 120 which set the effective temperature difference limit to equal either a hot HP temperature or a cold HP temperature limit, a counter referred to at block 128 is reset to zero and the heat transfer coefficient is computed as shown at 130. The block 130 computes the heat transfer coefficient for wide range speed control whereas the block 126 computes the heat transfer coefficient for load control as hereinbefore described.

The HP rotor surface temperature and the rotor volume average temperature, and the effective temperature difference are computed at 131. The latest 15 values of the HP rotor effective temperature difference computed by the block 131 are updated as shown at 132 every minute as shown at 133. Also each minute, the updated table is used to extrapolate an anticipated value of the HP rotor effective temperature difference 15 minutes hence as shown at 134. The program then checks the present effective temperature difference with respect to the limit value of the system at 135 provided that the "HP stress invalid" is not set at 136, and an appropriate message is printed out.

In the present embodiment of the invention, there are four different throttle steam temperature sensors at different locations. The difference between these various input temperatures is checked at 137 to determine if such a difference is greater than 25° F. Then, the main breaker is checked; and if it is open, the program returns. It it is closed, the load on the generator is then checked at 138, and if it is less than 20%, none of the throttle temperatures are stored and a 5-minute counter in the system is reset to 300 seconds. A block 140 checks to determine if any of the throttle steam temperatures that are stored have a present value greater than 150°. The system then checks at 141 to determine the number of stored throttle temperatures; and if the numbers stored are equal to or greater than six, the values are updated, which occurs at 5-minute intervals, for the four throttle steam sensors in the system.

The formula used in computing the heat transfer coefficient by respective blocks 126 and 130 are as follows:

Steam to Rotor Surface Heat Transfer Coefficient at HP first Stage

Speed Control Mode
$H = C_1P + C_2N = C_3P^2 + C_4N^2 + C_5P \cdot N + C_6$
Load Control Mode
For $T < 300$ seconds
$H = C_7 + C_8 \cdot T$
For $T \geq 300$ seconds
$H = ]C_9$ Where $C_{1-9}$ = heat transfer constants
$N$ = speed in rpm
$P$ = highest valve of condenser press ( No. 1, No. 2, and No. 3)
$T$ = time in seconds after main breaker is closed The HP rotor surface temperature is calculated to be the temperature of the first state steam at existing throttle steam temperature and pressure, and the volume average temperature $T_{AVP}(t)$ for the HP rotor is calculated in accordance with the following formula:

HP First Stage RTR Temp

RTR Surface Temp
$T_1(t) = C_{1,1} \cdot H \cdot T_{IMP} + C_{2,1} \cdot T_2(t-1) = (C_{2,1} - C_{1,1} \cdot H) \cdot T_1 (t-1)$
Intermediate segments temp ($1 = 2\ TO(L-1)$):
$T_i(t) = C_{1,i} \cdot T_{i-1)\ (t-1)} + C_{2,i} \cdot T_i(t+1)(t-1) + C_{3,i} \cdot T_i(t-1)$
RTR Bore Temp
$T_L(t) = C_{1,L} \cdot T_{(L-1)}(t-1) + C_{2,L} \cdot T_L(t-1)$
RTR Volume Average Temp $$T_{AVG}(t) = \sum_{i=1}^{L} Ti(t) \cdot (Vi) / \left( \sum_{i=1}^{L} Vi \right)$$

Next, the effective temperature difference between the rotor surface temperature $T_1(t)$ *and the volume average temperature* $T_{AVG}(t)$ is in accordance with the following formula:

RTR Effective Temp Diff
For T-root grooves
$T_{DIF}(t) = C_{10} \cdot T_1 (T, + (1-C_{10}) \cdot T_n(t) - T_{AVG}(t)$
For Side-entry grooves
$T_{DIF}(t) = T_{AVG}(t) - T_1(t) + C_{13} N h_{H} 2$
Where $t_i(t)$= Present temperature of ith segment
$T_i(t-1)$ = Previous temperature of *ith* segment
$C_{i,i}$ =Heat conducting constants of *ith* segment(1 +1 TO 3)
$H$ = heat transfer coefficient (steam to rotor surface)
$T_{imp}$ = first stage steam temp (higher value of 2 sensors)
$V_i$ = Volume of *ith* segment
L = Number of segments (upt to 24)
$C_{10,11}$ = Stress constants
$T_n(t)$ = Depends on the depth of grooves
$N$ = Present speed in rpm For extrapolating the 15-minute anticipated value $T_{ANTICIP}$ of the HP rotor effective temperature differenc, $T_{DIF}$, the following formula is used:

$$T_{ANTICIP} =$$
$$= [\,(3 \cdot 15 + 1) \cdot T_{DIF}(t) - 2 \cdot \sum_{i=1}^{15} T_{DIF}(t-i)\,] \,/\, (15+1)$$
$$= 2.875\, T_{DIF}(t) - .125 \sum_{i=1}^{15} T_{DIF}(t-i)$$

Where
$T_{DIF}(t)$ = Present volue of RTR effective temp. diff.
$T_{DIF}(t-i)$ = Stored previoius ith value of RTR effective temp. diff.

The operator indications which are initiated by program PO1 include "HP Rotor Stress Invalid-Vidar out of service, " "steam temperature difference exceeds 25°, " and "HP stress invalid calculation less than 2 hours," for example.

Figure 6A:
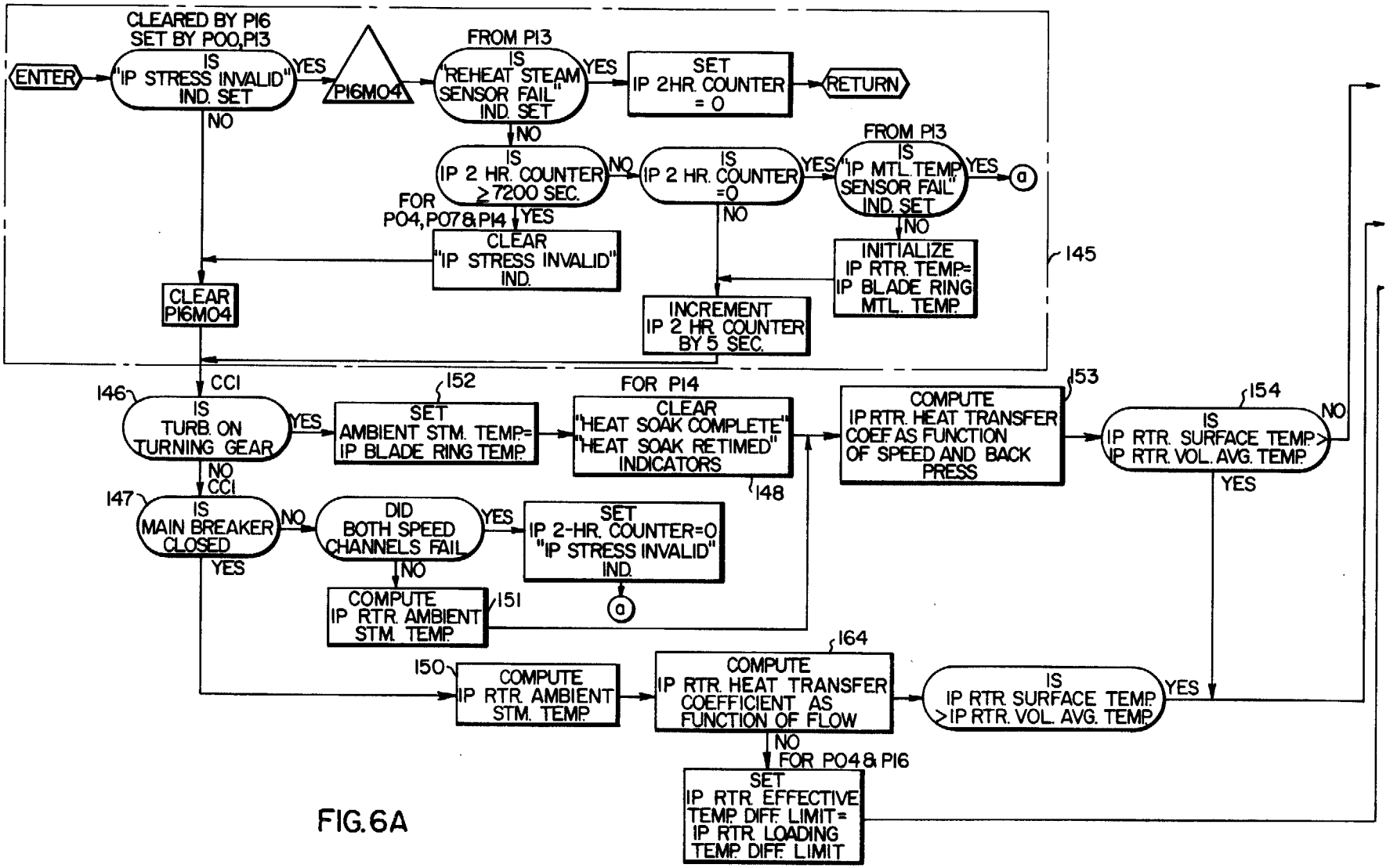
FIG. 6A and 6B is a flow chart of the reheat or IP rotor stress program P16 of the system of FIG. 3.
Figure 6B:
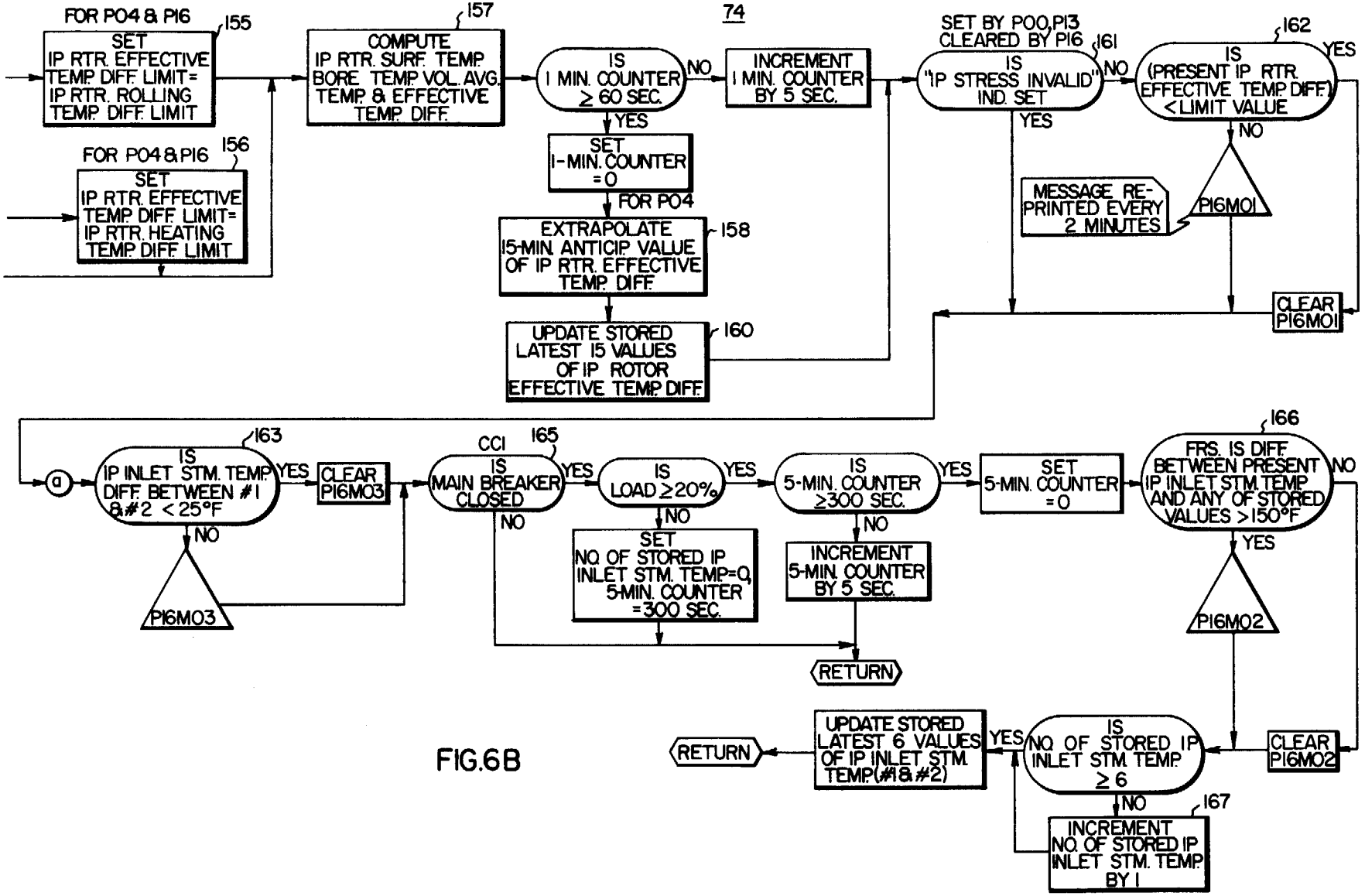

Referring to FIG. 6A and 6B, the IP rotor stress program P16 is operated every five seconds by the program PO0. That portion of the program within dashed lines 145 provides for the 2-hour countdown similar to the previously described HP rotor stress program PO1. The program P16 utilizes the temperature of the IP blade ring, the IP inlet steam temperature, and the IP exhaust steam temperature in its calculations. The program first checks the condition of the plant; that is, whether or not the turbine is on turning gear as shown at 146, the condition of the main breaker at 147, and whether or not the heat soak time of the turbine is complete at 148. Then, the IP rotor ambient steam temperature is computed at 150 and 151, and the ambient steam temperature and IP blade ring temperature is computed at 152 while the turbine is still on turning gear. If the main breaker is open, the IP rotor steam to surface heat transfer coefficient is computed at 153. The IP blade ring metal temperature is checked to determine if it is greater than 250° F minus a predetermined margin at 154. If it is less than 250° F, the IP rotor effective temperature difference limit is set to the equal to a cold IP rotor temperature limit as shown at 155; and if it exceeds 250° F, the IP rotor effective temperature difference limit is set equal to the hot IP rotor temperature limt at 156. The program P16 then computes the IP rotor surface temperature, the IP effective temperature difference as shown by action block 157. Each minute of operation, the anticipated value of the IP rotor effective temperature difference is extrapolated at 158, and the stored latest 15 values of the IP rotor effective temperature difference is updated at 160. After checking the validity of the IP stress at 161, the value of the present IP rotor effective temperature difference is checked at 162 with respect to the limit value which was previously set at either 155 or 156. The program then checks at 163 to determine whether the IP inlet steam temperature between the reheat stop valves differs more than 25° F.

If the main breaker is closed as indicated at 147, after the computation of the IP rotor ambient steam temperature at 150, the IP rotor heat transfer coefficient as a function of steam flow is computed at 164. Then the high or low loading rate flag is checked; and depending on which is set, the IP rotor effective temperature differences limit is set to equal to IP "high load rate" temperature limit, or the "normal load rate" temperature limit. If the main breaker is closed as indicated at 165, the load is then checked to determine whether it is greater than 20%. If such load is less than 20%, the number of stored inlet steam temperature values is set to zero. If it is greater than 20%, then every 5 minutes the inlet steam temperature is stored, and then for the relevant sensor (FRS) the difference between the inlet steam temperature and any of the stored values is checked to determine if it exceeds 150° F. Then, the number of stored inlet steam temperatures is updated at 167.

The IP rotor ambient steam temperature for the various conditions of the turbine is calculated by the following formula:

IP RTR Ambient Steam Temp

Turbine on turning gear
$T_{A1}(t) = T_{A2}8t) = T_{A3}(t) = T_{IP}$ blade ring
Roll off T.G. up to Sync. Speed
$T_{AO}(t) = C_9 \cdot T$ hot reheat steam + $C_{10} \cdot T_{IP\ EXH}$ $$T_{A2}(t) = \frac{(C_{11} \cdot G - .5 \cdot K_{A1}) \cdot T_{A0}(t) + K_{A1} T_{11}(t-1)}{C_{11} \cdot G + .5 \cdot K_{A1}}$$

Figure 14:
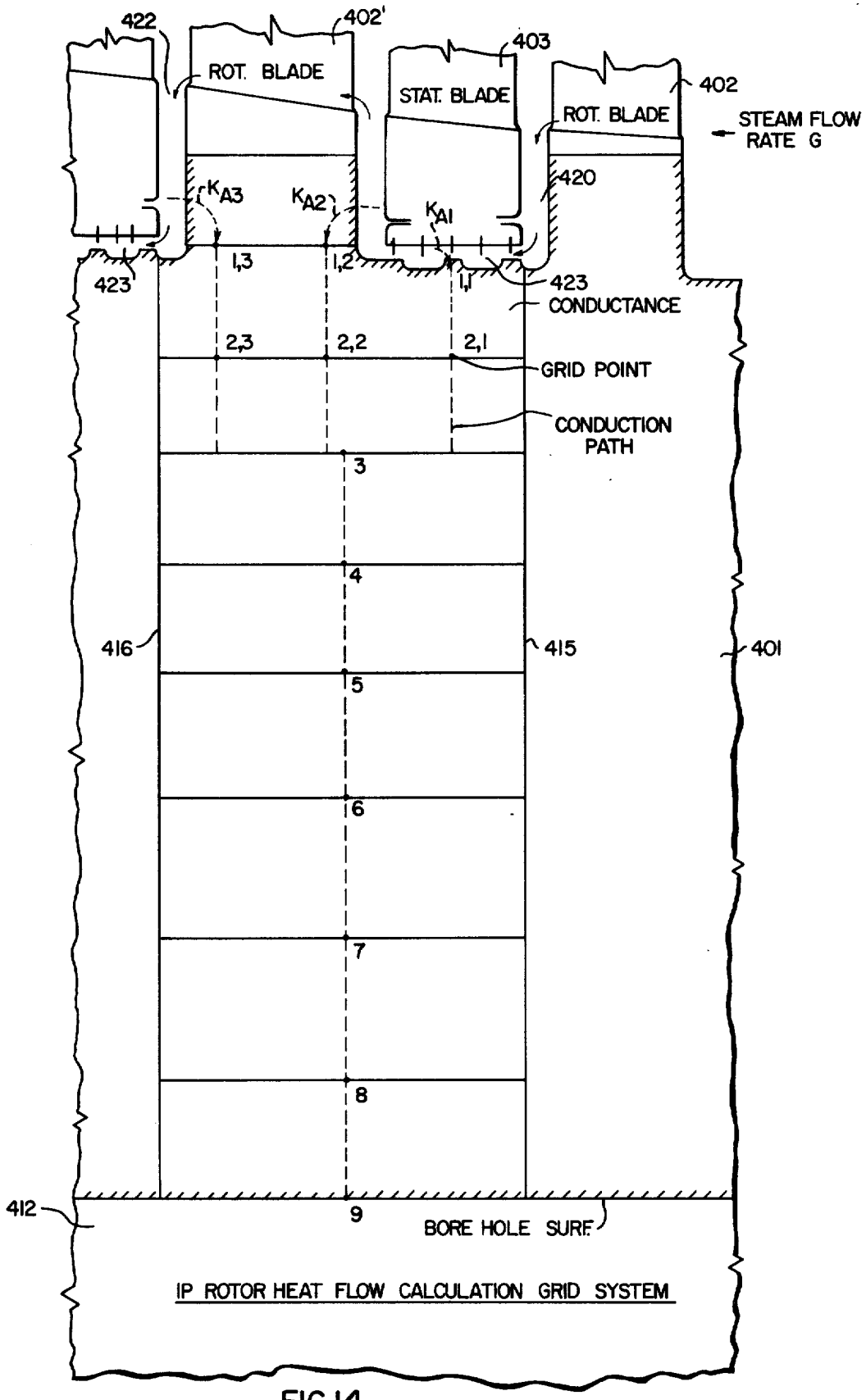

$T_{A1}(t) = 0.5(T_{A0}(t) + T_{A2}(t))$
$T_{A3}(t) = C_{12} \cdot T$ hot reheat steam + $C_{13} \cdot T_{IP\ EXH}$
Turbine on load (Gen. on line)
$T_{A1}(t) = T_{A2}(t) = C_{14} \cdot T$ hot reheat steam + $C_{15}$
$T_{A3}(t) = C_{16} \cdot T$ hot reheat steam + $C_{17}$ Where
$T_{AO}(t)$ = present temp. of steam entering seal strips (See FIG. 14)
$T_{A1}(t)_1$ and $T_{A3}(t)$ = present ambient temp. at corresponding parts of FIG. 14
$C_9$ through $C_{17}$ = Cal. constants
$T_{IP}$ blade ring = IP blade ring metal temperature
$T$ hot reheat steam = hot reheat stm temp (average value)
$T_{IP\ EXH}$ = IP exhaust stm temp.
$T_{A1}(t-1)$ = Previous iteration of grid point (1,1) (FIG. 14) temp.
$K_{A1}$ = Heat conductance of grid point (1.1) (FIG. 14) to ambient steam
$G$ = stm flow rate The IP rotor temperature including the surface temperature, intermediate segment temperature (as shown in FIG. 14), rotor bore temperature, rotor volume average temperature $T_{AVG}(t)$, and the rotor effective temperature difference $T_{DIF}(t)$ for the various types of grooves in the turbine rotor are calculated as shown at 157 according to the followng formulae:

IR RTR Temperature

RTR Surface Temp. ($i$=1)

For $j$=1 TO 3 and $N = (j-1)\cdot 5$ $$T_{1,j}(t) = C_{1,N+1}^{-K_{A1}}[T_{A1}(T-1)-T_{1,j}(t-1)]+C_{1,N+2}\cdot T_{1,(j-1)}(t=1) + C_{1,N=3})\cdot T_{1,j}(t-1)+c_{1,N=4)}\cdot T_{1,(j=1)}(t=1) + C_{1,N+5)}\cdot T_{2,j}(t-1)$$

$$T_{2,j}(t)= C_{2,N+1)}\cdot T_{1,j}(t-1) + C_{2,N+2)}\cdot T_{2,(j-1)}(t-1) + C_{2,N+3)}\cdot T_{2,j}(T-1) + C_{2,N+4)} + C_{2,N=}$$

For $i$ = 4 TO $L-1$ $$T_h(t) = C_{1,3}\cdot T_{(i+1)}(t-1) + C_{1,2}\cdot T_i(t-1) + C_{1,3}\cdot T_{i=1)}(t-1)$$

RTR Bore Temp. ($i$ $$T_i(t) = C_{1,1}\cdot T_7)(t-1) + C_{1,2}\cdot T_3(t-1)$$

RTR Volume Average Temp.

$$T_{AVG}(t) = \frac{\left(\sum_{i=1}^{2}\sum_{j=1}^{3} T_{i,j}(t)\cdot V_{i,j}\right) + \left(\sum_{K=3}^{L} T_K(t)\cdot V_K\right)}{\left(\sum_{i=1}^{2}\sum_{j=1}^{3} V_{i,j}\right) + \left(\sum_{K=3}^{8} V_F\right)}$$

RTR Effective Temp Diff

For Side Entry Grooves $$T_{DIF}(t)= T_{AVG}(t) - T_{1,2}(t) + C_{19}\cdot N^2$$

Where $C_{i,j}$ = Heat conducting constants $T_{i,j}(t)$ = Present temp. of the *ith* segment *jth* subsection $t_{i,j}(t-1)$ = Previous temp, of above $V_{i,j}$ = Volume of the *i*the segment *j*th subsection $V_k$ = Volume of the *k*th segment $C_{19}$ = Stress constants $L$ = number of segments $N$ = Present speed in rpm The IP rotor steam to surface heat tranfer coefficient H is computed at in accordance with the following formula:

IP RTR STM to Surface Heat Transfer Coefficient $$H_1 = C_1\cdot G^{.7}$$

$$H_2 = H_3 = C_2\cdot G^{.8}$$

Where $H_2$, and $H_3$ = Heat Transfer Coef (see FIG. 14)

$G$ = Stm flow rate (% of rated flow)

$G$ = Cal. result from basic DEH when under load control mode $G = C_3P + C_4N = C_5\cdot C_6\cdot N^2 + C_7\cdot P^0N + C_8$ when under speed control mode $C_1$ through $C_8$ = Cal. constants $P$ = Highest value of condenser press (No. 1, No. 2, and No. 3)

$N$ = Turbine Speed in rpm

The IP rotor heat conductance to ambient steam temperature $K_{A1}$, $K_{A2}$, and $K_{A3}$ are calculated in accordance with the following formula*

IP RTR Heat Conductance to Ambient Stm $$K_{A1} = \frac{1}{C_{18}/H_1 + C_{19}}$$

-continued $$K_{A2} = K_{A3} = \frac{1}{\frac{C_{20}}{\mathrm{LOG}_E(1 + C_{21}\cdot H_2)} + C_{22}}$$

Where $K_{A1}$, $K_{A2}$, and $K_{A3}$ = heat conductance at grid point (1,1), (1,2), and (1,3) of FIG. 14

$H_1$, $H_2$ = Heat transfer Coef.

$C_{19\text{-}22}$ = Cal. constants

The extrapolation of the IP rotor effective temperature difference as calculated at 158 is accomplished in accordance with the following formula:

$$T_{ANTICIP} = [3\cdot 15 + 1\cdot T_{DIF}(t) - 2\cdot \sum_{1=1}^{13} T_{DIF}(t-i)\,]\,/\,(15+1)$$

$$= 2.875\cdot T_{DIF}(t) - .125\sum_{1=1}^{15} T_{DIF}(t-i)$$

$T_{DIF}(t)$ = Present value of RTR effective temp diff $T_{DIF}(t-i)$ = Stored previoius ith value of the above diff.

The operator indications initiated by program P16 are as follows:

P16MO1 = IP RTR Stress GT present cycle life Lim. Value (% = LIM) = XXX

P16MO2 = Hot reheat stm temp drop 150° F at rate exceeding 300° F/Hr

P16MO3 = Stm temp diff between RSV's exceeds 25° F

P16MO4 = IP Stress Invalid – Cal. less than 2 Hr.

Figure 7A:
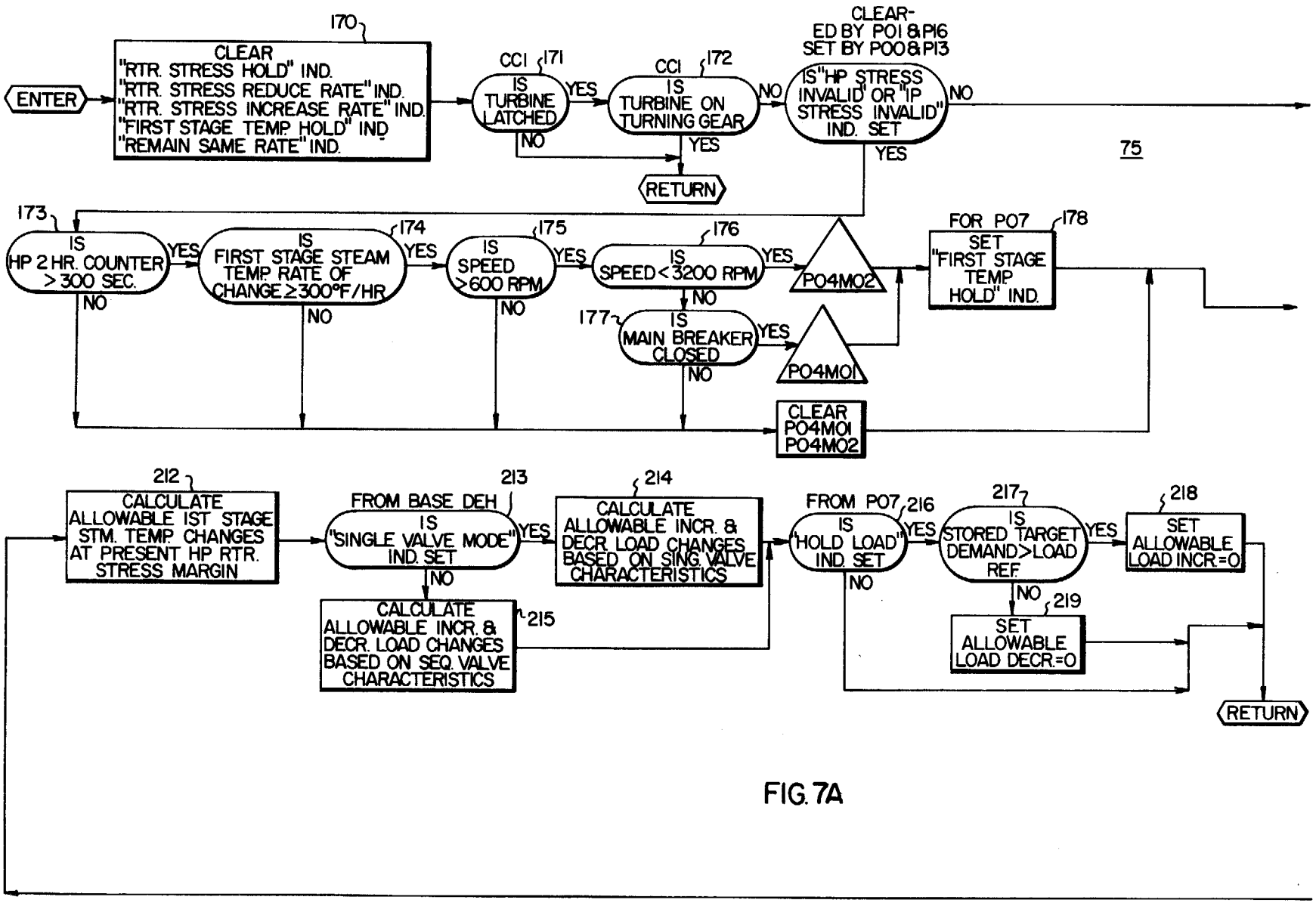
FIG. 7A, 7B and 7C is a flow chart of the rotor stress control program PO4 of the system of FIG. 3.
Figure 7B:
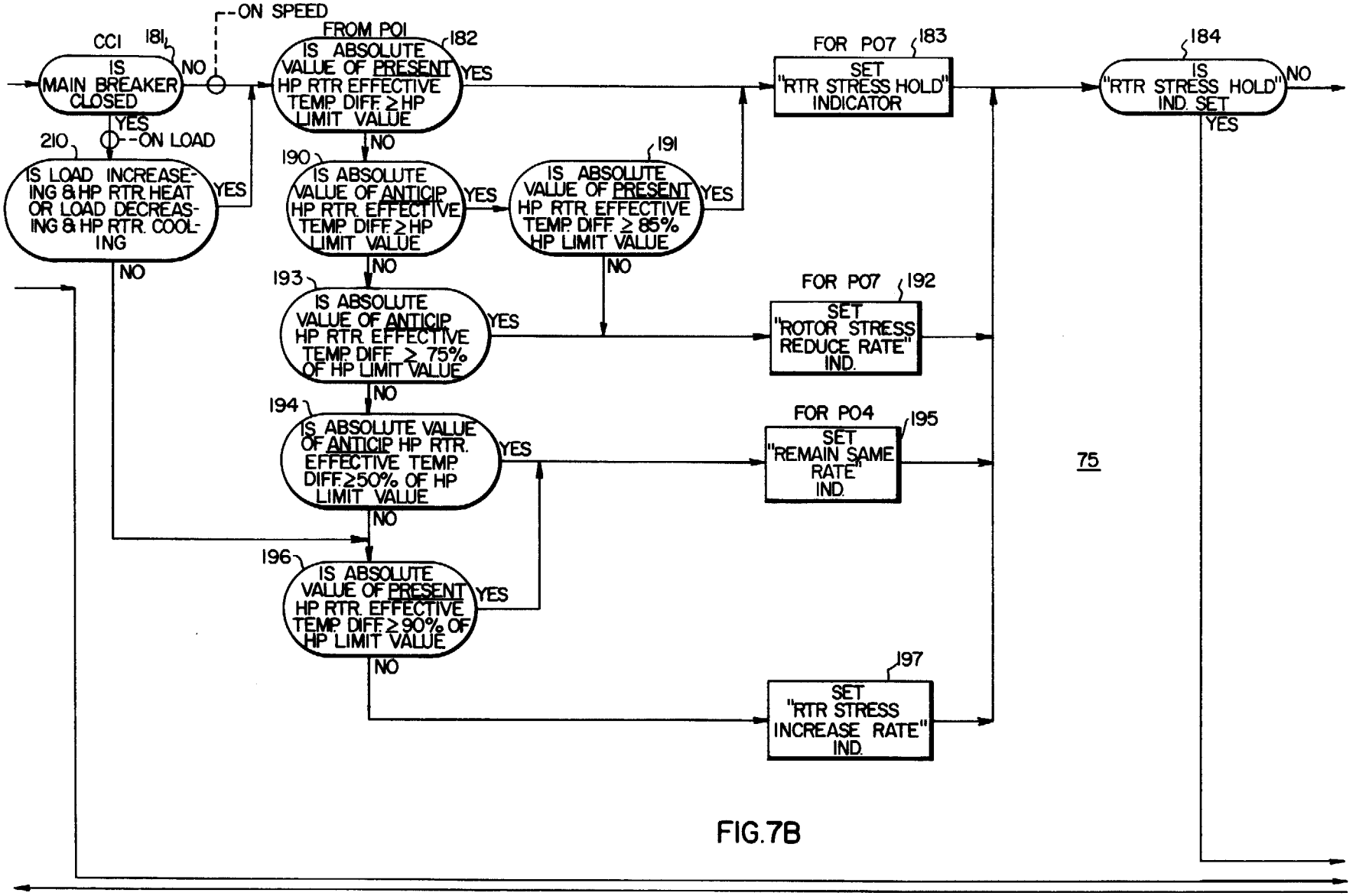
Figure 7C:
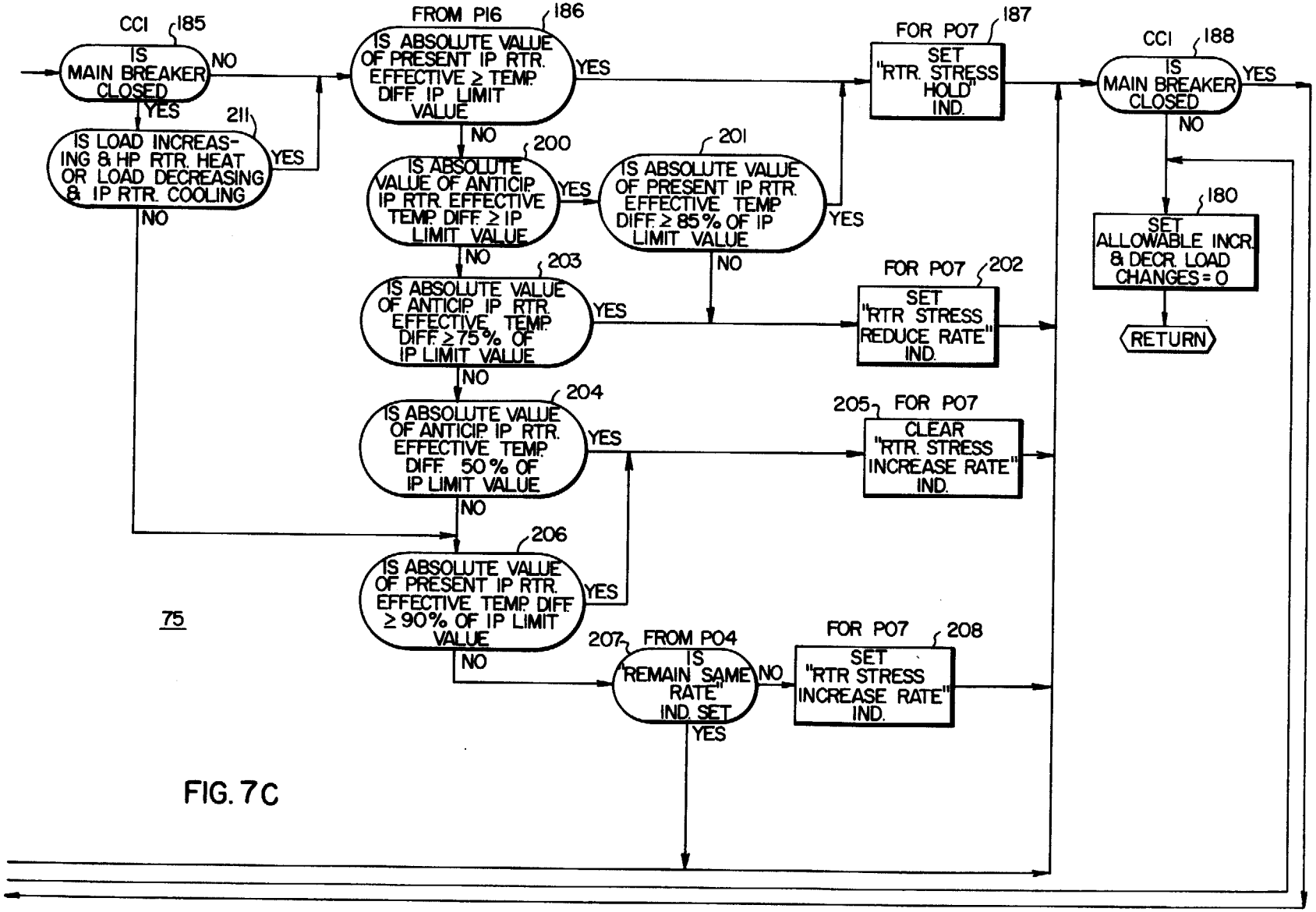

Referring to FIG. 7, the program PO4 referred to as the rotor stress control program, is placed into operation every thirty seconds and functions to command the speed demand and acceleration loading rate control program PO7, in accordance with the previously described computations and logic of the HP rotor stress and IP rotor stress programs PO1 and P16 respectively. Each time the program PO4 is run, it first clears the various flags as indicated at 170; and then checks on the operational status of the turbine as indicated by blocks 171 and 172. In the event the HP stress invalid or the IP stress flag is set, the program PO4 checks determine whether the 2-hour counter previously described has completed its countdown at 173. If such is the case, the first stage steam temperature rate of change is detected to determine if such change is greater than 300° F per hour at 174. If it is greater than such rate, block 175 determines if the turbine speed is greater than 600 rmp; and block 176 determines whether the speed is less than 3200 rpm. If the speed is less than 3200 rpm, block 177 checks the condition of the main breaker. In addition, a flag to hold the first stage temperature is set at 178, and the program P14 then sets the allowable increase or decrease load changes to zero as shown at 180.

When all conditions are met such that the turbine may be controlled by the ATC system, the program checks at 181 the condition of the main circuit breaker. If the circuit breaker is open indicating that the system is on wide range speed control, the absolute value of the present HP rotor effective temperature difference is compared with the HP limit value at 182. If the temperature difference is greater than the HP limit value, the "rotor stress hold" flag is set at 183. The program then checks at 184 the condition of the "rotor stress hold" flag, and the condition of the main breaker at 185. Then the absolute value of the present IP rotor effective temperature difference is compared with the IP limit value at 186; and if such temperature difference is equal to or greter than the IP limit value, a "rotor stress hold" flag is set at 187. After again checking the condition of the main breaker at 188, the allowable in crease or decrease of any load change is set to equal zero at 180. Thus, under these conditions the system permits the turbine to be controlled at the present speed or load at which it is operating, but does permit a speed or rate increase. For other conditions, considering first the condition of the HP rotor, where the block 182 determines that the present temperature difference is less than the HP limit value, a block 190 determines whether or not the absolute value of the anticipated HP rotor effective temperature difference is equal to or greater than the HP limit value. Assuming that such anticipated temperature difference is equal, the absolute value of the present HP rotor temperature is checked at 191 to determine if the difference is greater than 85% of the HP limit value. If such is the case, then the program continues through the block 183 and the "rotor stress hold" flag is set as in the previous example. Assuming that the present temperature difference is less than 85% of the HP limit value, a flag "rotor stress reduce rate" in block 192 is set; and the program proceeds along the same path as described in the previous example.

Assuming that the anticipated HP rotor temperature difference is less than the HP limit value, a check is made at 193 to determine if the absolute value of the anticipated temperature difference is greater than 75% of the HP limit value. If such is the case, the flag is set at 192 for reducing the stress rate as in the preceding example. Assuming that such temperature difference is les than 75% of the HP limit value, the anticipated HP rotor effective temperature difference is then checked at 194 to determine if it is greater than 50% of the HP limit value. Thus, with the anticipated temperature difference being between 50 and 75% of the HP limit value, a flag for maintaining the same rate at 195 is set and the program proceeds, s in the preceding example. Should the value of the anticipated HP rotor temperature difference be less than 50% of the HP limit value, then the system checks at 196 to determine whether or not the present HP rotor effective temperature difference is greater than 90% of the HP limit value. If such is the case, the flag for maintaining the same rate is set at 195. In the event that the value of the present HP rotor temperature difference is less than 90% of the HP limit value, than a "rotor stress increase rate" flag at 197 is set for increasing the rate of speed of the turbine. However, the condition of the reheat or IP rotor overrides the previously given examples of the condition of the present and anticipated HP rotor stress. Thus, the program goes through a single path entering the block 184 to check the condition of the reheat or IP rotor on wide range speed control.

With respect to the IP rotor stress, after the appropriate flags have been set, as previously described in connection with the HP rotor stress, the system checks at 184 for the condition of the "rotor stress hold" flag. In the event that it is set, and the block 188 indicates that the main breaker is open, the allowable increase and decrease load change is set to zero at 180 without the necessity of checking the condition of the IP rotor stresses. However, in the event that the "rotor stress hold" flag is not set, the block 185 checks the condition of the main breaker, which for this situation is open, and the IP rotor effective temperature difference is compared with its limit value. In the event that the present IP rotor temperature difference is equal to or greater than its limit value, the "rotor stress hold" flag is set at 187 and the program exits as previously mentioned. However, in the event that the IP effective temperature difference is less than the limit value, the anticipated effective temperature difference is checked to determine whether it is equal to or greater than its limit value at 200. If such is the case, the present IP rotor temperature difference is checked at 201 to determine if it is equal to or greater than 85% of the limit value, and if such is the case, the "rotor stress hold" flag is set at 187. In the event that the present IP rotor temperature difference is less than 85% of the IP limit value, the "rotor stress reduce rate" flag is set at 202. In the event that the block 186 is negative indicating that the IP rotor temperature difference is less than the IP limit value, and a block 203 determines that the absolute value of the anticipated IP rotor effective temperature difference is equal to or greater than 75% of the IP limit value, the decision block 202 sets the "rotor stress rate" flag. Should such anticipated IP rotor temperature difference be less than 75% of the IP limit value, but greater than 50% of the IP limit value as shown at 204, then the "rotor stress increase rate" flag is set at 205. If such anticipated temperature difference is less than 50% of the IP limit value, but the absolute value of the present IP rotor temperature difference is equal to or greater than 90% of the IP limit value of 206, then the "rotor stress increase rate " flag is cleared at 205. In the event that the present IP rotor effective temperature difference is less than 90% of the limit value for the IP rotor, and the "remain at the same rate" flag has not been set by the HP stress comparison as previously mentioned, which is checked at 207, then the "rotor stress increase rate" flag is set at 208.

For load control of the turbine, a decision block 181 determines that the main breaker is closed. Then at decision block 210 it is determined whether or not the load is increasing and the HP rotor heating; or that the load is decreasing and the HP rotor is cooling. If either condition is occurring, then the logic previously described for the HP rotor in connection with wide range speed control is followed to set the appropriate flags for either holding the rotor stress, reducing the rotor stress rate, permitting the rate to remain the same, or increasing the rotor stress rate. However, in the event that the HP rotor is not heating or or cooling as decided at 210, then the program checks the present HP rotor effective temperature difference at 196 to determine whether or not to set the flag at 195 for causing the load rate remain the same, or set the flag for increasing the rotor stress rate at 197. For the IP stress, with the main breaker closed at 185, the heating and cooling of the IP rotor with the load increasing or decreasing is checked at 211. In the event that the load is increasing and the IP rotor heating, or the load decreasing and the IP rotor cooling, then the same values are checked as previously described in connection with the IP stress for wide range speed control. However, if such is not the case, then the value of the present IP rotor temperature difference is compared at 206 to either clear the rotor stress increase rate at 205 if the difference is equal to or greater than 90% of the IP limit value, or set the rotor stress increase rate at 208 if the flag for having the rate remain the same at 207 was not previously set by the HP stress comparison.

After setting the flags in connection with the previously described logic for load control, the indication that the main breaker is closed by the decision block 188 then causes a calculation of the allowable first stage steam temperature changes at the present HP rotor stress margin as indicated by decision block 212. Then, from the base DEH system (FIG. 2) the system determines the valve mode at 213. If the single valve mode flag is set indicating that the system is operating with full arc admission, then the allowable increase and decrease in load changes is calculated based upon the single valve characteristics as indicated at 214. In the event that the system is in the sequential or partial arc mode, then the allowable increase and decrease load changes based upon the sequential valve characteristics is calculated at 215. In the event that a flag "hold mode" is set from the program PO7 hereinafter described as indicated at 216, then the program checks to determine if the stored target demand is greater than the load reference at 217. If such is the case, then the allowable load increase is set to zero at 218. If the target demand is less than the load reference, then the allowable load decrease is set to zero at 219.

In determining whether the load is increasing and the HP rotor is heating, or whether the load is decreasing and the HP rotor is cooling at 210, the first stage steam temperature is compared with the calculated rotor surface temperature. If the first stage steam temperature is greater than the calculated rotor surface temperature, the HP rotor is heating. If the first stage steam temperature is not greater than the calculated rotor surface temperature, the rotor is cooling. With respect to the determination for the IP rotor at 211, the IP rotor is heating if the calculated ambient steam temperature is greater than the calculated rotor surface temperature at grid point (1,2) (FIG. 14). If the calcualted ambient steam temperature is not greater than the calculated rotor surface temperature at such grid point, the IP rotor is cooling.

The allowable first stage steam temperature changes at the present HP rotor stress margin which are calculated at 212 are arrived at in accordance with the following formula:

For RTR with T-Root Grooves $$T_{INCR} = \frac{T_{AVG}(t) - (1 - C_{10})\, T_u(t) + T_{Limit}}{C_{10}}$$

$$T_{DECR} = \frac{T_{AVG}(t) - (1 - C_{10})\, T_u(t) - T_{Limit}}{C_{10}}$$

For RTR with Side-Entry Grooves $$T_{INCR} = T_{AVG}(t) + C_u \cdot N^2 + T_{Limit}$$

$$T_{DECR} = T_{AVG}(t) + C_u \cdot T_{Limit}$$

Where $T_{INCR}$ — Allowable Incr first Stage Stm Temp
$T_{DECR}$ — Allowable Decr first Stage Stm Temp
$T_{AVG}(t)$ — Present HP RTR Volume Average Temp
$I_U(t)$ — Present HP RTR $T_U$ Temp
$C_{10,N}$ — Stress Constants
$T_{Limit}$ — Present HP RTR Effective Temp Diff Limit.

At 214, the allowable increase and decrease of the load based on single valve characteristics is calculated in accordance with the following formula:

Single Valve Operation $$MW_{INCR} = \frac{T_{INCR} - T_{IMP}}{M_1} \cdot MW_{RATED}$$

$$MW_{DECR} = \frac{T_{IMP} - T_{DECR}}{M_1} \cdot MW_{RATED}$$

If $MW_{INCR} < 0$ SET $MW_{INCR} = 0$

If $MW_{DECR} < 0$ SET $MW_{DECR} = 0$

Where $M_1$ — Slope of first Stage Steam Temp vs. MW Curve at rated throttle conditions.

The allowable increase and decrease load change based on the sequential valve characteristics calculated in the block 215 are in accordance with the following formula:

$$T_{R1} = T_{RATED} - (LB_{RATED} - L_{Present}) \cdot M_2$$

(For $L_{Present} \leq LB_{Rated}$)

$$T_{R1} = T_{RATED} + (L_{Present} - LB_{Rated}) \cdot M_2$$

(For $L_{Present} > LB_{RATED}$)

$$LB_{Present} = LB_{RATED}\left(\frac{TO_{Present}}{TO_{RATED}}\right)$$

$$TR_2 = T_{RATED} - (LV_{RATED} - LB_{Present}) \cdot M_3$$

(For $L_{Present} \leq LB_{RATED}$)

$$TR_2 = T_{RATED} - (LB_{Present}) \cdot N_2$$

(For $L_{Present} > LB_{RATED}$)

$$T_{BP} = T_{R2} - (T_{R1} - T_{IMP})$$

(i) If $T_{DECR} \geq T_{BP}$ $$MW_{INCR} = \frac{T_{INCR} - T_{IMP}}{M_2} \cdot MW_{RATED}$$

$$MW_{DECR} = \frac{T_{IMP} - T_{DECR}}{M_2} \cdot MW_{RATED}$$

(ii) If $T_{INCR} \leq T_{BP}$ $$MW_{INCR} = \frac{T_{INCR} - I_{IMP}}{M_3} \cdot MW_{RATED}$$

$$MW_{DECR} = \frac{T_{IMP} - T_{DECR}}{M_3} \cdot MW_{RATED}$$

(iii) If $T_{INCR} > T_{BP} > T_{DECR}$

For $T_{IMP} \geq T_{BP}$ $$MW_{INCR} = \frac{T_{INCR} - T_{IMP}}{M_2} \cdot MW_{RATED}$$

$$MW_{DECR} = \frac{(T_{IMP} - T_{BP}}{M_2} + \frac{T_{BP} - T_{DECR})}{M_3} \cdot MW_{RATED}$$

For $T_{IMP} < T_{BP}$ $$MW_{INCR} = \frac{(T_{INCR} - T_{BP}}{M_2} + \frac{T_{BP} - T_{IMP})}{M_3} \cdot MW_{RATED}$$

$$MW_{DECR} = \frac{T_{IMP} - T_{DECR}}{M_3} \cdot MW_{RATED}$$

If $MW_{INCR} < 0$ From (i), (ii), or (iii); Set $MW_{INCR} = B$

If $MW_{DECR} < 0$ From (i), (ii), or (iii); Set $MW_{DECR} = B$

Where $LB_{RATED}$—%Load at Break Point Of first Stage Stm Temp vs. MS Curve Under Rated Throttle Conditions $T_{RATED}$ —]First Stage Temp at Above Break Point $LB_{Present}$ — % Load at Break Point of First Stage Stm. Temp vs. MW Curve Under Present Throttle Conditions $T_{BP}$ — First Stage Stm Temp at Above Break Point $L_{Present}$ — PRESENT % Load Reference $T_{R1}$ — First Stage Stm Corresponding to Present % Load $T_{R2}$ — First Stage Stm Temp Corresponding to $LB_{Present}$ % Load on Rated Throttel Condition Curve $M_2$ — Slope of Upper Sector of first Stage Stm Temp vs. MW Curve at Rated Throttle Conditions $M_3$ — Slope of Lower Sector of First Stage Stm Temp vs. MW Curve at Rated Throttle Conditions $T_{IMP}$ — Present First Stage Stm. Temp.

$T_{INCR}$, $T_{DECR}$—From PO4.2

$MW_{RATED}$ — RATED MW $MW_{INCR}$ — Allowable Incr Load in MW $MW_{DECR}$ — Allowable Decr Load in MW The setting of the various flags for either holding the rotor stress, reducing the rate of rotor stress, increasing the rate or rotor stress, or governing the rate to remain the same, is utilized by the program PO7 for controlling the speed demand and acceleration and the load rate hereinafter described.

The operator indications initiated by program PO4 are as follows:

PO4MOI = Hold LD. fast CHG. First STG. STM Temp. LIM = YYYF CHG = XXXF

PO4MO2 = Hold SPD. fast CHG. First STG. STM Temp. LIM = YYYF CHG = XXXF

Figure 8A:
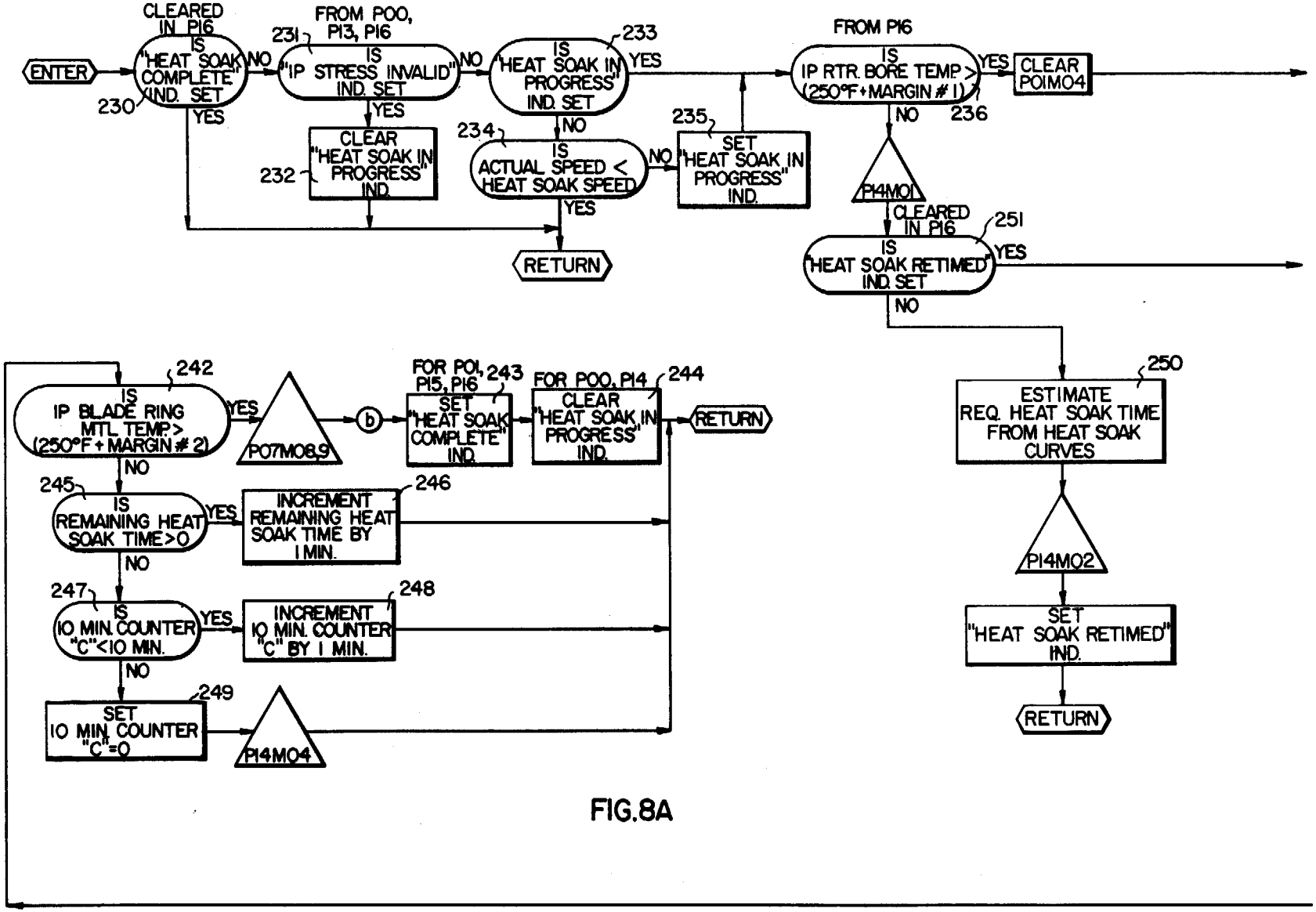
FIG. 8A and 8B is a flow chart of the heat soak program P14 of the system of FIG. 3.
Figure 8B:
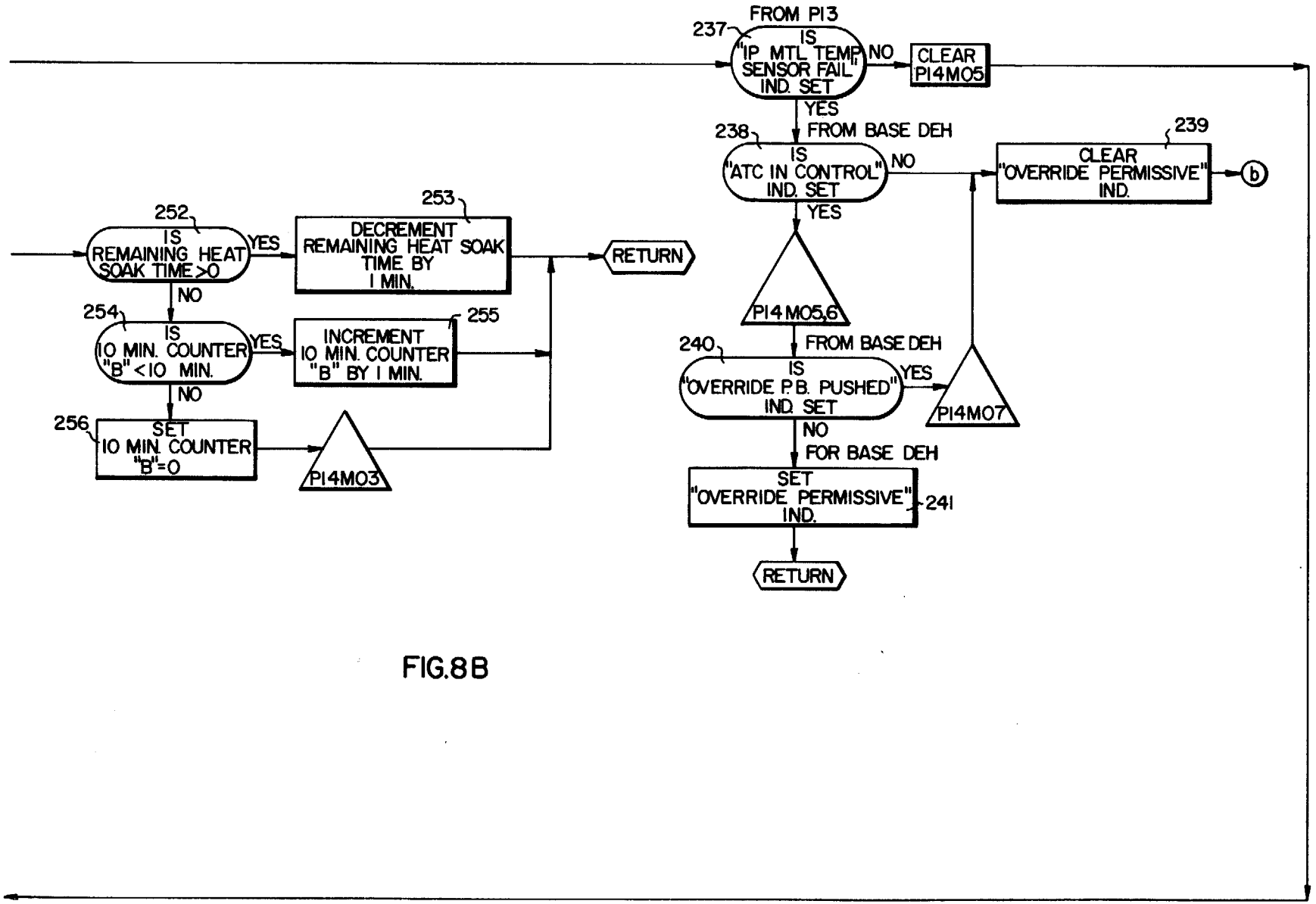

Referring to FIG. 8, the heat soak program P14 is activated by the program P00 every 60 seconds. The program first determines whether or not the "heat soak complete" flag is set at 230, which is cleared by the program P16 each time it is run when the turbine is on turning gear. In the event that the "heat soak complete" flag is set, the program merely returns without further action. In the event that the "heat soak complete" flag is not set, the program then checks to determine the validity of the IP stress signal at 231. If the system shows in invalid signal, block 232 clears the "heat soak in progress" flag and the program exits. If the stress signals are valid, decision block 233 determines whether the "heat soak in progress" flag is set. If it is not set, decision block 234 determines whether the actual speed is less than the heat soak speed, which informs the system that the speed of the turbine has not yet reached 2200 rpm's approximately. If the actual speed is not less than the heat soak speed, the "heat soak in progress" flag is set as indicated by block 235. This same indicator 235 is also used to turn on or off the ATC status light indicating that a "heat soak" is in progress.

The system then checks at 236 to determine whether the IP rotor bore temperature is greater than 250° F plus a predetermined margin. Then, if the IP metal temperature sensor failure flag at 237 is not set, the operator is so informed. If the sensor is out of service, decision block 238 then determines whether the operator has placed the "ATC in control". If not, a flag indicated at 239 is cleared which extinguishes the ability of the operator to override the ATC control. If the turbine system is in ATC control, then an indicator is set advising the operator to check the heat soak curve for sufficient soak time before attempting to override the ATC system. In the event that the operator has operated the override pushbutton as indicated by block 240, a panel light informing the operator that the heat soak has been terminated by operator override is lit. The "override permissive" flag is set at 241 for the base DEH system. Thus, in the event that the calculated IP rotor bore temperature is greater than 250° F plus a margin, and the IP blade ring sensor has failed, the operator may override the ATC system, having been given the aformentioned warnings.

If 237 indicates that the IP blade ring temperature sensor has not failed, then the determination of whether the IP blade ring metal temperature is greater than 250° F plus a predetermined margin is made at 242. If such is the case, the operator is informed that the heat soak is complete, and that the calculated rotor bore temperature is greater than a predetermined temperature and also that the IP blade ring temperature is greater than a predetermined temperature. Also, block 243 sets the "heat soak complete" flag for the other subprograms of the ATC system and clears the "heat soak in progress" flat at 244 for the appropriate ATC programs. However, in the event that the blade ring's metal temperature is less than 250° F plus the predetermined margin, block 245 determines whether the remaining heat soak time is greater than zero. If it is greater than zero, the remaining heat soak time is incremented by 1 minute, as shown at 246; and if it is not greater than zero, a 10-minute counter C is checked at 247 to determine if it is less than 10 minutes. If the counter is less than 10 minutes, the counter is incremented by 1 minute at 248; and if it is not less than 10 minutes, the 10-minute counter C is set to zero at 249. The operator is also informed that additional heat soak time is required because the IP blade ring temperature is less than a predetermined temperature. The counter C is provided to inform the operator of this situation every 10 minutes.

The IP rotor bore temperature flag indicating that the temperature is less than 250° F plus a margin, is utilized to provide the operator with an estimate for indication purposes only of the entire heat soak time that may be required. This is accomplished by estimating the required heat soak time at 250 and informing the operator of such time by the indicator hereinafter listed. Also, if the IP rotor bore temperature is less than 250° plus the margin, the program checks at 251 whether the "Heat soak retimed" flag is set; and if the remaining heat soak time has not expired as indicated at 252, then the remaining heat soak time is incremented by 1 minute in block 253. The blocks 254, 255 and 256 provide the logic for checking and informing the operator by way of the appropriate indicator every 10 minutes that additional heat soak time is required in accordance with the required calculated rotor bore temperature.

The operator indications initiated by program P14 are as follows:

P14MO1 = Heat soak required CAL. RTR. bore temp. = XXXF

P14MO2 = Estimated heat soak time = XXX MIN

P14MO3 = Additional heat soak required CAL. RTR bore temp. LT YYYF temp = XXXF

P12MO4 = Additional heat soak required IP BLD ring temp. LT YYYF temp = XXXF

P14MO5 = CAL. RTR bore temp. GT YYYF IP BLD ring temp sensor out of service

P14MO6 = Check heat soak curve for sufficient soak time before override

P14MO7 = Heat soak terminated by operator override

P14MO8 = Heat soak complete

P14MO9 = CAL. RTR bore temp. GT YYYF IP BLD ring temp. GT YYYF

Figure 9A:
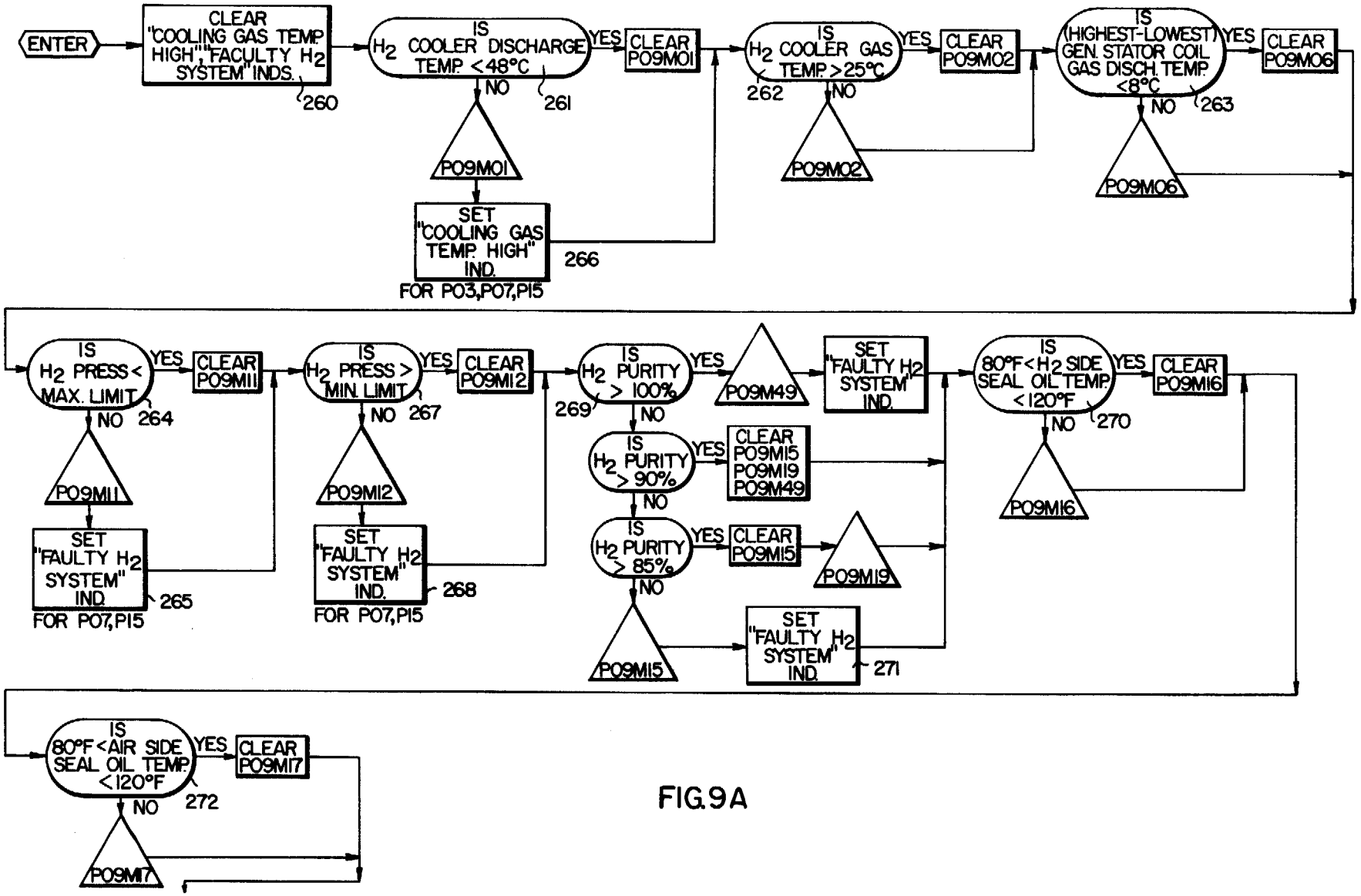
FIG. 9A, 9B and 9C is a flow chart of the generator supervision program PO9 of the system of FIG. 3.
Figure 9B:
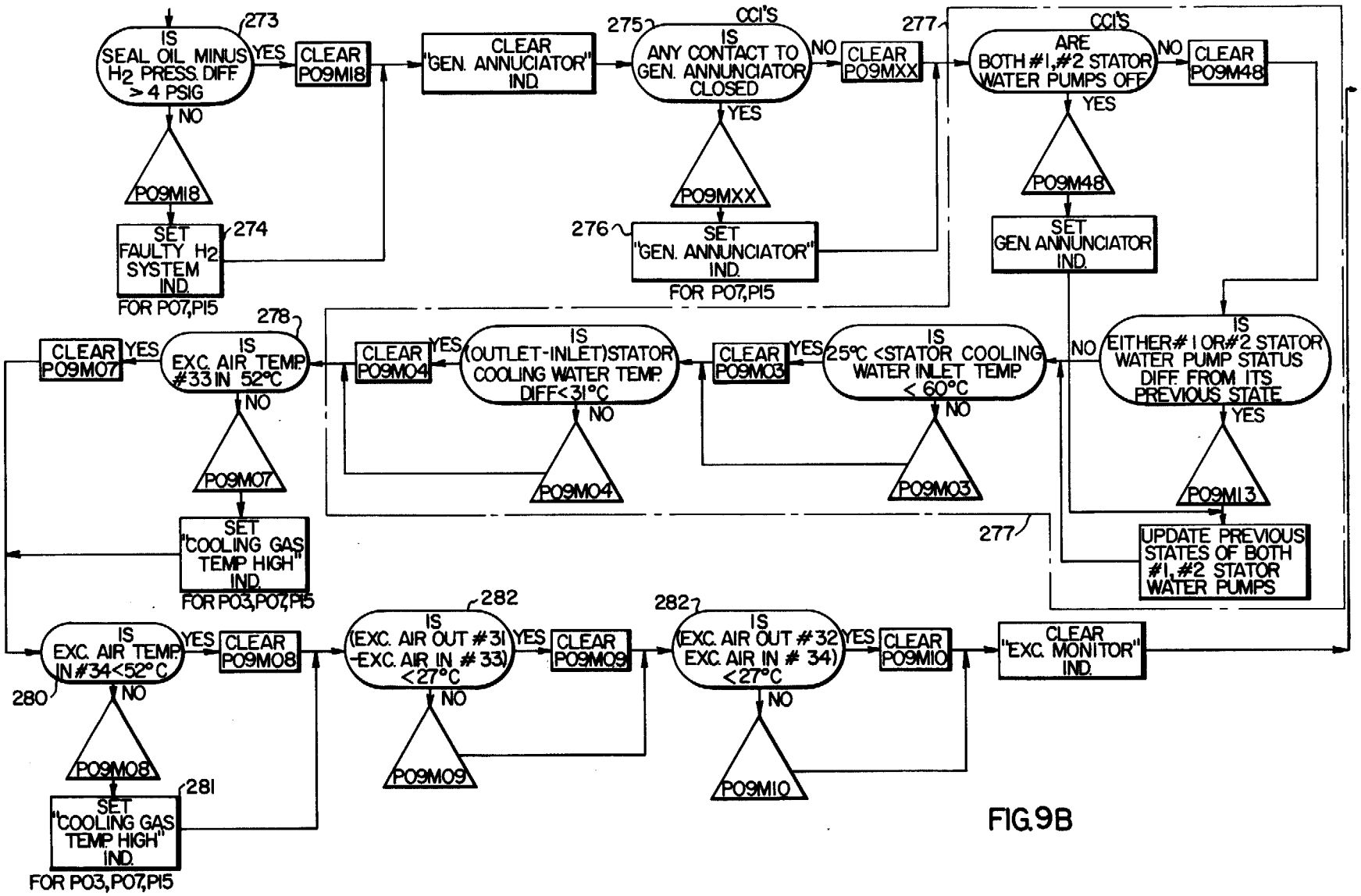
Figure 9C:
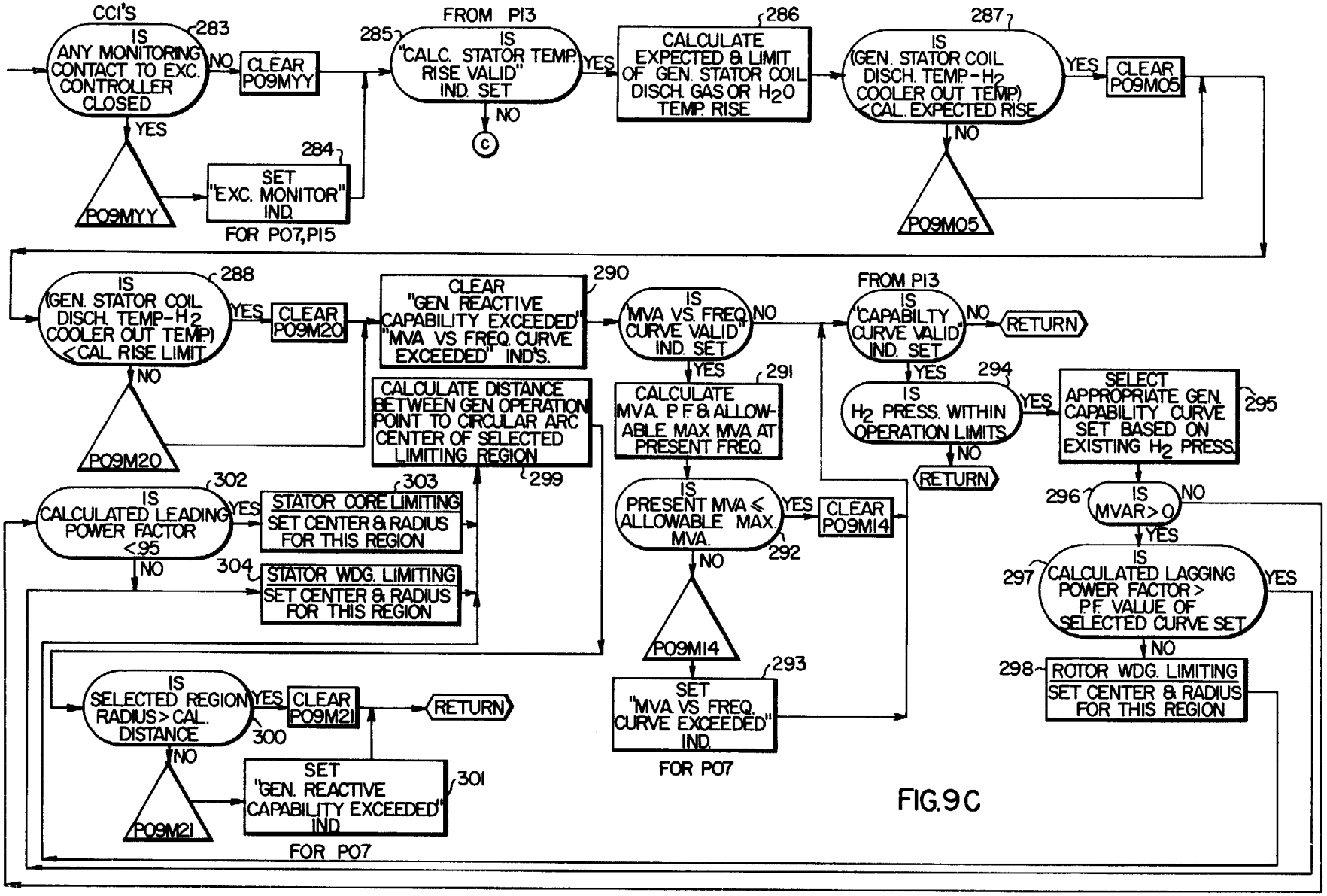

Referring to FIG. 9, for the automatic control of the loading of the generator PO9, not only must the turbine conditions be checked and controlled, but also various operating parameters of the electrical generator itself. The program for supervising the conditions of the generator is initiated every 60 seconds by the program P00. The program enters at 260 and clears the "cooling gas temperature high" and "faulty hydrogen (hereinafter referred to as $H_2$) system" flag. The system then determines whether or not the $H_2$ cooler discharge temperature is less than 48° C at 261. In this decision block, the highest value of up to 4 $H_2$ cooler temperature sensors is utilized. If the temperature is equal to or greater than 48° C, an indicator informs the operator that the $H_2$ cooler discharge temperature is at its high limit. If it is less than the 48° C, the indicator is cleared. The program then determines whether or not the $H_2$ cooler discharge temperature is greater than 25° C at 262. If the temperature is not greater than 25° C, the operator is informed that the $H_2$ cooler discharge temperature low limit equals a predetermined temperature; and if it exceeds such temperature, then such operator indication is cleared. For the decision block 262, the lowest value of up to 4 $H_2$ cooler discharge temperature sensors are used. At 263, a check is made to determine whether or not the difference between the highest and the lowest generator stator coil gas discharge temperature is less than 8° C. It is is less, the operator is informed that the maximum temperature difference between gas discharges exceeds the temperature limit; and if it is less than the maximum limit of 8°, then such indication is cleared.

Next the $H_2$ pressure is checked in block 264 to determine if it is less than the maximum limit. If it is not less than the maximum limit, then an indicator informs the operator that there is a faulty $H_2$ system, and a flag "faulty $H_2$ system" is set at 265 for use in the program PO7, hereinafter described. A "cooling gas temperature high" flag at 266 is provided for use of the program PO7. The program then determines at 267 that the $H_2$ pressure is greater than the minimum limit; if it is not, a flag is set at 268 that there is a "faulty $H_2$ system" for use by the program PO7. The program PO9 then checks the purity of the hydrogen system; and if it is greater than 100% as indicated at 269, the program then determines at 270 whether or not the $H_2$ side of the seal oil temperature is out of limit. If it is below 80° or higher than 120°, an indication of this fact is given to the operator. In the event that the $H_2$ purity is less than 90% but greater than 85%, an indication is given to the operator that the $H_2$ purity is low. If it is less than 85%, then an indication is given that the $H_2$ purity is very low, and a flag "faulty $H_2$ system" for the program PO7 is set at 271.

The program then checks the air side of the seal oil temperature at block 272. If it is below 80° F or greater than 120° F, an indication is given to the operator that the air side seal oil temperature is out of limit. If the seal oil pressure minus the $H_2$ pressure is not greater than 4 psig, as indicated at 273, then the operator is informed that the seal differential pressure is low and to correct the fault immediately or trip and purge the $H_2$ system. Consequently, a "faulty $H_2$ system" flag is set at 274 for the program PO7.

On the generator $H_2$ panel, there are a number of annunciators which are closed for a respective alarm condition. The program checks at 275 if any of these generator annunciator contacts are closed; and if they are, an appropriate indication is made and a flag is appropriately set at 276 for the program PO7. The portion of the program within the dashed lines referred to at 277 is provided for generators that are water cooled and merely checks the status of the water pump and the water inlet and outlet temperatures to inform the operator accordingly at the various indicators. The exciter air temperature is checked at 278; and if it is greater than 52° C, then the operator is appropriately informed, and a flag "cooling gas temperature high" is set for the program PO7. A similar check is made at 280 to determine if the exciter air temperature is less than 52° C in another part of the exciter; and a similar flag at 281 is set for the program PO7. If the difference between the exciter air going out and the exciter air coming in is not less than 27° C, as shown at 282, the operator is so informed. In block 283, each contact input from the voltage regulator equipment is interrogated to determine if any of the exciter controller contacts are closed. If such is the case, an appropriate flag "exciter monitor" is set at 284 for use by the program PO7. If the main breaker is not closed, as indicated at 285, the program returns. However, if the main breaker is closed, indicating that the system is on load rate control, the program calculates at 286, the expected and the limit of the generator stator coil discharge gas temperature rise. If the generator is water cooled, then the calculation would be of the $H_2O$ temperature rise. The program then checks at 287 to determine whether the generator stator coil gas discharge temperature minus the $H_2$ cooler output temperature is less than the calculated expected rise of the block 286. If it is not less than the calculated expected rise, the operator is informed. Then, if the generator stator coil has discharge temperature minus the $H_2$ cooler output temperature is not less than the calculated rise limit as indicated at 288, the operator is also notified.

The expected generator stator coil discharge gas or $H_2O$ temperature rise or the rise limit is shown for various types of generators in the chart of FIG. 10 under the appropriate heading. For determining the generator stator coil gas discharge temperature, the highest value of up to 12 temperature sensors for the generator stator coil gas is used; and the lowest value of up to four temperature sensors for the $H_2$ cooler oil temperature is used.

The reactive capability of the generator is of prime importance in automatic load rate control. This generator capability must not be exceeded during the loading of the generator. In the present embodiment of the invention, the present $H_2$ pressure is used to select an appropriate capability curve that is set from a possible maximum of four curve sets. A curve set consists of three circular arcs (see FIG. 11) with centers at C1, C2 and C3, and radii lengths of R1, R2 and R3, respectively. The circular arcs divide the positive megawatt side of the megavar (MVAR) less the megawatt (MW) plane into three different regions; namely, stator winding limiting region, stator core limiting region, and rotor winding limiting region.

The program first clears at 290, a flag which indicates to the system that a generator reactive capability is exceeded; and the megavolt ampere (MVA) vs. the frequency curve is also exceeded. Then, at 291 an MVA power factor (PF), and the allowable maximum MVA of the present frequency is calculated. The MVA, the power factor, and the allowable maximum MVA at the present frequency is calculated in accordance with the following formulae:

Gen MVA and Power Factor $$MVA = \sqrt{(MVAR)^2 + (MW)^2}$$

$$PF = MW/MVA$$

PF is lagging if MVAR is positive

PF is leading if MVAR is negative

Where $MW$ = present megawatts reading $MVAR$ = present megavars reading

Allowable MAX MVA at Present Frequency

For $N \geq 3600$ rpm

Allow $MAX\ MVA = 100\%\ RMMVA = RMMVA$

For $N < 3600$ rpm $$\text{Allow } MAX\ MVA = (100-(60-N/60)\cdot 12.5/5)\%\cdot RMMVA$$

$$= (100-04167(3600-N)\%\cdot RMMVA$$

$$= (0.4167\quad 10^{-3}\cdot N-0.5)\cdot RMMVA$$

Where $RMMVA$ = Rated MAX MVA $N$ = Present speed in rpm

Figure 11:
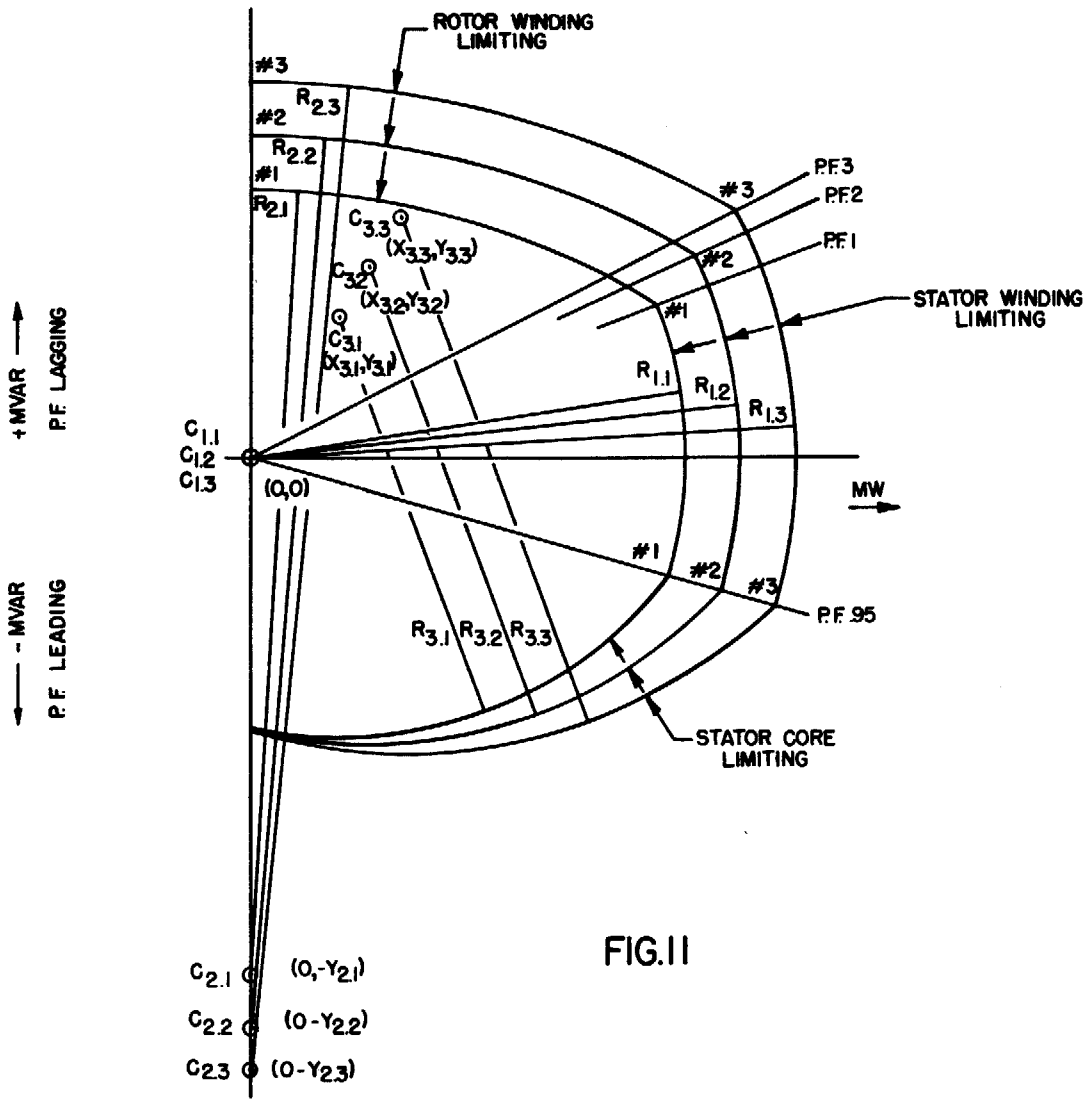
FIG. 11 are curves illustrating the generator reactive capabilities.

Then, decision block 292 checks as to whether the present MVA is less than the allowable maximum MVA. If it is not, the operator then is informed that the generator MVA vs. the frequency curve limit is exceeded; and a corresponding flag at 293 is set. The program checks at 294 if the $H_2$ pressure is within operation limits, which is indicated by the setting of the flags 265 and 268. If it is not within operation limits, then the program returns. If it is within operation limits, then the appropriate generator capability curve set based on existing $H_2$ pressure is selected in accordance with FIG. 11 at 295. If the MVAR is greater than zero, as indicated by 296, then 297 checks to determine whether the calculated lagging power factor is greater than the power factor value of the selected curve set. If 297 is negative, a rotor winding limiting sensor and radius for this region is set at 298. Then the distance between the generator operation point to the circular arc center of the selected limiting region of FIG. 11 is calculated at 299. If the selected region radius is not greater than the calculated distance, as checked by block 300, a flag "generator reactive capability exceeded" is set at 301, and an appropriate indication is given to the operator.

In the event that the MVAR is not greater than zero, block 302 checks to determine whether the calculated leading power factor is less than 95%. If it is less than 95%, the stator core limiting center and radius for this region is set at 303. If the MVAR is greater than zero; and the calculated lagging power factor is greater than the power factor value of the selected curve set, then the stator winding limiting center and radius for this region is set at 304. The distance from the generator operating point to the selected arc center of the appropriate limiting region on the MV-MVAR plane is calculated in accordance with the following formula:

$$\text{Distance} = \sqrt{MV-X)^2 + (MVAR + |Y|)^2}$$

Where $X$ = Abscissa of the arc center on MW-MVARplane $Y$ = Ordinate of the arc center on MW-MVAR plane The X and Y values should be initialized.

The operator indications initiated by program PO9 are as follows:

PO9MO1 = $H_2$ cooler discharge temp. HI LIM = YYYC temp. = XXXC

PO9MO2 = $H_2$ cooler discharge temp. LO LIM = YYYC temp. = XXXC

PO9MO3 = General stat. cooling water off limits temp. = XXC

PO9MO4 = Gen. stat. cooling water temp rise GT 31° C rise = XXC

PO9MO5 = Gen. stat. coil disch. temp. rise GT CAL expected rise, rise = XXC

PO9MO6 = MAX temp. diff between gas discharges exceeds temp. limit of 8° C.

PO9MO7 = Cold air temp. HI No. 1 exciter cooler LIM = YYYC temp. = XXXC

PO9MO8 = Cold air temp. HI No. 2 exciter cooler LIM = YYYC temp. = XXXC

PO)MO) = Exciter templ rise HI No. 1 cooler LIM = YYYC Rise = XXXC

PO9M10 = Exciter temp. rise HI No. 2 cooler LIM = YYYC Rise = XXXC

PO9M11 = $H_2$ press HI LIM = YYY psig Press = XXX psig

PO9M12 = $H_2$ press LO LIM = YYY psig Press = XXX psig

PO9M13 = Gen. stat. water pumps changed
PO9M14 = Gen. KVA vs. freq. curve limit exceeded PO9M15 = $H_2$ purity very LO — less than 85% purity = XXX PO9M16 = $H_2$ side seal oil temp. out of Lim, LIM = YYYF Temp. = XXXF PO9M17 = Air side seal oil temp out of Lim, LIM = YYYF Temp. = XXXF PO9M18 = Seal diff. press LO correct fault immediately or trip and purge $H_2$ PO9M19 = $H_2$ purity LO — less than 90

PO9M20 = Gen stator coil dischr. temp. rise HI, LIM =YYYYC Rise = XXXC

PO9M21 = Gen. load exceed capability curve XXX psig

Figure 12A:
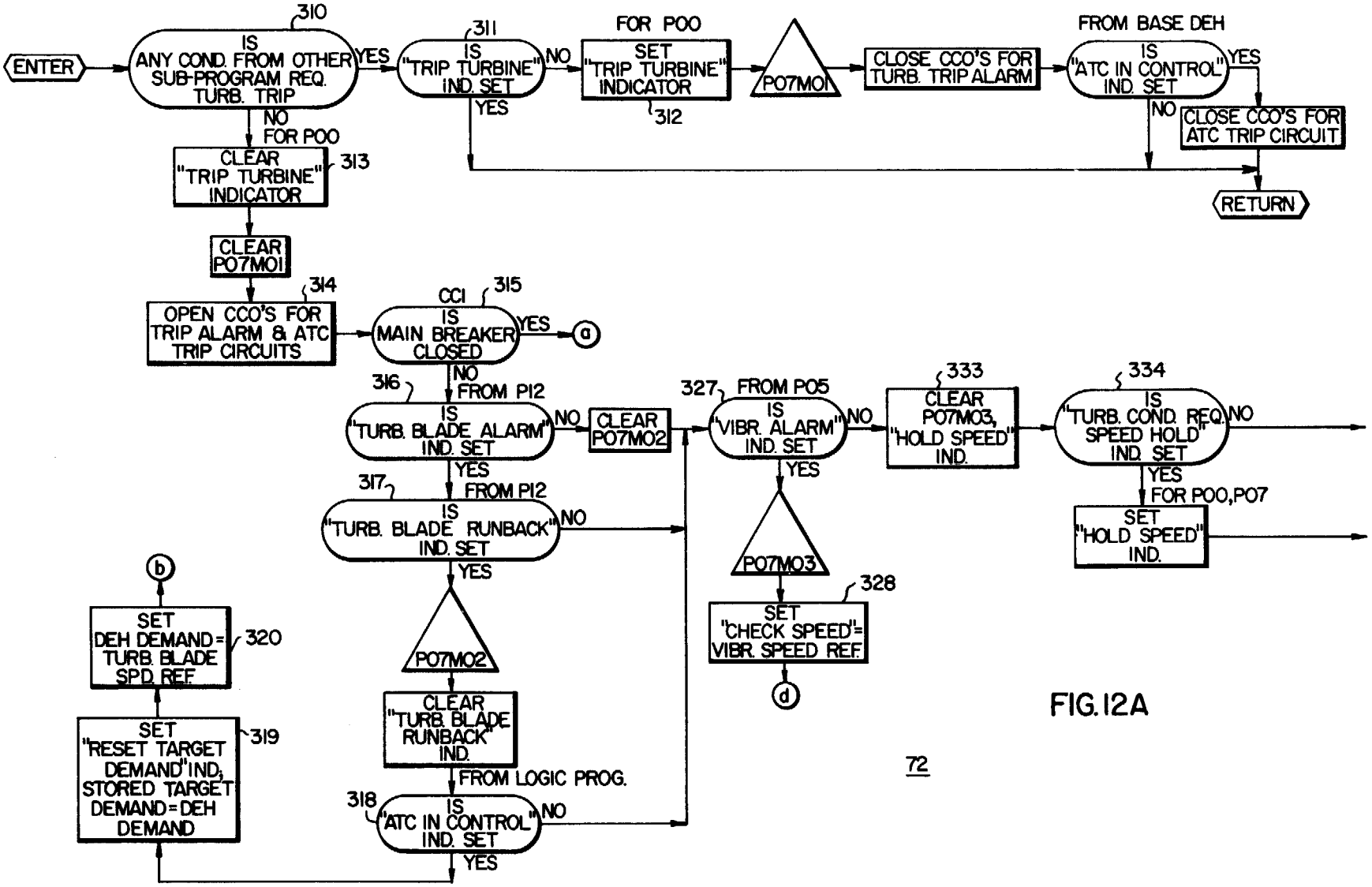
FIG. 12A, 12B, 12C and 12D is a chart explaining the generator reactive capability curves.
Figure 12B:
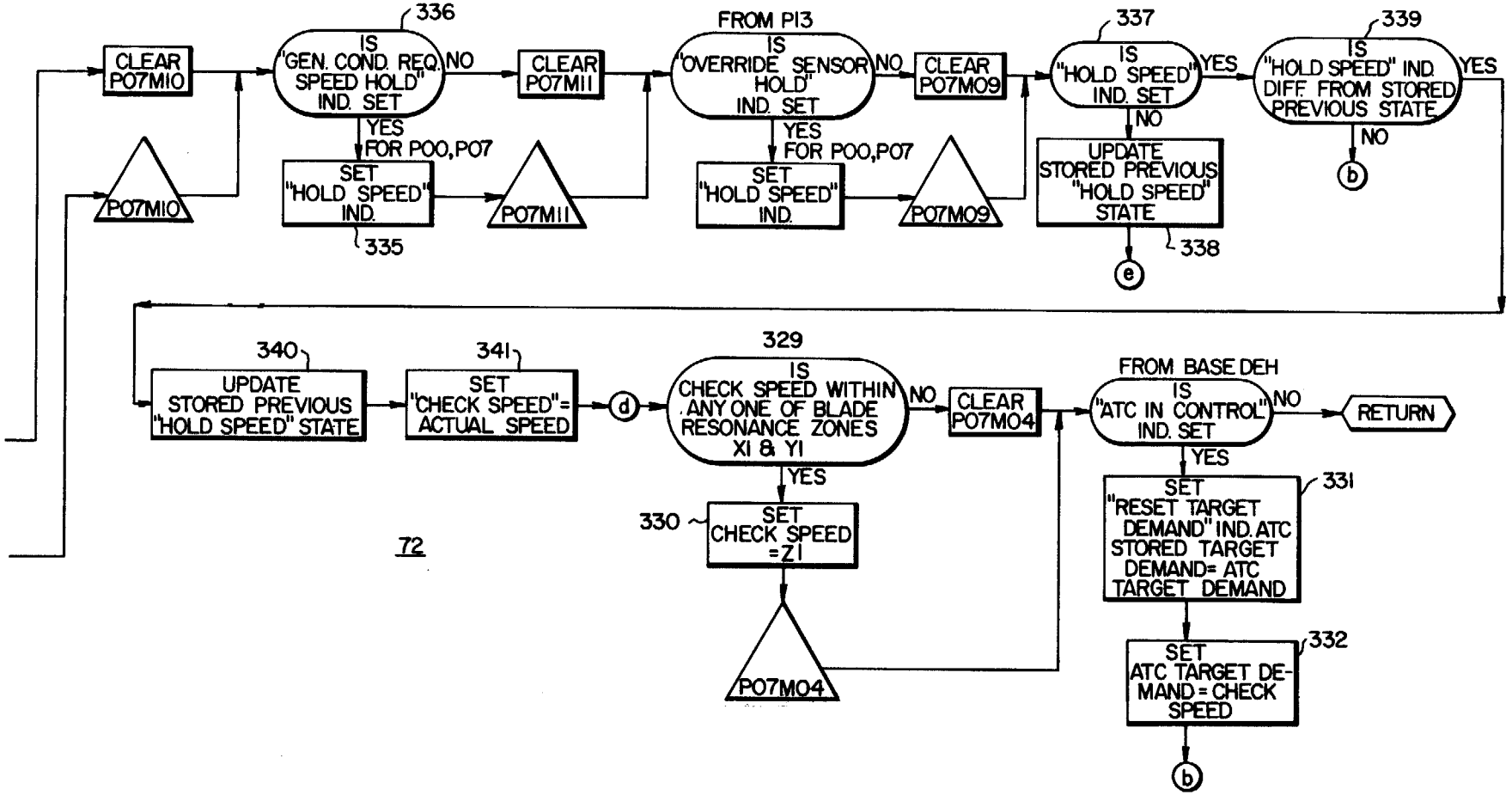
Figure 12C:
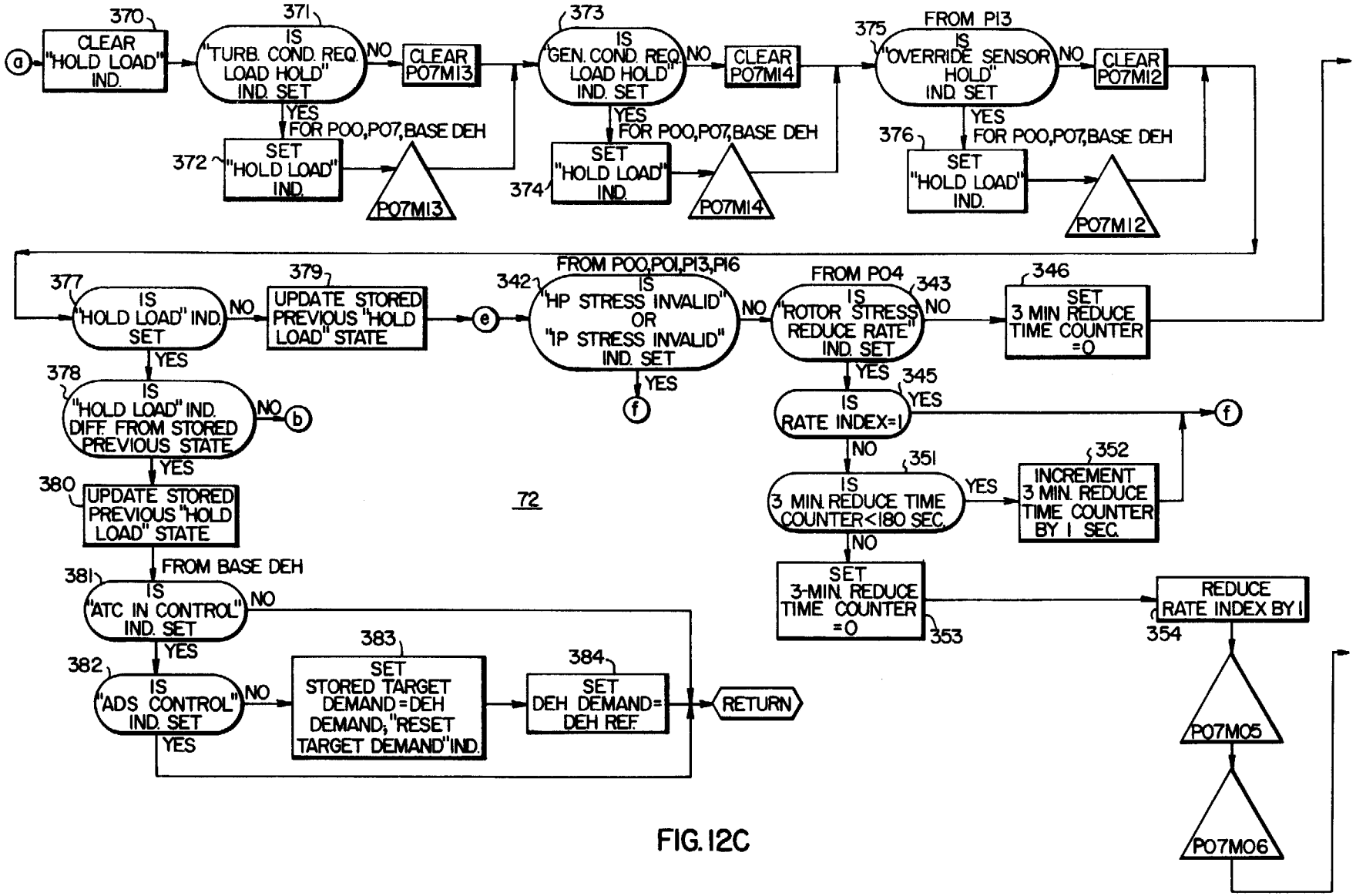
Figure 12D:
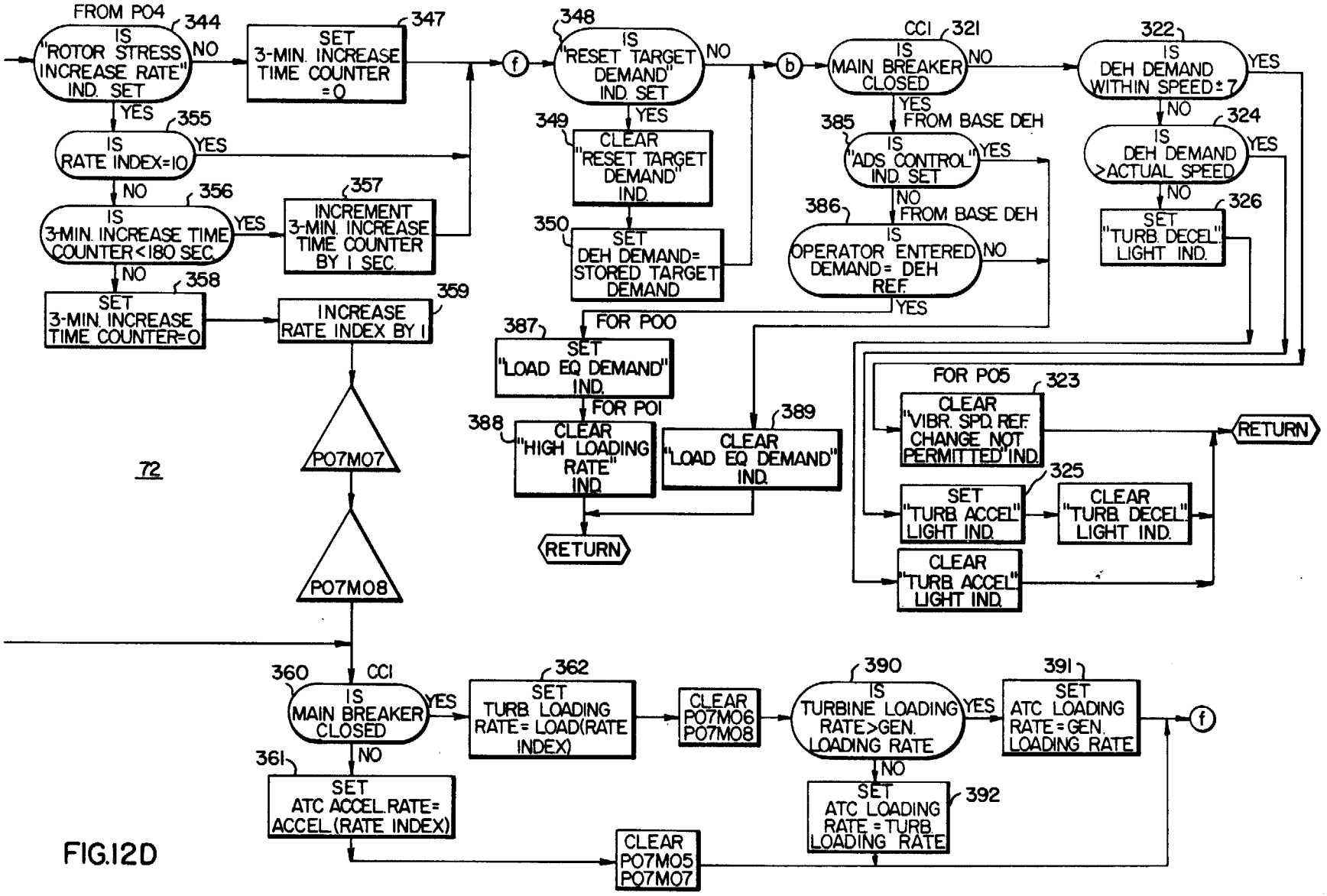

Referring to the FIGS. 12A and 12B, the program PO7 controls the speed demand and acceleration when the turbine power plant is on wide range speed control, and the load rate control when the circuit breaker is closed in accordance with information including the various flag conditions of the previously described programs. The speed demand and acceleration, and load rate control program PO7 is operated every second by the program P00.

The program first checks at 310 the several conditions thay may be detected by other programs that should institute a turbine trip. For example, and referring to FIG. 3, excessive vibration detected by the program 80, detection of water caused by the program 83, etc. In the event that there is such a condition and the turbine trip flag of 311 is not set, then the "trip turbine" flag is set for use by the program PO0 to reject from ATC to operator automatic control at 312. The operator is informed that the ATC system has requested a turbine trip. Then, the various contact outputs are caused for the various alarm and trip circuits. In the event there is no conditions requiring a turbine trip, the "trip turbine" flag is cleared at 313; and the contact outputs for the trip alarm and trip circuits are opened at 314.

Decision block 315 checks whether or not the system is on wide range speed or load control. In the event that it is on wide range speed control, checks are made at 316 and 317 to determine if the program P12 (FIG. 3) has set any conditions that would be injurious to the turbine blading. If so, an indicator informs the operator to reduce speed to avoid overheating the LT blades. After checking that the ATC system is in control at 318, a "reset target demand" flag is set and the stored target demand is made equal to the ATC target demand. The target demand speed is obtained from the program P12 (FIG. 3) and includes a speed of 605 rpm to which the turbine is run back when the actual speed is greater than 2150 rpm in the event that the steam conditions would cause dangerous overheating of the blades; and includes the heat soak speed to which the turbine would be run back if the actual speed is greater than 3550 rpm. Thus, if a run-back condition is required, depending upon the speed of the turbine from the program P12, the turbine blade reference is set equal to the ATC target demand in block 320 as previously described.

The main breaker is again checked at 321; and if it is open, block 322 checks to determine whether the actual speed is within ±7 rpm's of the DEH demand speed. The "hold speed" state is stored during each operation of the program; and if the "hold speed" flat at 337 is set, then the previously stored "hold speed" at 338 is updated. If the "hold speed" flag is set, then the difference between that flag and the stored previous state is checked at 339 and it is updated at 340. The "check speed" is then set equal to the actual speed at 341; and the program continues at 329 as previously described.

After the previously stored "hold speed" is updated at 338, and the validity of th HP and IP stress signals are determined to be valid at 342, the rotor stress control program inputs are checked for determining the proper rate of acceleration of deceleration in wide range speed control, and the proper load rate in megawatts per minute (hereinafter described) in load control. The computer memory has stored therein a rate index with information as follows:

| Rate Index No. | Accel. Rate (RPM MIN) | Load Rate (% MW/MIN) |
|---|---|---|
| 1 | 50 | .5 |
| 2 | 100 | 1.0 |
| 3 | 150 | 1.5 |
| 4 | 200 | 2.5 |
| 5 | 200 | 2.5 |
| 6 | 300 | 3.0 |
| 7 | 350 | 3.5 |
| 8 | 400 | 4.0 |
| 9 | 450 | 4.5 |
| 10 | 500 | 5.0 |

The program PO7 then checks to determine if a flag for reducing the rotor stress rate at 343 or increasing the rotor stress at 344 is set. If block 343 is in the affirmative, the rate index is checked at 345 to determine if it is at the lowest acceleration or loading rate. In the event that the program PO4 does not indicate that the rotor stress should be either decreased or increased, a 3-minute reduce counter is set to 0 at 346, and a 3-minute increase time counter is set to 0 at 347. In the event that the rate index is at its lowest rate of equal to 1, then the flag for resetting the target damand is checked at 348. If the flag 348 is set, then it is cleared at 349, and the stored target demand is set to be equal to the DEH demand at 350 because the rate can go no lower than 1. If the block 348 is in the negative, then the program on wide range speed control follows through the previously described blocks 321 through 326. In the event that the rate index is not at its lowest rate, then block 351 checks to determine if the 3-minute reduce time counter is less than 180 seconds. If it is, then it is incremented at 352 by 1 second and the program continues through the previously described blocks 348, 349 and 350. If the 3-minute counter is at its maximum time, then it is set to equal 0 at 353. Also, the rate index is reduced by "one" in block 354 which reduces the acceleration rate of the turbine on wide range speed control. Accordingly, the loading rate of the turbine is also reduced if it is on load control.

If the "rotor stress increase" rate flag is set by the program PO4, the rate index is checked at 355 to determine if it is equal to the maximum rate or index 10. If it is, then the program proceeds to 348 as previously described; because the acceleration rate or the loading rate is at its maximum. If it is not at its maximum, the 3-minute increase time counter is checked to determine if the time has run out at 356. If it has not run out, then the 3-minute increase time counter is incremented by 1 second at 357. If it has run out, the counter is set to zero at 358 and the rate index is increased by "one" at 359.

Thus, the rotor stress control program PO4 controls the rate of acceleration or deceleration on speed control at 3-minute intervals; and the rotor stress control program PO4 controls the loading rate of the turbine at 3-minute intervals on load control. In the present embodiment of the invention, the system is structured so that the rate index is initialized at index 4.

After the rate index has been either reduced by "one" or increased by "one" in respective blocks 354 and 359; and the condition of the main breaker has been checked at 360, the automatic control acceleration rate is made equal to the rate index at 361 for wide range speed control and the turbine loading rate is made equal to the load rate index at 362. If the main breaker is open, the program continues to block 348 as previously described.

Assuming that the main circuit breaker is closed, the program provides for automatically increasing or decreasing, or holding the rate of increase the same of the megawatts per minute being generated by the turbine generator. The program enters at 310 and continues to 315 if there are no turbine trip conditions; and then clears the "hold load" flag at 370. In the event any of the other programs have detected a turbine conditions requiring a "load hold" at 371 then a flag 372 is determined by 273; and if such a condition exists, a "hold load" flag 374 is set. After checking the condition of the "override sensor hold" at 375; and either setting or not setting the appropriate flag of 376, the "hold load" flag is checked at 377. If the flag is set, a check is made at 378 to determine if the "hold load" flag is different from that stored during a previous program operation. If it is not set, the present "hold load" state is updated at 379. If the "hold load" flag is different from the stored previous state, then the stored previous state is also updated in 380. If the ATC is in control as determined by 381 from the base DEH system, the determination of whether or not the automatic dispatch system is in control is determined by flag 382. If ATC is not in control, the system merely returns. If the automatic dispatch (ADS) system is not in control then the stored target demand is set equal to the ATC target demand, and the target demand flag is reset for 383. Then the ATC target demand is set to be equal to the DEH load reference at 384. If the "hold load" flag is not different from the stored previous state, then the program continues to 321, which checks the condition of the main breaker.

Inasmuch as this portion of the program is concerned solely with load control, the main breaker is closed and the program checked, if the automatic dispatch system is in control at 385. If the operator enters a load demand that is equal to the DEH load, as indicated by 386, then the system sets a "load is equal to demand" flag 387. The "high loading rate" flag 388 is cleared for the program PO1 previously described. In the event that the ADS system is in control, a flag 389 is set to clear the "load equal to load demand".

Assuming that there is no "hold load" flag that is set, the block 342 checks to determine the validity of the HP or IP stress calculation and checks the flags for either reducing or increasing the rotor stress reduce rate 343 and 344 as previously described. The program then follows the paths given in connection with the description of the blocks 345–347 and 351–359 as previously described in connection with wide range speed control. The program then checks the condition of the main breaker; and the block 362 sets the turbine loading rate to be equal to the load rate index which was either decreased or increased at 354 or 359. The loading rate of the turbine is compared with the loading rate of the generator at 390; and if the turbine loading rate is greater, the automatic turbine control loading rate is set to be equal to the generator loading rate at 391. If the generator loading rate is not greater than the turbine loading rate, then the automatic turbine control loading rate is set to be equal to the turbine loading rate at 392. The program then continues at the decision block 348 as previously described.

The operator indications initiated by program PO7 are as follows:

PO7M01 = Turb. trip requested by ATC

P07MO2 = Reduce speed to reduce overheating LP blade

PO7MO3 = Hold Spd. HI Vibr.

PO7MO4 = Hold Spd. delayed until decr. to Z1, Z2, or Z3 to avoid blade res.

PO7MO5 = RTR stress initiates LO rate decr.

PO7MO6 = RTR stress initiates accel. rate decr.

PO7MO7 = RTR stress initiates LO rate incr.

PO7MO8 = RTR stress initiates accel. rate incr.

PO7MO9 = Hold Spd. sensor out of service override perm.

PO7M10 = Hold Spd. Turb. alarm condition

PO7M11 = Hold Spd. Gen. Sys. alarm condition

PO7M12 = Hold LO sensor out of service override perm.

PO7M13 = Hold LO Turb. alarm condition

PO7M14 = Hold LO Gen. Sys. Alarm condition

Figure 13:
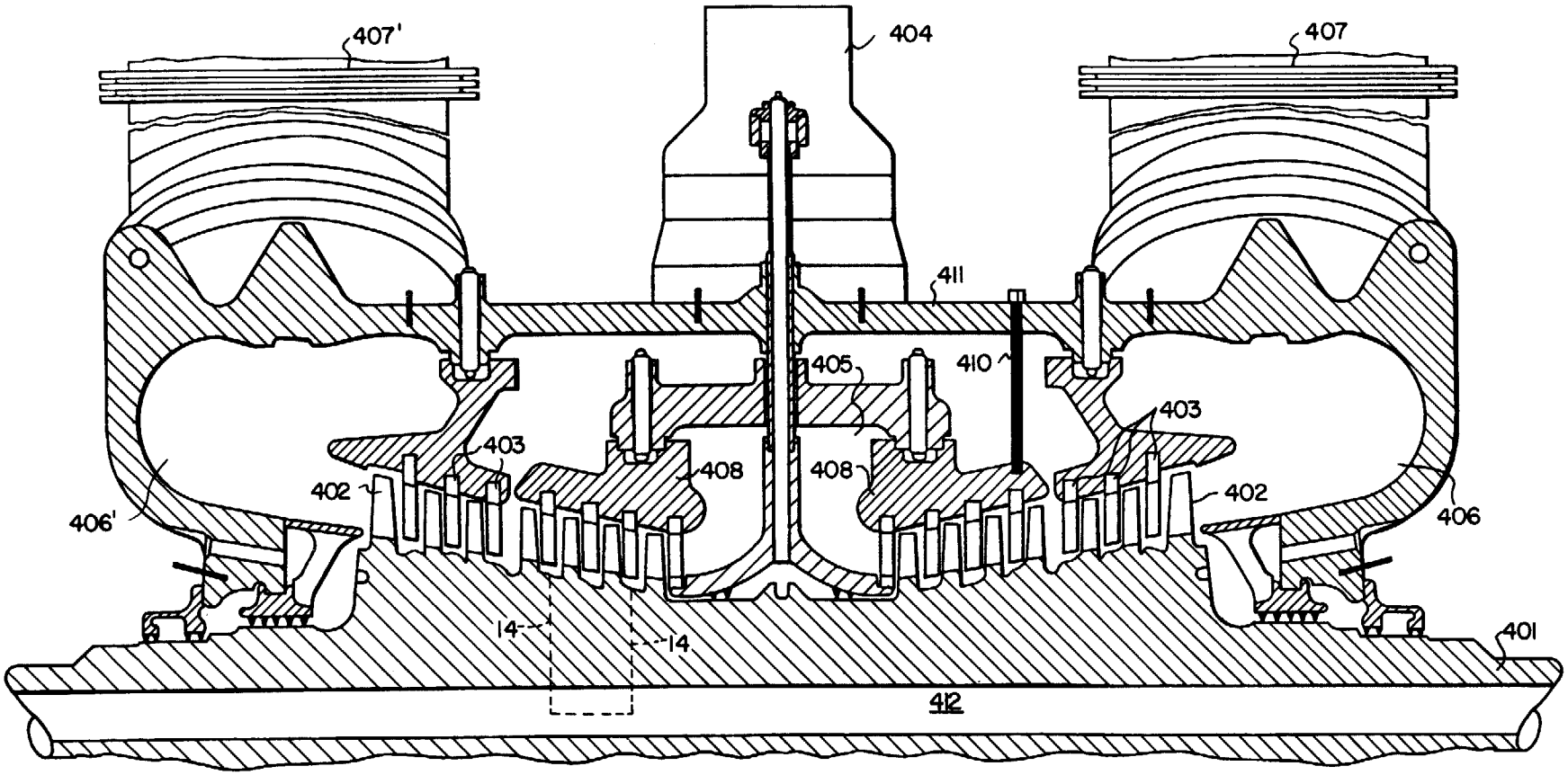
FIG. 13 is a longitudinal sectional view of a typical IP turbine rotor, blading, and casing, the stress of which is controlled in accordance with the present invention; and, FIG. 14 shows the portion of the IP rotor within the dashed lines 14—14 of FIG. 11 and illustrates the rotor heat flow determination in accordance with the present invention.

Referring to FIG. 13, an IP turbine section 400 includes a rotor 401 having rotating blades 402 which are positioned to rotate relative to stationary blades 403 in response to the driving force of reheat steam entering intakes 404 and chamber 405. The steam exhausts through chambers 406 and conduits 407 to the low pressure turbine section.

The stationary blades 403 which are positioned between the rotating blades 402 are fastened to a blade ring 408. The temperature of the blade ring 408 is detected by a thermocouple 410 which extends at its sensing end into the blade ring 408 and at its outer end through casing 411. The outer end of the thermocouple 410 is adapted to be connected to the control system of the present invention. The rotor 401 has a bore 412 extending axially therethrough. The portion of the rotor 401 between dashed lines 14—14 illustrates that portion of the rotor for which the stress calculations are made in the present system.

Referring to FIG. 14, which shows in an enlarged form that portion of the IP turbine between dashed lines XIV—XIV of FIG. 13, bears similar reference numerals for similar parts thereof.

Referring to the fragmentary view of FIG. 14, the rotating blades 402 and 402' may be fastened to the rotor 401 in a well-known manner. In the present embodiment of the invention, stress calculations are described for either the well-known conventional "side entry" or T-root grooved blade fastenings. Opposite each rotating and stationary blade 402' and 403 of the IP rotor, there is an axial segment P extending radially inward from the surface of the rotor 401 to the bore 412 which is that area of the rotor between lines 415 and 416, which has different heat transfer coefficients and heat conductances therein. Although only one such area 415, 416 is shown in FIG. 14, the entire length of the rotor may be considered to have imaginary adjoining segments, each of which has similar characteristics with respect to varying points of conductance and heat transfer coefficients in each segment.

For example, for that area of the bore extending radially inward at opposite edges of the blades 402' and 403, the rotor is subjected to heat from the steam flowing at a rate G axially across the blades 402, 403 and 402', etc, and a portion of the steam flows in passageways 420, 421 and 422 around seal strips such as 423, which extend radially in close proximity to a peripheral surface 424 of the rotor 401 to provide an equalizing steam seal.

As is apparent from the fragmentary view of FIG. 14, the peripheral surface of the IP rotor is replete with irregularities which include grooves under the seal strips 423 as well as the peripheral extensions which fit into the base of the rotating blades 402 and 402' either by the "side entry" or "T-root" configuration. Because of these irregularities resulting in different diameters of the rotor at closely spaced axial intervals, the heat conductance is different for various portions of each of the individual segments such as that illustrated in the area between lines 415 and 416. Also, the conductance K takes different paths into the rotor in each one of the aforementioned radial segments. For example the conductance $K_{A1}$, the heat travels substantially radially inward to grid point 1,1 and grid point 2,1. The heat conductance $K_{A2}$ travels in a path indicated by the reference dashed line to a point 1,2 within the rotor 401 which point is axially spaced from the point 1,1. Heat also is conducted in the path $K_{A3}$ in the blade 402' to a grid point 1,3. Heat transfer coefficient $H_1$ from the space between the seal strips 423 through the conductance $K_{A1}$ is as much as 10 times greater than the heat transfer coefficient $H_2$ through the conductance paths $K_{A2}$ and $K_{A3}$. Thus, there is substantial heat flow axially in the rotor 401 as well as radially from the surface of the rotor to the bore 412. Such heat flow for each of the radial areas 415, 416 of the IP rotor travels from the grid point 1,1 towards 1,2 because the heat transfer coefficient is highest at the path 2,1. $T_{A0}$ in the path 420 represents the actual ambient steam temperature; and is a function of the reheat steam inlet an the reheat steam exhaust after it leaves the IP turbine section. The temperature $T_{A2}$ in the path 421 equals the temperature at grid point 1,1 and $T_{A0}$. Therefore, the temperature $T_{A2}$ can be obtained from $T_{A0}$ and the temperature $T_{A1}$ beneath the seal strip 423 is the average.

The two-dimensional approach according to the present invention provides greater accuracy in determining the volume average temperature of the rotor. It has been found unnecessary to continue the two-dimensional calculation inwardly beyond the grid point 2,1 and 2,2 and 2,3. As the conduction path gets deeper into the rotor the calculations may then be confined merely to a single radial dimension rather than both the axial and radial which is adjacent the outer radial portions of the rotor. The details of calculating the various quantities used in the real-time determination of the rotor stress is apparent from the formulas set forth in connection with the program P16.

Appendix pages A1 through A71 is a program listing of the programs described herein including program P15.

To summarize broadly, the turbine power plant operation according to the present invention is controlled automatically from rolling of turning gear to the application of the desired megawatt loading in accordance with the real-time on line condition of the plant in the following manner.

The control system provides for storing a plurality of speed acceleration and loading rates in the computer. These rates range in increments from a predetermined minimum to a predetermined maximum; and the system at periodic intervals selects these rates in accordance with present and predicted plant conditions. For example, the system can either hold the rate of loading, at the present selected rate; decrease the rate of loading until the desired decreased rate is selected, and then hold at such decreased rate; increase the rate of loading to the desired rate, and the hold at such rate.

In starting up the turbine, after rolling off turning gear, the system selects a predetermined one of the stored rates of acceleration, provided plant conditions permit. The system then selects a stress limit for the HP turbine and the IP turbine, which limit may vary for the HP rotor depending on the temperature of the HP turbine when it rolled off turning gear and when it is under load, and for the IP rotor depending on whether it is heating or cooling. The effective temperature difference for both the HP rotor and the IP rotor is compared repetitively against its respective selected limit. Additionally, the anticipated effective temperature difference for a predetermined time in the future is also compared. Depending on such comparison both present and anticipated, the system provides for holding the stress, increasing the stress, or decreasing the stress. This command results in the rate of acceleration or loading to change incrementally in the required direction, or to remain the same.

Prior to synchronization and upon reaching heat soak speed, the turbine is held at such speed for a period of time depending on the calculated rotor bore temperature and the actual blade ring temperature of the IP turbine. The system compares these values periodically; and when both temperatures reach a predetermined value, the system is permitted to increase the speed of the turbine under the constraints of the HP and IP turbine rotor conditions as previously described.

Upon closing the circuit breaker, and after application of initial load the system, in response to the operator or other means requesting a target electrical load, changes its rate of loading periodically under the constaints of the HP and IP turbine rotors and the capabilities of the electric generator.

Briefly, the generator constraints which control the rate of loading includes the allowable maximum megavoltampers and the reactive capability of the generator.

The capability curve of the generator is based on existing hydrogen pressure and a determination of whether the calculated lagging power factor is greater than the power factor value of a selected curve is made.

The IP rotor stress determination and bore temperature is calculated in two dimensions for greater accuracy.

It is understood that although a programmed digital computer having a central processor is disclosed in connection with the present invention, that hardwired digital or analog system or micro-processor may be used to perform the functions set forth herein.

```
0001: C          P00 PERIODIC CONTROL
0002: C
0003:          COMMON /LDHCALC/
0004:        1     TM              ,OPCOP          ,CIRB(3)        ,STO            ,
0005:        1     OPRT            ,ASL            ,MCB            ,LDHCALC2(7)    ,
0006:        1     ADSUP           ,ADSDOWN        ,ADSPERM        ,ASUP           ,
0007:        1     ASDOWN          ,ASPERM         ,BVPLR          ,RVPLL          ,
0008:        1     CIDLPERM        ,LDHCALC3(7)    ,CIMANPLH       ,CIMANPLK       ,
0009:        1     THI             ,TPTF           ,MANTPC         ,CICOFF         ,
0010:        1     CICTIMR         ,MAXEXLIM       ,OVEXPRTN       ,MAXVHZIM       ,
0011:        1     VRPAFCOS        ,GFGNDDPT       ,REAROILP       ,LDHCALC5(1)    ,
0012:        1     EHFLPLO         ,MGACSW         ,STH2OPI        ,STH2OP2        ,
0013:        1     ASONAUTO        ,LPFXSPON       ,DRVSAUTD       ,HPDRVC         ,
0014:        1     HPDRVO          ,RSBRCSW        ,GENTERM        ,TURBONTS       ,
0015:        1     LDHCALC6(1)     ,RSARCL         ,GNADJPRE       ,VOLTREGO       ,
0016:        1     VREGSHON        ,LDRCALC7(1)    ,H2PRLO         ,GENH2OHI       ,
0017:        1     H2TEMPHI        ,DEFTNKHI       ,ASSOPOFF       ,H2SIDLO        ,
0018:        1     SOBUPLO         ,H2SSOPOF       ,ASSOPRUN       ,H2OPDHI        ,
0019:        1     SMH2CON         ,SH2OTLHI       ,SH2OTLLO       ,SH2OTPHI       ,
0020:        1     SCH2OLO         ,SCH2OVLO       ,SCH2OPHI       ,SCH2OIHI       ,
0021:        1     SCH2OIVH        ,SH2OPDCH       ,GH2PRLO        ,IPDRVC         ,
0022:        1     I2DRVD          ,LDHCALCB(41)   ,LSISCAN(2)     ,LCI1SEC        ,
0023:        1     LSKPDIS         ,LATFIN         ,LATCRSEY       ,RUNPANEL       ,
0024:        1     RUMLOGIC        ,RUNVLVPB       ,GO             ,GCX            ,
0025:        1     TC              ,STM            ,OA             ,OAX            ,
0026:        1     AS              ,ASX            ,ADS            ,ADSX           ,
0027:        1     HCLOCP          ,GO             ,HOLD           ,ASUPX          ,
0028:        1     ASDONNX         ,BR             ,BRX            ,SLLLBP         ,
0029:        1     LLLBP           ,LLX            ,TPC            ,VIDAROS        ,
0030:        1     VIDAROSX        ,CADSUP         ,CADSDOWN       ,IPI            ,
0031:        1     IPIX            ,ADSUPX         ,ADSDOWNX       ,MWI            ,
0032:        1     MWIX            ,SPI            ,SPTP           ,TVMAX          ,
0033:        1     GVMIN           ,GVMAX          ,GOHOLDOF       ,PERSCAN        ,
0034:        1     TVMIN           ,TCLITE         ,YROOM          ,ATS            ,
0035:        1     ATSX            ,ADSINC         ,ADSDEC         ,ASYNC          ,
0036:        1     ASDEC           ,AIFAILMN       ,AIFAILPI       ,AIFAILMX       ,
0037:        1     AIFAILPX        ,TSOFF          ,TPTVGV         ,TVSCAN         ,
0038:        1     GVSCAN          ,ADSCH          ,DATENTRY       ,DECPT          ,
0039:        1     DADR            ,SELTOUY        ,LCRTRSEI       ,RTPSPT         ,
0040:        1     CDL             ,CDLVFLR        ,CDLVPLL        ,CDLPERM        ,
0041:        1     TMXLOG          ,TMXLTL         ,OPPTX          ,ASLX           ,
0042:        1     LMEMPAR         ,TR2B           ,IPIP           ,RIPSPIB        ,
0043:        1     MWIPB           ,CRESETPB       ,SPIPB          ,TPCPB          ,
0044:        1     HOLDPB          ,GOPB           ,VSTATUS        ,GV             ,
0045:        1     TV              ,AUTOSTAR       ,VTESTPB        ,DLINX          ,
0046:        1     TURBSPOF        ,ASPB           ,ADSPB          ,VPLRPB         ,
0047:        1     VPLLPB          ,CLOSEPB        ,OPENPB         ,ATSSENOV       ,
0048:        1     OVRIDPB         ,RETSENPB       ,TRSSPONL       ,LHIRATPB       ,
0049:        1     REFLLIM         ,REFHLIM        ,VPLIM          ,TPLIM          ,
0050:        1     LOWFREQ         ,MANOTRAK       ,READY          ,LOPTVLV        ,
0051:        1     LRBOPER         ,TVCONT         ,GVCONT         ,VSTATCON       ,
0052:        1     SINGTR          ,SEOTR          ,LDHCALCA(7)    ,SING           ,
0053:        1     SEQ             ,RODCH          ,RODCHX         ,TREPG          ,
0054:        1     TREPGX          ,TPXDOR         ,LPCORR         ,VCHDR          ,
0055:        1     SINGLV          ,VT             ,CRVSELOK       ,TEMPLOG        ,
0056:        1     HISLOPE         ,VTTRACK        ,LRBRQ          ,INVREQ         ,
0057:        1     LVLVADR         ,TSONLY         ,LSDIGADK       ,LSDIGBOK       ,
0058:        1     LSHPSIOX        ,LSSELFF        ,LSPDXFER       ,LSPDOUT        ,
0059:        1     LSPDMON         ,DOIMGLOG(30)   ,DOIMXLOG(30)   ,DOIMGLOG(35)   ,
0060:        1     DOIMGCTL(25)    ,DOIMXCTL(25)   ,DOIMGCTL(35)   ,HILDRAT        ,
0061:        1     LDALITE         ,LVDEVRN        ,LIMPONLY       ,LATCRFJ        ,
0062:        1     LCTLFL          ,LVDISFL        ,LATCFL
0063:          LOGICAL
0064:        1     TM              ,OPCOP          ,CIRB           ,STO            ,
0065:        1     OPRT            ,ASL            ,MCB            ,LDHCALC2       ,
0066:        1     ADSUP           ,ADSDOWN        ,ADSPERM        ,ASUP           ,
0067:        1     ASDOWN          ,ASPERM         ,RVPLR          ,RVPLL          ,
```

```
0068:      1     CIDLPERM        ,LDHCALC3       ,CIMANPLH       ,CIMANPLK       ,
0069:      1     THI             ,TPCP           ,PANTPC         ,CICCPF         ,
0070:      1     CICTIMR         ,MAX SLIM       ,OVERPRTM       ,MAXVPZTH       ,
0071:      1     VRMAPCDS        ,PCMPRLY        ,REAROILP       ,LDHCALC5       ,
0072:      1     SHPLPLG         ,PSPCSW         ,STH2OP1        ,STH2OP2        ,
0073:      1     ASCNAUTO        ,LPRASPON       ,DAVSAUCD       ,RPDRVC         ,
0074:      1     PPDRVD          ,PSHPCSW        ,CENTERM        ,TURBOMTG       ,
0075:      1     DHCALC6         ,RSPECL         ,GNIDJPRF       ,VOLTPICO       ,
0076:      1     VRESSMON        ,LDHCALC7       ,H2PRLO         ,CPNH2OHI       ,
0077:      1     H2TEMPHI        ,DEFTMPHI       ,ASSCPOFF       ,H2SIOLO        ,
0078:      1     H2SUPLO         ,H2SSCPOF       ,PSSCPPON       ,H2CPOHI        ,
0079:      1     H2OOOV          ,SH2OTLHI       ,SH2OTLLO       ,SH2OTPHI       ,
0080:      1     SCH2OLO         ,SCH2OVLO       ,SCH2OPHI       ,SCH2OTHI       ,
0081:      1     SCH2OIVM        ,SH2OTSCH       ,SH2OPLO        ,TPDRVC         ,
0082:      1     TPDRVO          ,LDHCALC8       ,LSISCAN        ,LCTISPC        ,
0083:      1     LSAPDIS         ,LAIFIN         ,LATCPSPT       ,RUNPANEL       ,
0084:      1     RUNLOGIC        ,RUNVLVPM       ,GC             ,GCX            ,
0085:      1     TC              ,STM            ,DA             ,DAX            ,
0086:      1     AS              ,ASX            ,ADS            ,ADSX           ,
0087:      1     HOLDCP          ,GO             ,HOLD           ,ASUPX          ,
0088:      1     ASDOWNX         ,BR             ,BRX            ,SLLLBP         ,
0089:      1     LLLBP           ,LLX            ,TPC            ,VIDAPOS        ,
0090:      1     VIDAPOSX        ,CADSUP         ,CADSDOWN       ,IPI            ,
0091:      1     IPIX            ,ADSUPX         ,ADSDOWNX       ,MWI            ,
0092:      1     MWIX            ,SPI            ,SPTP           ,TVMAX          ,
0093:      1     GVMIN           ,GVMAX          ,GSHOLDOF       ,PERSCAN        ,
0094:      1     TVMIN           ,TCLITE         ,TRCOM          ,ATS            ,
0095:      1     ATSX            ,ADSINC         ,ADSDEC         ,ASINC          ,
0096:      1     ASDEC           ,AIFAILMW       ,AIFAILPI       ,AIFAILMX       ,
0097:      1     AIFAILPX        ,TSOFF          ,TRTVGV         ,TVSCAN         ,
0098:      1     GVSCAN          ,ADSCH          ,DATENTRY       ,DECPT          ,
0099:      1     DADR            ,SELTOUT        ,LCRTRSET       ,RTPSPI         ,
0100:      1     CDL             ,CDLVPLR        ,CDLVPLL        ,CDLPERM        ,
0101:      1     TMXLOG          ,TMXCTL         ,DPRTX          ,ASLX           ,
0102:      1     LMEMPAR         ,TRPB           ,IPIPB          ,RTPSPIB        ,
0103:      1     MWIPB           ,CRESETPB       ,SPIPB          ,TPCPB          ,
0104:      1     HOLDPB          ,GOPB           ,VSTATUS        ,GV             ,
0105:      1     TV              ,AUTOSTAR       ,VTESTPB        ,DLINK          ,
0106:      1     TURBSPOF        ,ASPB           ,ADSPB          ,VPLRPB         ,
0107:      1     VPLLPB          ,CLOSEPB        ,OPENPB         ,ATSSENGV       ,
0108:      1     OVRIDPB         ,RETSEMPB       ,TRBSPONL       ,LHIRATPB       ,
0109:      1     REFLLIM         ,REFHLIM        ,VPLIM          ,TPLIM          ,
0110:      1     LOWFREQ         ,MANOTRAK       ,READY          ,LOPTVLV        ,
0111:      1     LRPOPER         ,TVCONT         ,GVCONT         ,VSTATCON       ,
0112:      1     SINGTH          ,SPDTP          ,LDHCALC4       ,SING           ,
0113:      1     SEQ             ,MODCH          ,MODCHX         ,TRFPG          ,
0114:      1     TRFPGX          ,TPXDOK         ,LPCORP         ,VCHDR          ,
0115:      1     SIMGLV          ,VT             ,CRVSELDX       ,TEMPLOG        ,
0116:      1     HISLOPE         ,VTTRACK        ,LREAD          ,INVREQ         ,
0117:      1     LVLVADR         ,TSCHLY         ,LSDIGADK       ,LSDIGROK       ,
0118:      1     LSHPSIOK        ,LSSFLPP        ,LSPOXFER       ,LSPDOUT        ,
0119:      1     LSPDMON         ,CDIMGLOG       ,CDIMXLOG       ,DDIMGLOG       ,
0120:      1     DDIMGCTL        ,CDIMXCTL       ,DDIMGCTL       ,HILDRAT        ,
0121:      1     LOALITE         ,LVLVOPN        ,LIMPONLY       ,LATCREJ        ,
0122:      1     LCTLFL          ,LVDISFL        ,LATCFL
0123:       LOGICAL
0124:      1     LDHCALC1(1)
0125:       EQUIVALENCE
0126:      1     ( LDHCALC1(1) , TM )
0127: C
0128:       COMMON /LDHINIT/
0129:      1     NUCINLIN        ,SINGEND        ,STOPVLVS       ,REFAO          ,
0130:      1     FRQAO           ,FIXTPSP        ,ATSSCAN        ,ADSPULSE       ,
0131:      1     LPLRAT          ,LFDEMAO
0132:       LOGICAL
0133:      1     NUCINLIN        ,SINGEND        ,STOPVLVS       ,REFAO          ,
0134:      1     FRQAO           ,FIXTPSP        ,ATSSCAN        ,ADSPULSE       ,
0135:      1     LPLRAT          ,LFDEMAO
0136:       LOGICAL
0137:      1     LDHINIT1(1)
0138:       EQUIVALENCE
0139:      1     ( LDHINIT1(1) , NUCINLIN )
0140: C
```

```
0141:        COMMON /IDHCALC/
0142:       1     IAIRV(165)      ,IATVTAO        ,IAIVTSIG       ,ISOAO(8)       ,
0143:       1     IGVSS(8)        ,ITVSS(4)       ,IOPCSPD        ,IPLRAT         ,
0144:       1     ITVMAN          ,ITVAO          ,ITVCOM         ,IGVMAN         ,
0145:       1     ISVAO           ,IGVCOM         ,ISICNT(2)      ,ICIIMAG(16)    ,
0146:       1     IRPRF(4)        ,IRPRFPTR       ,IRPRFLST       ,IRPIMAG        ,
0147:       1     ICRIMAG         ,IASCNSTR       ,NASCNCVT       ,IASCNRO        ,
0148:       1     IASCNCMP        ,NAIPTSCN       ,MAIPTIDX       ,IPERCT         ,
0149:       1     IWSTBLA(5)      ,IWSTBLB(5)     ,IWSDIGA        ,IWSDIGB        ,
0150:       1     IAUXCNT1        ,IAUXCNT2       ,IAUXCNT3       ,IAUXCNT4       ,
0151:       1     IATCREG         ,IVDISREG       ,IPB            ,IPBX           ,
0152:       1     IFLGWRD         ,NVTEST         ,INDEX1         ,INDEX2         ,
0153:       1     INDEX3          ,IWINDPNL       ,IDPT           ,IADSUP         ,
0154:       1     IADSDCAN        ,IVPL           ,ITIME          ,IREFDMD        ,
0155:       1     IVTPAT1         ,IVTPAT2        ,IPRXOLD        ,ICRSLN         ,
0156:       1     IGVAO(10)       ,ITVPTEST       ,ITSTDISP       ,IATCNDFF       ,
0157:       1     ICTLREG         ,IADSCHAM       ,IAISVPI        ,IGVFLCNT(8)    ,
0158:       1     ITVFLCNT(4)
0159:        DIMENSION
0160:       1     IDHCALC1(1)     ,IAIRVATC(143)  ,IAICVT(30)     ,IGVTVSS(12)
0161:        EQUIVALENCE
0162:       1     ( IDHCALC1(1) , IAIRV(1) )      ,( IAIRV(43), IAIRVATC(1) )     ,
0163:       1     ( IAIVTAO, IAICVT(1) )          ,( IGVSS(1) ,IGVTVSS(1) )
0164: C
0165:        COMMON /CRTPAN/
0166:       1     ICRBFLST        ,ICRBF(4)       ,RUNCRTPL       ,IPOINT         ,
0167:       1     LCRTOUT
0168:        LOGICAL
0169:       1     RUNCRTPL        ,LCRTOUT
0170:        DIMENSION
0171:       1     ICRTPAN1(1)
0172:        EQUIVALENCE
0173:       1     ( ICRTPAN1(1) , ICRBFLST )
0174: C
0175:        COMMON /IDHINIT/
0176:       1     NOVLV           ,NTV            ,NDIVS          ,NDIV           ,
0177:       1     ICOMLS(8)       ,NOPPCV         ,FPTCSL         ,LPTCSL         ,
0178:       1     NOSEQ           ,SEQT(6)        ,ICOTLR         ,NPSTRT         ,
0179:       1     NOFCFP          ,INTRIES        ,ITESTPAT(16)   ,ITVDB          ,
0180:       1     IGVDB           ,IVLVFLMX       ,IGVDBI         ,ICIMAX         ,
0181:       1     NAIPTS(20)      ,IAIPRIDX(20)   ,ISIABLE(2)     ,NTAUXSYN       ,
0182:       1     NTCISCAN        ,NTANSCAN       ,NTANCVTB       ,NTPAL          ,
0183:       1     NTCRTOP         ,NTLOGIC        ,NTVLVPB        ,NTCNTRL        ,
0184:       1     NTCISDIS        ,NTANCVTA       ,NTATCPER       ,NTMWRITR       ,
0185:       1     NTCRTAUX        ,NTDATLNK       ,NTTSKCHK       ,NTSYSERR       ,
0186:       1     NTCTLOUT        ,IDISMAX(9)     ,IDHAIPMX       ,IATAIPMX
0187:        INTEGER
0188:       1     FPTCSL          ,SEQT
0189:        DIMENSION
0190:       1     IDHINIT1(1)
0191:        EQUIVALENCE
0192:       1     ( IDHINIT1(1) , NOVLV )
0193: C
0194:        COMMON /RDHCALC/
0195:       1     POLIM           ,AADSIN         ,WSHPSI         ,PO             ,
0196:       1     MW              ,RDHCALCP(7)    ,FLRAT          ,OPCSPEED       ,
0197:       1     PI              ,WSDIGA         ,WSDIGB         ,WS             ,
0198:       1     DDMD            ,DACCRATE       ,OLRATE         ,LLL            ,
0199:       1     HLL             ,VPCSL          ,RDHCALC3(1)    ,PIXDSP         ,
0200:       1     PDSP            ,DEMAND         ,RATE           ,REFDMD         ,
0201:       1     REF1            ,REF2           ,SPDSP          ,X              ,
0202:       1     Y               ,PISP           ,VSP            ,TVBTAS         ,
0203:       1     GVSP            ,GVBIAS         ,SPD            ,RESSPD         ,
0204:       1     RESMW           ,RESPI          ,TESTAO         ,SIMMW          ,
0205:       1     SIMPI           ,SIMWS          ,RESMWX         ,RESPIX         ,
0206:       1     RESSPDX         ,WSTRANS        ,ADSCHAMT       ,XX             ,
0207:       1     RBTIME          ,COLRATE        ,COLDMD         ,RLDPER         ,
0208:       1     FDEM            ,FASUM          ,ERRMIN         ,POLAST         ,
0209:       1     FTCLR           ,PCORF          ,FACTS(8)       ,FLOSED(8)      ,
0210:       1     FVMX(8)         ,FC1            ,POINT(3)       ,SPAN(3)        ,
0211:       1     OFFSET(3)       ,XPRINT         ,XPERIOD        ,PRINT
0212:        REAL
0213:       1     MW              ,LLL
0214:        DIMENSION
```

```
0215:      1     RDHCALC1(1)    ,RAICVT(15)
0216:       EQUIVALENCE
0217:      1     ( RDHCALC1(1) , POLIM )        ,( POLIM, RAICVT(1) )
0218:       DIMENSION
0219:      1     DISP(9)
0220:       EQUIVALENCE
0221:      1     ( DISP(1)      , ODMD )
0222: C
0223:       COMMON /RDHINIT/
0224:      1     AIHL(15)       ,AILL(15)       ,SLOPE(15)      ,BINT(15)       ,
0225:      1     RBLIM(3)       ,RBRAT(3)       ,ODMDMAX        ,DARATMAX       ,
0226:      1     DLRATMAX       ,LLLMAX         ,HLLMAX         ,VPOSLMAX       ,
0227:      1     SPDRMINS       ,SPDRPLUS       ,RDSPMAX        ,WR             ,
0228:      1     HLS            ,HLF            ,HEL            ,LEL            ,
0229:      1     GS1            ,RDMIN          ,GL2            ,GL3            ,
0230:      1     WSERRSUP       ,T1             ,T2             ,T3             ,
0231:      1     HANDIFPO       ,DLOSEOR        ,RTVO           ,RGVO           ,
0232:      1     RGVC           ,WSDIP          ,MWINIT         ,VPOSLINC       ,
0233:      1     GVSPMIN        ,VTESTINC       ,RDREF          ,TWS            ,
0234:      1     TMW            ,TPI            ,DBTRKL         ,DBTRKS         ,
0235:      1     GR1            ,GR2            ,GR3            ,GR4            ,
0236:      1     GR6            ,GR7            ,GR8            ,ADSRATE        ,
0237:      1     TPCRATE        ,WSMIN          ,WSMAX          ,AIDSMW         ,
0238:      1     AIDSPI         ,GS2            ,T4             ,GVINIT         ,
0239:      1     PIMAX          ,MWMAX          ,DIMAX          ,WSREFMIN       ,
0240:      1     RERCCI         ,RAIOSERV       ,WSERRDIG       ,YVMANDB        ,
0241:      1     GVMANDB        ,ADSMAX7        ,TESTAIMX       ,XTIME          ,
0242:      1     XUPDATE        ,FRGSLOPE       ,FRGINT         ,REFSLOPE       ,
0243:      1     REFINT         ,PLRCORR        ,GR11           ,GL2REF         ,
0244:      1     GL3REF         ,T2REF          ,T3REF          ,RATELD         ,
0245:      1     RDRND          ,MXPDEV         ,FTOLRM         ,FTOLRF         ,
0246:      1     MXPRCH         ,FC             ,FA             ,RDGNDL         ,
0247:      1     RDGNDH         ,RLOWFREQ       ,TNONOZ         ,FNOVLV         ,
0248:      1     FX             ,CONV           ,PL(7)          ,PZ(7)          ,
0249:      1     NONOZ(8)       ,FDCF(7)        ,FTOLRFLO       ,FTOLRFHI       ,
0250:      1     FMMXB          ,FMINAS         ,FINCR          ,TRCTOLR        ,
0251:      1     COEF(7)        ,FLIN(7)        ,PZI(7)         ,FLOWCHNG       ,
0252:      1     HYSTOB         ,GAINVHP(6)     ,PZ2SPEED       ,RMWFLOX        ,
0253:      1     ADSPLMAX       ,DBOPTCL        ,DBOPTFOP       ,DBOPTTOL
0254:       REAL
0255:      1     LLLMAX         ,LEL            ,HANDIFPO       ,MWINIT         ,
0256:      1     MWMAX          ,MXPDEV         ,MXPRCH         ,NONOZ
0257:       DIMENSION
0258:      1     RDHINIT1(1)
0259:       EQUIVALENCE
0260:      1     ( RDHINIT1(1) , AIHL(1) )
0261:       DIMENSION
0262:      1     DISPMAX(9)
0263:       EQUIVALENCE
0264:      1     ( DISPMAX(1)   , ODMDMAX )
0265: C
0266:       COMMON /AITBL/
0267:      1     IAICW(185)     ,IAIXCONV(143) ,IAISFAW(143)  ,IAIHLLIM(64)  ,
0268:      1     AICONST(40)    ,IAISUBVL(30)  ,IAISREPL(100)
0269:       DIMENSION
0270:      1     IAICWATC(143)
0271:       EQUIVALENCE
0272:      1     ( IAICW(43) , IAICWATC(1) )
0273: C
0274:       COMMON /CORE/
0275:      1     ICOPF(1)
0276: C
0277: C
0278: C
0279: C
0280: C
0281: C
0282: C
0283: C
0284: C
0285: C
0286: C
0287:       COMMON/ATCICCOM/
0288:      1     DECOUNT        ,HPICOL         ,IPICOL         ,LOADPER        ,
0289:      1     RATEINDX       ,SDARTIME       ,LSTPTIDX       ,RHSTMCT        ,
```

```
0290:      1     THTMPCNT        ,STMTLCT        ,INSE  (100)
0291:       INTEGER
0292:      1     DECOUNT         ,HPICOL         ,IPICOL         ,LOADPER        ,
0293:      1     RATEINDX        ,SOAKTIME       ,LSTPTIDX       ,RHSTHCT        ,
0294:      1     THTMPCNT        ,STMTLCT        ,INSERT
0295:       DIMENSION
0296:      1     IATCICOM(1)
0297:       EQUIVALENCE
0298:      1     ( IATCICOM(1) , DECOUNT )
0299: C
0300:       COMMON/ATCTICOM/
0301:      1     NUMSEN          ,LY
0302:       INTEGER
0303:      1     NUMSEN          ,LY
0304:       DIMENSION
0305:      1     IATCIICM(1)
0306:       EQUIVALENCE
0307:      1     (  IATCIICM(1) ,  NUMSEN)
0308:       COMMON /ATCLCCOM/
0309:      1     ANDEHOLD        ,BMTTRIP        ,EXHERR         ,BRERR          ,
0310:      1     GLERR           ,DEOFFN         ,HETHOLD        ,VACOFLIM       ,
0311:      1     HIECEN          ,COOLGSHI       ,HMETHI         ,RPOFFN         ,
0312:      1     H2OHOLD         ,DET            ,ESTROTIM       ,EXCMON         ,
0313:      1     GENANUN         ,GRCEXC         ,GUFCEXC        ,HPSTINV        ,
0314:      1     H2FAULT         ,H2OTRIP        ,IPMTFAIL       ,IPSTINV        ,
0315:      1     LDEODMD         ,RHFAIL         ,ROTGNP         ,ROTROTG        ,
0316:      1     RPOSHOLD        ,RPOSTRIP       ,RSINCRAT       ,RSREDRAT       ,
0317:      1     RTSTHOLD        ,RUNPOS         ,SOAKDUN        ,SOAKRET        ,
0318:      1     TBALRM          ,THRB           ,TBTRIP         ,TGCOM          ,
0319:      1     TICMFAIL        ,TIMPFAIL       ,TIMPHOLD       ,VIBRATN        ,
0320:      1     VIT             ,VSRCNP         ,CHKAMET        ,CHKANDE        ,
0321:      1     DEHOLD          ,CLHPDRV        ,CLIPDRV        ,OHPDRV         ,
0322:      1     OIPDRV          ,ATSASPB        ,ATSVPLPB       ,OVRIDIND       ,
0323:      1     VSFAIL          ,SSPRDA         ,SNRTPERM       ,SNOVPERM       ,
0324:      1     TVGVINIT        ,TGINOP         ,SOAKFLAG       ,SYNCPROG       ,
0325:      1     TURBDEC         ,TURBACC        ,HOLDWS         ,HOLDLOAD       ,
0326:      1     TURBTRIP        ,MES(500)
0327:       LOGICAL
0328:      1     ANDEHOLD        ,BMTTRIP        ,EXHERR         ,BRERR          ,
0329:      1     GLERR           ,DEOFFN         ,HETHOLD        ,VACOFLIM       ,
0330:      1     HIECEN          ,COOLGSHI       ,HMETHI         ,RPOFFN         ,
0331:      1     H2OHOLD         ,DET            ,ESTROTIM       ,EXCMON         ,
0332:      1     GENANUN         ,GRCEXC         ,GUFCEXC        ,HPSTINV        ,
0333:      1     H2FAULT         ,H2OTRIP        ,IPMTFAIL       ,IPSTINV        ,
0334:      1     LDEODMD         ,RHFAIL         ,ROTGNP         ,ROTROTG        ,
0335:      1     RPOSHOLD        ,RPOSTRIP       ,RSINCRAT       ,RSREDRAT       ,
0336:      1     RTSTHOLD        ,RUNPOS         ,SOAKDUN        ,SOAKRET        ,
0337:      1     TBALRM          ,THRB           ,TBTRIP         ,TGCOM          ,
0338:      1     TICMFAIL        ,TIMPFAIL       ,TIMPHOLD       ,VIBRATN        ,
0339:      1     VIT             ,VSRCNP         ,CHKAMET        ,CHKANDE        ,
0340:      1     DEHOLD          ,CLHPDRV        ,CLIPDRV        ,OHPDRV         ,
0341:      1     OIPDRV          ,ATSASPB        ,ATSVPLPB       ,OVRIDIND       ,
0342:      1     VSFAIL          ,SSPRDA         ,SNRTPERM       ,SNOVPERM       ,
0343:      1     TVGVINIT        ,TGINOP         ,SOAKFLAG       ,SYNCPROG       ,
0344:      1     TURBDEC         ,TURBACC        ,HOLDWS         ,HOLDLOAD       ,
0345:      1     TURBTRIP        ,MES
0346:       LOGICAL
0347:      1     LATCLCCM(1)
0348:       EQUIVALENCE
0349:      1     ( LATCLCCM(1) , ANDEHOLD )
0350: C
0351:       COMMON/ATCLICOM/
0352:      1     ATCLISPR(47)
0353:       LOGICAL
0354:      1     ATCLISPR
0355:       COMMON /ATCAICOM/
0356:      1     TIMP1           ,TIMP2          ,TICM           ,TVSTM(4)       ,
0357:      1     IPTNGM          ,IPINLM         ,TPEXHSTM       ,IPBRT          ,
0358:      1     VIBREV(11)      ,ECENTRIC       ,RSCTI          ,RSCTO          ,
0359:      1     LSCTI           ,LSCTO          ,IPCOOLST       ,BASE(11)       ,
0360:      1     COVER(11)       ,RFTBMT1        ,RFTBMT2        ,RFTBMT1        ,
0361:      1     RFTBMT2         ,BEARMT(21)     ,OILIN          ,OILOUT         ,
0362:      1     STCTMP2         ,STCOTMP2       ,EXCOOLI1       ,EXCOOLI2       ,
0363:      1     EXCOOLO1        ,EXCOOLO2       ,H2COOL1        ,H2COOL2        ,
```

```
0364:      1     H2COOL3        ,H2COOL4        ,HGTMP1         ,HGTMP2         ,
0365:      1     HGTMP3         ,HGTMP4         ,HGTMP5         ,HGTMP6         ,
0366:      1     HGTMP7         ,HGTMP8         ,HGTMP9         ,HGTMPA         ,
0367:      1     HGTMPB         ,HGTMPC         ,H2PRESS        ,H2PUR          ,
0368:      1     H2SODIFP       ,STATCUR        ,MVAR           ,EHFLTMP        ,
0369:      1     SOATMP         ,H2SSOTMP       ,LPEXSTM1       ,LPEXSTM2       ,
0370:      1     LPEXSTM3       ,LPEXSTM4       ,HPGLSTM        ,LPGLSTM        ,
0371:      1     ENDWALL1       ,ENDWALL2       ,DEGO           ,DEGF           ,
0372:      1     RPOS           ,RPOS1          ,CONDPR1        ,CONDPR2        ,
0373:      1     CONDPR3        ,RTD1           ,RTD2           ,RTD00
0374:       REAL
0375:      1     TIMP1          ,TIMP2          ,TICM           ,TVSTM          ,
0376:      1     IPINRH         ,IPINLH         ,IPEXHSTM       ,IPBRT          ,
0377:      1     VIBDEV         ,ECCENTRIC      ,RSCTI          ,RSCTO          ,
0378:      1     LSCTI          ,LSCTO          ,IPCOOLST       ,BASE           ,
0379:      1     COVER          ,FFTBMT1        ,FFTBMT2        ,RFTBMT1        ,
0380:      1     RFTBMT2        ,BEARMT         ,OILIN          ,OILOUT         ,
0381:      1     STCINH20       ,STCOTH20       ,EXCOOLI1       ,EXCOOLI2       ,
0382:      1     EXCOOLO1       ,EXCOOLO2       ,H2COOL1        ,H2COOL2        ,
0383:      1     H2COOL3        ,H2COOL4        ,HGTMP1         ,HGTMP2         ,
0384:      1     HGTMP3         ,HGTMP4         ,HGTMP5         ,HGTMP6         ,
0385:      1     HGTMP7         ,HGTMP8         ,HGTMP9         ,HGTMPA         ,
0386:      1     HGTMPB         ,HGTMPC         ,H2PRESS        ,H2PUR          ,
0387:      1     H2SODIFP       ,STATCUR        ,MVAR           ,EHFLTMP        ,
0388:      1     SOATMP         ,H2SSOTMP       ,LPEXSTM1       ,LPEXSTM2       ,
0389:      1     LPEXSTM3       ,LPEXSTM4       ,HPGLSTM        ,LPGLSTM        ,
0390:      1     ENDWALL1       ,ENDWALL2       ,DEGO           ,DEGF           ,
0391:      1     RPOS           ,RPOS1          ,CONDPR1        ,CONDPR2        ,
0392:      1     CONDPR3        ,RTD1           ,RTD2           ,RTD00
0393:       DIMENSION
0394:      1     ATCATCM(1)
0395:       EQUIVALENCE
0396:      1     ( ATCATCM(1)   , TIMP1 )
0397:       COMMON /ATCRCCOM/
0398:      1     ALSCTD         ,ARSCTD         ,ATCARAT        ,ATDIF          ,
0399:      1     CALTIMP        ,CHKSPD         ,HPALM50P       ,HPALM75P       ,
0400:      1     HPALM85P       ,HPALM90P       ,HPTDIFLM       ,IPALM50P       ,
0401:      1     IPALM75P       ,IPALM85P       ,IPALM90P       ,IPATDIF        ,
0402:      1     IPTAVG         ,IPTDIF         ,IPTDIFLM       ,LOADRATE       ,
0403:      1     RSCTD          ,LSCTD          ,MVA            ,PF             ,
0404:      1     RECTHRTM       ,ROTBOR         ,ROTSURF        ,SATTMP         ,
0405:      1     STGTDEM        ,TAVG           ,TBSPDREF       ,TDIF           ,
0406:      1     TEMPLIM1       ,TEMPLIM2       ,TIMPCRAT       ,TLRATE         ,
0407:      1     VIBLIMIT       ,VIBSPDRF       ,VIBTRIP(11)    ,MAXDIFCP       ,
0408:      1     HPGSMST        ,HPGSMEW1       ,HPGSMEW2       ,IPROTBOR       ,
0409:      1     IPROTSUR       ,DEHOMD         ,DEHREF         ,ROLLTIME       ,
0410:      1     MWINCR         ,MWDECR         ,MAXMVA         ,ANDEGE         ,
0411:      1     ANDEGO         ,VIBLIM(11)     ,EXPECT         ,LIMIT          ,
0412:      1     STATDIF        ,H2ODIF(11)     ,HPEXHIPC
0413:       REAL
0414:      1     ALSCTD         ,ARSCTD         ,ATCARAT        ,ATDIF          ,
0415:      1     CALTIMP        ,CHKSPD         ,HPALM50P       ,HPALM75P       ,
0416:      1     HPALM85P       ,HPALM90P       ,HPTDIFLM       ,IPALM50P       ,
0417:      1     IPALM75P       ,IPALM85P       ,IPALM90P       ,IPATDIF        ,
0418:      1     IPTAVG         ,IPTDIF         ,IPTDIFLM       ,LOADRATE       ,
0419:      1     RSCTD          ,LSCTD          ,MVA            ,PF             ,
0420:      1     RECTHRTM       ,ROTBOR         ,ROTSURF        ,SATTMP         ,
0421:      1     STGTDEM        ,TAVG           ,TBSPDREF       ,TDIF           ,
0422:      1     TEMPLIM1       ,TEMPLIM2       ,TIMPCRAT       ,TLRATE         ,
0423:      1     VIBLIMIT       ,VIBSPDRF       ,VIBTRIP        ,MAXDIFCP       ,
0424:      1     HPGSMST        ,HPGSMEW1       ,HPGSMEW2       ,IPROTBOR       ,
0425:      1     IPROTSUR       ,DEHOMD         ,DEHREF         ,ROLLTIME       ,
0426:      1     MWINCR         ,MWDECR         ,MAXMVA         ,ANDEGE         ,
0427:      1     ANDEGO         ,VIBLIM         ,EXPECT         ,LIMIT          ,
0428:      1     STATDIF        ,H2ODIF         ,HPEXHIPC
0429:       DIMENSION
0430:      1     RATCRCCM(1)
0431:       EQUIVALENCE
0432:      1     ( RATCRCCM(1) , ALSCTD  )
0433: C
0434:       COMMON /ATCRICOM/
0435:      1     CLDDIFLM       ,DEALRM1        ,DEALRM2        ,DEALRM3        ,
0436:      1     DEALRM4        ,DETRIP1        ,DETRIP2        ,DETRIP3        ,
0437:      1     DETRIP4        ,GLRATE         ,HIDIFLM        ,IPCLDDFL       ,
```

```
0438:      1     HOTDIFLM       ,RMMVA          ,RPALRM         ,RPM(6)         ,
0439:      1     RPMM(6)        ,RPTRIP         ,NDIFLM         ,IPHILDTL       ,
0440:      1     IPNDIFLM       ,IPHOTDFL       ,STCMDFLM       ,TCRATLIM       ,
0441:      1     BMTTLIM        ,TBMTTLIM       ,CTCOOLLM       ,SATTMPC        ,
0442:      1     MARGIN1        ,MARGIN2        ,SOAKSPD        ,TTBRMAL        ,
0443:      1     JTBRMAL        ,STCDSLIM       ,H2OALIM        ,H2OTLIM        ,
0444:      1     VIBTRIPI(11)   ,PERCENDB       ,VIBTRPDB       ,VIBDIFDB       ,
0445:      1     REF(6)         ,BROOL          ,SOTHALIM       ,SOTLALIM       ,
0446:      1     H2PURLL        ,H2COOLLL       ,H2COOLHL       ,EXCOALIM       ,
0447:      1     EXCOTRLM       ,LPGLSHLM       ,LPGLSLLM       ,HPGSEWLM       ,
0448:      1     LPEXALIM       ,LPEXTRLM       ,H2PRMAX        ,H2PRMIN        ,
0449:      1     RATECUR        ,RPTRIP1        ,RPALRM1        ,IPSTMLIM
0450:       REAL
0451:      1     CLDDIFLM       ,DEALRM1        ,DEALRM2        ,DEALRM3        ,
0452:      1     DEALRM4        ,DETRIP1        ,DETRIP2        ,DETRIP3        ,
0453:      1     DETRIP4        ,GLRATE         ,HIDIFLM        ,IPCLDDFL       ,
0454:      1     HOTDIFLM       ,RMMVA          ,RPALRM         ,RPM            ,
0455:      1     RPMM           ,RPTRIP         ,NDIFLM         ,IPHILDTL       ,
0456:      1     IPNDIFLM       ,IPHOTDFL       ,STCMDFLM       ,TCRATLIM       ,
0457:      1     BMTTLIM        ,TBMTTLIM       ,CTCOOLLM       ,SATTMPC        ,
0458:      1     MARGIN1        ,MARGIN2        ,SOAKSPD        ,TTBRMAL        ,
0459:      1     JTBRMAL        ,STCDSLIM       ,H2OALIM        ,H2OTLIM        ,
0460:      1     VIBTRIPI       ,PERCENDB       ,VIBTRPDB       ,VIBDIFDB       ,
0461:      1     REF            ,BROOL          ,SOTHALIM       ,SOTLALIM       ,
0462:      1     H2PURLL        ,H2COOLLL       ,H2COOLHL       ,EXCOALIM       ,
0463:      1     EXCOTRLM       ,LPGLSHLM       ,LPGLSLLM       ,HPGSEWLM       ,
0464:      1     LPEXALIM       ,LPEXTRLM       ,H2PRMAX        ,H2PRMIN        ,
0465:      1     RATECUR        ,RPTRIP1        ,RPALRM1        ,IPSTMLIM
0466:       DIMENSION
0467:      1     RATCRICM(1)
0468:       EQUIVALENCE
0469:      1     (  RATCRICM(1) , CLDDIFLM )
0470: C
0471:       COMMON /MWCRTBF/MWCRTBF1,MWCRTBF2,MWCRTBUF(5,9)
0472: C
0473: C
0474: C
0475: C
0476: C
0477:       LOGICAL LITE(8) ,RESET,TSOFFATC,TSONLYAT
0478:       EQUIVALENCE(LITE(1),TGINOP)
0479:       LOGICAL DOTMGP00(3)
0480:       INTEGER CT2MIN
0481:       INTEGER NUMLITES,IREGATCL(8),IMSKATCL(8),DOREGP00(3),DOMSKP00(3)
0482:       DATA     IMSKATCL/$0040,$0080,$0001,$0002,$0004,$0008,$0010,$0020/
0483:       DATA     IREGATCL/13,13,14,14,14,14,14,14/
0484:       DATA     NUMLITES/8/
0485:       DATA DOREGP00/5,5,6/
0486:       DATA DOMSKP00/$0040,$0080,$0001/
0487: C     IS "COMPUTER TIME-OUT"INDICATOR SET ?
0488: 00200 LOADPER =(MW/RATELD) * 100.
0489:       IATCREQ = 0
0490:       IF(.NOT. LATCRSET) GO TO 00500
0491:       IF(RESET) GO TO 00525
0492: C     SET HP AND IP 2HR COUNTERS EQUAL ZERO; SET HP & IP STRESS INVALID
0493: 00550 HPICOL = 0
0494:       IPICOL = 0
0495:       HPSTINV = .TRUE.
0496:       IPSTINV = .TRUE.
0497: C     SET # STORED METAL COUNT AND # DIFF EXP COUNT EQUAL ZERO
0498:       STMTLCT = 0
0499:       DECOUNT = 0
0500: C     CLEAR"CHECK ANTIC METAL";"CHECK ANTIC DIFF EXP";& ALL LITE INDIC
0501:       CHKANDE = .FALSE.
0502:       CHKAMET = .FALSE.
0503:       DO 00575 I = 1,NUMLITES
0504:       LITE(I) = .FALSE.
0505: 00575 CONTINUE
0506: C     CLEAR "COMPUTER TIME-OUT" INDICATOR;SET ATC REJECT TO OPER AUTO
0507: 00600 LATCRSET = .FALSE.
0508:       SSPROA  = .TRUE.
0509: C     SET 2-MINUTE COUNTER EQUAL ZERO
0510:       CT2MIN = 0
0511: C     RESET DRAIN VALVE INDICATORS;SET REHEAT STEAM CT = 0
```

```
0512:          CLHPDRV= .FALSE.
0513:          CLIPDRV= .FALSE.
0514:          OHPDRV = .FALSE.
0515:          OIPDRV = .FALSE.
0516:          RHSTMCT = 0
0517:          THTMPCNT = 0
0518:          RESET = .TRUE.
0519:          GO TO 00525
0520: C        IS"ATC IN CONTROL" INDICATOR SET ?
0521: 00225    IF(ATS     ) GO TO 00700
0522:          MES(0006) = .FALSE.
0523: C        IS"TURBINE SUPERVISION OFF" INDICATOR SET ?
0524:          IF(TSOFF    ) GO TO 00800
0525:          MES(0007) = .FALSE.
0526:          MES(000H) = .FALSE.
0527:          TSOFFATC = .FALSE.
0528: C        IS"TURBINE SUPERVISION ONLY" INDICATOR SET ?
0529:          IF(TSONLYAT) GO TO 00300
0530: C        SET "SUPERVISION ONLY"INDICATOR
0531:          TSONLYAT = .TRUE.
0532: C        IS"ATC REJECT TO OPER AUTO" INDICATOR SET ?
0533:          IF(.NOT. SSPROA) GO TO 00750
0534:          SSPROA = .FALSE.
0535:          GO TO 00300
0536: 00750    MES(05) = .TRUE.
0537: C        CALCULATE WHICH A/I POINTS SHOULD NOW BE CONVERTED BEFORE BIDDING
0538: C        A PERIODIC.
0539: C                  1. NAIPTSCN IS THE DEH VARIABLE FOR THE NUMBER OF POINTS
0540: C                     TO BE CONVERTED
0541: C
0542: C                  2. MAIPTIDX IS THE POINTER FOR THE FIRST POINT TO BE
0543: C                     CONVERTED
0544: 00300    LSTPTIDX = MAIPTIDX + NAIPTSCN - 1
0545:          CALL AICONV
0546:          GO TO (1,16,2,4,13,1,16,6,15,13,1,16,2,9,13,1,16,6,15,13,
0547:         1        1,16,2,3,13,1,16,6,15,13,1,16,2,4,13,1,16,6,15,13,
0548:         1      1,16,2,10,13,1,16,6,15,13,1,16,2,11,13,1,16,6,15,13)IASCNCMP
0549: 00001    CALL PER1
0550:          GO TO 00900
0551: 00002    CALL PER2
0552:          CALL PER5
0553:          GO TO 00900
0554: 00003    IF(RUNP03) CALL PER3
0555:          GO TO 00900
0556: 00004    CALL PER4
0557:          GO TO 00900
0558: 00006    CALL PER6
0559:          CALL PER5
0560:          GO TO 00900
0561: 00009    CALL PER9
0562:          GO TO 00900
0563: 00010    CALL PER10
0564:          CALL PER12
0565:          GO TO 00900
0566: 00011    CALL PER11
0567:          CALL PER14
0568:          GO TO 00900
0569: 00013    CALL PER13
0570:          CALL PER8
0571:          GO TO 00900
0572: 00015    CALL PER15
0573:          GO TO 00900
0574: 00016    CALL PER16
0575:          GO TO 00900
0576: 00900    CALL PER7
0577:          DOIMGP00(1) = OVRIDIND
0578:          DOIMGP00(2) = SNOVPERM
0579:          DOIMGP00(3) = SNRTPERM
0580:          CALL M:DDO(3,DOIMGP00(1),DOREGP00(1),DOMSKP00(1))
0581:          CALL M:DDO(NUMLITES,LITE(1),IREGATCL(1),IMSKATCL(1))
0582:          CALL EXIT
0583:          GO TO 00200
0584: 00[illegible]0 RESET = .FALSE.
0585:          IF(CT2MIN .GE. 120) GO TO 00225
0586:          CT2MIN = CT2MIN+1
```

```
0587: 00525 CALL EXIT
0588:       GO TO 00200
0589: 00700 MES(0001) = VSFAIL
0590:       MES(0002) = TURBTRIP
0591:       MES(0003) = HPSTINV ,OR, IPSTINV
0592:       MES(0004) = LDEQDMD
0593:       MES(0006) = ,NOT, LDEQDMD
0594:       SSPROA = MES(0001) ,OR, MES(0002) ,OR, MES(0003) ,OR, MES(0004)
0595:       IF(SSPROA) RUNLOGIC = ,TRUE,
0596:       TSOFFATC = ,FALSE,
0597:       TSONLYAT = ,FALSE,
0598:       GO TO 00300
0599: 00800 IF(TSOFFATC) GO TO 00812
0600:       MES(0008) = VIDARDS
0601:       IF(MES(08)) GO TO 00811
0602:       MES(07) = ,TRUE,
0603: 00811 TSOFFATC = ,TRUE,
0604: 00812 TSONLYAT = ,FALSE,
0605:       GO TO 00300
0606:       END

  PROGRAM SIZE: 0310     DATA POOL SIZE: 0051     ERROR COUNT:  0000
0463:      1     EXCOTRLM        ,LPGLSHLM        ,LPGLSLLM        ,HPGSEWLM        ,
0464:      1     LPEXALIM        ,LPEXTRLM        ,H2PRMAX         ,H2PRMIN         ,
0465:      1     RATECUP         ,RPTRIP1         ,RPALRM1         ,IPSTMLIM
0466:       DIMENSION
0467:      1     RATCRICM(1)
0468:       EQUIVALENCE
0469:      1     (  RATCRICM(1) , CLDDIFLM )
0470: C
0471:       COMMON /MWCRTBF/MWCRTBF1,MWCRTBF2,MWCRTBUF(5,9)
0472: C
0473: C
0474: C
0475: C
0476: C
0477: C     P01 INTERNAL VARIABLES
0478:       REAL C(3,21),V(21),          TP(21),T(21),TDIFT(21),TAVGT(21),
0479:      1                TVSTMT(4,6),CONDPRES,C1,C2,C3,C4,C5,C6,C7,C8,C9,
0480:      1      HXFER,TDEM,TDIFSUM,TIMP,TNUM,TVDIF,       TVSTM,TVSTMAX,
0481:      1      TVSTMIN,TMAX(4)
0482:       INTEGER COUNTF, FIVMINCT,I,IAVCT,J,K, NUMLAYRS,ONEMINCT,SL,
0483:      1         THTMPCNT,W,Z,CT2MIN
0484:       LOGICAL MES01(05)
0485:          EQUIVALENCE(MES01(01),MES(9))
0486: C     INITIALIZE THE FOLLOWING P01 INTERNAL VARIABLES USING DATA STATEMENTS
0487: C     C(3,21),  V(21), C1 THRU C9, TDEM, NUMLAYRS
0488:       DATA C1,C2,      C3,      C4,          C5,          C6,   C7,  C8
0489:      1   /,5,,7575E-1,-,25E-1,-,7221RE-5,,719444E-2,2,525,264,,12,27/
0490:       DATA C9/1000,/
0491:       DATA C / ,6845E-3        ,,1697        ,,8303        ,
0492:      1         ,8921E-1        ,,8329E-1     ,,8275        ,
0493:      1         ,8943E-1        ,,8307E-1     ,,8275        ,
0494:      1         ,8969E-1        ,,8281E-1     ,,8275        ,
0495:      1         ,8998E-1        ,,8252E-1     ,,8275        ,
0496:      1         ,9034E-1        ,,8216E-1     ,,8275        ,
0497:      1         ,9076E-1        ,,8174E-1     ,,8275        ,
0498:      1         ,9129E-1        ,,8121E-1     ,,8275        ,
0499:      1         ,9196E-1        ,,8054E-1     ,,8275        ,
0500:      1         ,9283E-1        ,,7967E-1     ,,8275        ,
0501:      1         ,9401E-1        ,,7849E-1     ,,8275        ,
0502:      1         ,9571E-1        ,,7679E-1     ,,8275        ,
0503:      1         ,1838           ,,8162        , 0,          ,
0504:      1         0,              ,0,           , 0,          ,
0505:      1         0,              ,0,           , 0,          ,
0506:      1         0,              ,0,           , 0,          ,
0507:      1         0,              ,0,           , 0,          ,
0508:      1         0,              ,0,           , 0,          ,
0509:      1         0,              ,0,           , 0,          ,
0510:      1         0,              ,0,           , 0,          ,
0511:      1         0,              ,0,           , 0,/
0512:       DATA V/,2375,    ,4517,    ,4207,    ,3897,    ,3587,    ,3276,    ,2966
0513:      1      ,,2656,    ,2345,    ,2035,    ,1725,    ,1414,    ,5907E-1,
0514:      1   0,,  0,,  0,,  0,,  0,,  0,,  0,,  0,/
```

```
0515:        DATA TDEM/3.55907/
0516:        DATA NUMLAYRS/13/
0517:        DATA HPCF/.152E-5/
0518: C
0519: C      IS HP STRESS INVALID INDICATOR SET ?
0520: C
0521:        IF(HPSTINV) GO TO 01100
0522: 01000 HES01(05)= .FALSE.
0523: C
0524: C      IS TURBINE ON TURNING GEAR ?
0525: C
0526: 01120 IF(TURBONTG) GO TO 01150
0527: C
0528: C      IS MAIN BREAKER CLOSED ?
0529: C
0530:        IF(.NOT. MGB) GO TO 01160
0531: C
0532: C      IS HIGH LOADING RATE INDICATOR SET ?
0533: C
0534:        IF(HILDRAT) GO TO 01170
0535:        HES01(02)= .FALSE.
0536: C
0537: C      WHEN HIGH LOADING RATE INDICATOR IS RESET,
0538: C      HP ROTOR(SURF - VOL AVG) EFFECTIVE  TEMP DIFF LIMIT = HP NORM LOAD
0539: C                    RATE TEMP LIMIT
0540: C
0541:        HPTDIFLM = NDIFLM
0542: C
0543: C      IS COUNTER "FR  GT  60 ?
0544: C
0545:        IF(COUNTF .GT. 60) GO TO 01200
0546: C
0547: C      CALCULATE HEAT TRANSFER COEFFICIENT FOR FIRST 5 MIN OF LOAD CONTRL
0548: C
0549:        COUNTF  = COUNTF + 1
0550:        TEMP2 = COUNTF
0551:        HXFER = C7 + C8 * TEMP2
0552:        GO TO 01210
0553: C
0554: C      SET HEAT TRANSFER COEFFICIENT EQUAL HIGH PRESET VALUE
0555: C
0556: 01200 HXFER = C9
0557: C
0558: C      COMPUTE HP ROTOR SURFACE TEMPERATURE
0559: C
0560: 01210 TIMP = AMAX1(TIMP1,TIMP2)
0561:        TP(1)= C(1,1) * HXFER * TIMP + C(2,1) * T(2) +
0562:       1   (C(3,1)-C(1,1)*HXFER)*T(1)
0563:        W = NUMLAYRS  - 1
0564: C
0565: C      COMPUTER ROTR INTERMEDIATE SEGMENTS TEMPERATURES
0566: C
0567:        DO 01211 J=2,W
0568:        TP(J) = C(1,J) * T(J-1) + C(2,J) * T(J+1) + C(3,J) * T(J)
0569: 01211 CONTINUE
0570:        Z = NUMLAYRS
0571: C
0572: C      COMPUTE ROTOR BORE TEMPERATURE
0573: C
0574:        TP(Z) = C(1,Z) * T(Z-1) + C(2,Z) * T(Z)
0575:        DO 01212 J=1,Z
0576: 01212 T(J) = TP(J)
0577:        ROTSURF = TP(1)
0578:        ROTBOR = TP(NUMLAYRS)
0579:        TNUM = 0.
0580: C
0581: C      COMPUTE ROTOR VOLUME AVERAGE TEMP
0582: C
0583:        DO 01213 J=1,Z
0584: 01213 TNUM = TNUM + V(J)*T(J)
0585:        TAVG = TNUM / TDEM
0586: C
0587: C      COMPUTE ROTOR SURFACE MINUS ROTOR VOLUME AVERAGE EFFECTIVE TEMP DIFF
0588: C
```

```
0589:        TDIF = TAVG-TR(1) + HPCF*WS**2
0590: C
0591: C      HAS ONE MINUTE ELAPSED SINCE LAST CALCULATION OF 15 MINUTE
0592: C      ANTICIPATED ROTOR SURFACE - VOLUME AVG EFFECTIVE TEMP, DIFFERENCE
0593: C
0594:        IF(ONEMINCT .GE. 12) GO TO 01600
0595:        ONEMINCT = ONEMINCT + 1
0596: C
0597: C      IS HP STRESS INVALID INDICATOR SET ?
0598: C
0599: 01300 IF(HPSTINV) GO TO 01310
0600:        IF(CT2MIN .GE. 24) CT2MIN=0
0601:        CT2MIN = CT2MIN + 1
0602:        IF(CT2MIN .LT. 24) GO TO 01310
0603: C
0604: C      IS ABSOLUTE VALUE OF PRESENT ROTOR EFFECTIVE TEMP DIFF LT LIMIT
0605: C
0606:        MES01(01)= (RGE:(TDIF,HPTDIFLM))
0607:        INSERT(1) = HPTDIFLM
0608: C
0609: C      IS THROTTLE STEAM TEMP DIFFERENCE LESS THAN 25 F
0610: C
0611: 01310 TVSTMAX = AMAX1(TVSTM(1),TVSTM(2),TVSTM(3),TVSTM(4))
0612:        TVSTMIN = AMIN1(TVSTM(1),TVSTM(2),TVSTM(3),TVSTM(4))
0613:        MES01(03)= RGE:(TVSTMAX-TVSTMIN,25.)
0614: C
0615: C      IS MAIN BREAKER CLOSED ?
0616: C
0617:        IF(.NOT. MGB)RETURN
0618: C
0619: C      IS LOAD LESS THAN 20%
0620: C
0621:        IF(LOADPER .LT. 20) GO TO 01330
0622: C
0623: C      IS 5-MINUTE COUNTER LESS THAN 5 MINUTES
0624: C
0625:        IF(FIVMINCT .LT. 60) GO TO 01320
0626:        FIVMINCT = 0
0627:        GO TO 01180
0628: C
0629: C      IS FIRST STAGE METAL TEMP LESS THAN 250F ?
0630: C
0631: 01150 IF(RLT:(TICM,250.)) GO TO 01151
0632: 01155 HPTDIFLM = HOTDIFLM
0633: C
0634: C      SET COUNTER "F" EQUAL ZERO.
0635: C
0636: 01152 COUNTF = 0
0637: C
0638: C      COMPUTER HEAT TRANSFER COEFFICIENT ON SPEED CONTROL
0639: C
0640:        CONDPRES = AMAX1(CONDPR1,CONDPR2,CONDPR3)
0641:        HXFER = C1 * CONDPRES + C2 * WS    + C3 * CONDPRES**2 +
0642:       1        C4 * WS   **2 + C5 * CONDPRES*WS    +C6
0643:        GO TO 01210
0644: 01151 HPTDIFLM =CLDDIFLM
0645:        GO TO 01152
0646: C
0647: C      IS HEAT SOAK COMPLETE INDICATOR SET ?
0648: C
0649: 01160 IF(SOAKDUN)GO TO 01155
0650:        GO TO 01151
0651: C
0652: C      IS THROTTLE TEMP COUNTER GREATER THAN OR EQUAL 6 ?
0653: C
0654: 01180 IF(THTMPCNT .LT. 6) GO TO 01401
0655: C
0656: C      FRS IS ANY STORED TV STEAM TEMP MINUS PRESENT VALUE GT 150F
0657: C
0658:        DO 01410 J= 1,4
0659:         TMAX(J) =  AMAX1(TVSTMT(J,1),TVSTMT(J,2),TVSTMT(J,3),TVSTMT(J,4),
0660:       1                TVSTMT(J,5),TVSTMT(J,6))
0661:        TVDIF =  TMAX(J) - TVSTM(J)
0662:        MES01(04)= RGT:(TVDIF,150.)
```

```
0663:          IF(MES01(04))GO TO 01400
0664: 01410 CONTINUE
0665: C
0666: C        STORE NEWEST VALUE OF STEAM TEMP FOR EACH THROTTLE VALUE
0667: C
0668: 01400 IF(K.EQ. 6) K = 0
0669:          K = K +1
0670: 01403 DO 01402 I = 1,4
0671:          TVSTMT(I,K) = TVSTM(I)
0672: 01402 CONTINUE
0673:          RETURN
0674: 01401 THTMPCNT = THTMPCNT +1
0675:          K = THTMPCNT
0676:          GO TO 01403
0677: C
0678: C        SET HP ROTOR(SURFACE MINUS VOLUME AVERAGE)TEMP DIFF EFFECTIVE LIMIT EQL
0679: C        HP HIGH LOAD RATE TEMP LIMIT
0680: C
0681: 01170 HPTDIFLM = HIDIFLM
0682:          MES01(02)= .TRUE.
0683:          GO TO 01152
0684: C
0685: C        SET NUMBER OF THROTTLE TEMPERATURES STORED EQUAL TO ZERO.
0686: C
0687: 01330 THTMPCNT = 0
0688:          FIVMINCT = 0
0689: 01311 RETURN
0690: C
0691: C        INCREMENT FIVE MINUTE COUNTER
0692: C
0693: 01320 FIVMINCT = FIVMINCT + 1
0694:          GO TO 01311
0695: 01100 MES01(05)= .TRUE.
0696: C
0697: C        IS FIRST STAGE STEAM SENSOR FAIL INDICATOR SET ?
0698: C
0699:          IF (TIMPFAIL) GO TO 01108
0700: C
0701: C        IS HP 2HR COUNTER GT 7200 SEC ?
0702: C
0703:          IF(HPICOL .GT. 7200)GO TO 01107
0704: C
0705: C        IS HP 2HR COUNTER EQUAL ZERO?
0706: C
0707:          IF(HPICOL .EQ. 0) GO TO 01800
0708: 01105 HPICOL = HPICOL + 5
0709:          GO TO 01120
0710: C
0711: C        CLEAR HP STRESS INVALID INDICATOR
0712: C
0713: 01107 HPSTINV = .FALSE.
0714:          GO TO 01000
0715: C
0716: C        SET HP 2HR COUNT EQUAL ZERO
0717: C
0718: 01108        HPICOL = 0
0719:          GO TO 01310
0720: C
0721: C        SET ONE MINUTE COUNTER EQUAL ZERO
0722: C
0723: 01600 ONEMINCT = 0
0724: C
0725: C        CALCULATE SUM OF LAST 15 VALUES OF ROTOR(SURFACE-VOLUME AVG) EFFECTIVE
0726: C           TEMPS
0727: C
0728:          TDIFSUM = 0.
0729:          DO 01610 J=1,15
0730:          TDIFSUM = TDIFSUM + TDIFT(J)
0731: 01610 CONTINUE
0732: C
0733: C        CALCULATE 15 MINUTE ANTICIPATED VALUE OF HP ROTOR(SURF - VOL AVG)
0734: C           EFFECTIVE TEMPS
0735: C
0736:          ATDIF = 2.875 * TDIF - .125 * TDIFSUM
```

```
0737: C
0738: C       UPDATE OLDEST OF THE 15 VALUES OF(ROTOR SURF-VOL AVG) EFFECTIVE
0739: C          TEMPERATURE DIFFERENCES
0740: C
0741:         TDIFT(IAVCT) = TDIF
0742: C
0743: C       UPDATE OLDEST OF THE 15 VALUES OF ROTOR VOLUME AVG TEMP
0744: C
0745:         TAVGT(IAVCT) = TAVG
0746:         IF(IAVCT .GT. 15)IAVCT = 0
0747:         IAVCT = IAVCT + 1
0748:         GO TO 01300
0749: C
0750: C       IS 1ST STAGE METAL SENSOR FAIL INDICATOR SET ?
0751: C
0752: 01800 IF(TICMFAIL) GO TO 01310
0753: C
0754: C       INITIALIZE HP ROTOR TEMP = 1ST STAGE METAL TEMP
0755: C
0756:         DO 01801 I = 1,NUMLAYRS
0757:         TP(I) = TICM
0758:         T(I) = TICM
0759: 01801 CONTINUE
0760:         GO TO 01105
0761:         END

  PROGRAM SIZE: 0820     DATA POOL SIZE: 0522     ERROR COUNT:  0000
0463:       1     EXCOTRLM        ,LPGLSHLM        ,LPGLSLLM        ,HPGSEWLM        ,
0464:       1     LPEXALIM        ,LPEXTRLM        ,H2PRMAX         ,H2PRMIN         ,
0465:       1     RATECOR         ,RPTRIP1         ,RPALRM1         ,IPSTMLIM
0466:        DIMENSION
0467:       1     RATCRICM(1)
0468:        EQUIVALENCE
0469:       1     (  RATCRICM(1) , CLDDIFLM )
0470: C
0471:         COMMON /MWCRTBF/MWCRTBF1,MWCRTBF2,MWCRTBUF(5,9)
0472: C
0473: C
0474: C
0475: C
0476: C
0477: C       P04 INTERNAL VARIABLES
0478:         REAL TIMP,TINCR,TDECR,C11,LPRES,MWINCR,MWDECR,M1,M2,M3,LBRATD,
0479:       1      LRPRES,CONST,TR1,TRATD,TBP,TR2
0480:         REAL  TIMP,TIMPT(10,2)
0481:         LOGICAL  FLAG,  SAMERATE
0482:         LOGICAL MES04(2)
0483:            EQUIVALENCE(MES04(01),MES(41))
0484:         INTEGER  I
0485: C       INITIALIZED CONSTANTS
0486: C       C10, C11,M1,M2,M3
0487:         DATA C11/.152E-5/
0488:         DATA  M1/1.0526/
0489:         DATA M2/2.5/
0490:         DATA M3/1.4665/
0491: C
0492: C       CLEAR THE FOLLOWING INDICATORS:
0493: C
0494: C                  ROTOR STRESS HOLD
0495: C                  ROTOR STRESS REDUCE RATE
0496: C                  ROTOR STRESS INCREASE RATE
0497: C                  FIRST STAGE TEMPERATURE HOLD
0498: C                  REMAIN SAME RATE
0499:         FLAG = .FALSE.
0500:         RTSTHOLD = .FALSE.
0501:         RSREDRAT = .FALSE.
0502:         RSINCRAT = .FALSE.
0503:         TIMPHOLD = .FALSE.
0504:         SAMERATE = .FALSE.
0505:         HPALM50P =.5*HPTDIFLM
0506:         HPALM75P =.75*HPTDIFLM
0507:         HPALM85P =.85*HPTDIFLM
0508:         HPALM90P =.90*HPTDIFLM
0509:         IPALM50P =.50*IPTDIFLM
```

```
0510:          IPALM75P =.75*IPTDIFLM
0511:          IPALM85P =.85*IPTDIFLM
0512:          IPALM90P =.90*IPTDIFLM
0513: C
0514: C        IS TURBINE LATCHED ?
0515: C
0516:          IF(.NOT. ASL  )RETURN
0517: C
0518: C        IS TURBINE ON TURNING GEAR ?
0519: C
0520:          IF(TURBONTG)RETURN
0521: C
0522: C        IS HP STRESS INVALID OR IP STRESS INVALID INDICATOR SET ?
0523: C
0524:          IF(HPSTINV .OR. IPSTINV) GO TO 04300
0525: C
0526: C        SET TEMP1,2,3,AND 4 EQUAL TO HP VALUES
0527: C
0528:          TEMP1 = ABS(TDIF)
0529:          TEMP2 = ABS(ATDIF)
0530:          TEMP3 = HPTDIFLM
0531:          TEMP4 = TDIF
0532:          TEMP5 = HPALM90P
0533:          TEMP6 = HPALM75P
0534:          TEMP7 = HPALM50P
0535:          TEMP8 = HPALM85P
0536: C
0537: C        IS MAIN BREAKER CLOSED ?
0538: C
0539: 04100 IF(MGB) GO TO 04200
0540: C
0541: C        IS ABSOLUTE VALUE OF PRES HP/IP ROTOR(SURFACE-VOLUME AVG) TEMP
0542: C        GE LIMIT VALUE ?
0543: C
0544: 04110 IF(RGE:(TEMP1,TEMP3)) GO TO 04500
0545: C
0546: C        IS ABSOLUTE VALUE OF ANTIC HP/IP    ROTOR(SURFACE-VOLUME AVG) TEMP
0547: C        GE LIMIT VALUE ?
0548: C
0549:          IF(RGE:(TEMP2,TEMP3)) GO TO 04560
0550: C
0551: C        IS ABSOLUTE VALUE OF ANTIC HP/IP    ROTOR(SURFACE-VOLUME AV ) TEMP
0552: C        GE 75% OF LIMIT VALUE ?
0553: C
0554:          IF(RGE:(TEMP2,TEMP6    )) GO TO 04565
0555: C
0556: C        IS ABSOLUTE VALUE OF ANTIC HP/IP    ROTOR(SURFACE-VOLUME AVG) TEMP
0557: C        GE 50% OF LIMIT VALUE ?
0558: C
0559:          IF(RGE:(TEMP2,TEMP7    )) GO TO 04570
0560: C
0561: C        IS ABSOLUTE VALUE OF PRES HP/IP ROTOR(SURFACE-VOLUME AVG) TEMP
0562: C        GE 90% OF LIMIT VALUE ?
0563: C
0564: 04120 IF(RGE:(TEMP1,TEMP5    )) GO TO 04570
0565: C
0566: C        SET"ROTOR STRESS INCREASE RATE"INDICATOR
0567: C
0568:          RSINCRAT = (.NOT. SAMERATE)
0569: C
0570: C        IS"ROTOR STRESS HOLD"INDICATOR SET ?
0571: C
0572: 04550 IF(RTSTHOLD)GO TO 04600
0573:          IF(FLAG) GO TO 04600
0574:          TEMP1 = ABS(IPTDIF)
0575:          TEMP2 = ABS(IPATDIF)
0576:          TEMP3 = IPTDIFLM
0577:          TEMP4 = IPTDIF
0578:          TEMP5 = IPALM90P
0579:          TEMP6 = IPALM75P
0580:          TEMP7 = IPALM50P
0581:          TEMP8 = IPALM85P
0582:          FLAG = .TRUE.
0583:          GO TO 04100
```

```
0584: C
0585: C       CALCULATE ALLOWABLE 1ST STAGE STEAM AT PRESENT HP ROTOR STRESS
0586: C       MARGIN,  CALCULATION FOR A ROTOR WITH SIDE-ENTRY GROOVES,
0587: C
0588: 04600 IF(MGB) GO TO 04650
0589: 04601 MWINCR = 0.
0590:       MWDECR = 0.
0591:       RETURN
0592: 04650 TIMP = AMAX1(TIMP1,TIMP2)
0593:       TINCR = TAVG + C11*WS**2 + HPTDIFLM
0594:       TDECR = TAVG + C11*WS**2 - HPTDIFLM
0595:       LPRES =(REFDMD/RATELD) * 100.
0596: C
0597: C       CALCULATE ALLOWABLE LOAD CHANGE AT HP ROTOR STRESS MARGIN
0598: C
0599:       IF(SEQ) GO TO 04400
0600:       MWINCR=((TINCR - TIMP)/M1) * RATELD
0601:       MWDECR = ((TIMP - TDECR)/M1)*RATELD
0602:       IF(RLT:(MWINCR,0.)) MWINCR = 0.
0603:       IF(RLT:(MWDECR,0.)) MWDECR = 0.
0604:       RETURN
0605: 04400 CONST = M3
0606:       IF(RGT:(LPRES,LBRATD)) CONST = M2
0607:       TR1 = TRATD +(ABS(LPRES - LBRATD)) * CONST
0608:       LBPRES = LBRATD *(1. -(TR1 - TIMP)/TR1)
0609:       CONST = M3
0610:       IF(RGT:(LPRES,LBRATD)) CONST = M2
0611:       TR2 = TRATD - (LBRATD - LBPRES)* CONST
0612:       TBP = TR2 - (TR1 - TIMP)
0613:       IF(RLT:(TBP,TINCR) .AND. RGT:(TBP,TDECR)) GO TO 04450
0614:       CONST = M2
0615:       IF(RLE:(TINCR,TBP)) CONST = M3
0616:       MWINCR=((TINCR - TIMP)/CONST)*RATELD
0617:       MWDECR=((TIMP - TDECR)/CONST)*RATELD
0618:       RETURN
0619: 04450 MWINCR =((TINCR - TIMP)/M2)*RATELD
0620:       MWDECR =((TIMP - TBP)/M2  + (TBP - TDECR)/M3) * RATELD
0621:       IF(.NOT. RLT:(TIMP,TBP)) RETURN
0622:       RTEMP = MWINCR
0623:       MWINCR = MWDECR
0624:       MWDECR = RTEMP
0625:       RETURN
0626: C       HAVE PERIODICS BEEN RUNNING FOR 5 MINUTES OR MORE ?
0627: C
0628: 04300 IF(HPICOL .LE. 300) GO TO 04900
0629: C
0630: C       IS FIRST STAGE STEAM TEMP RATE OF CHANGE GE 300F PER HOUR ?
0631: C
0632:       I = I+1
0633:       IF(I .GE. 11) I=1
0634:       TIMPT(I,1) = TIMP1
0635:       TIMPT(I,2) = TIMP2
0636:       TEMP1 = TIMPT(I,1) - TIMP1
0637:       TEMP2 = TIMPT(I,2) - TIMP2
0638:       TIMPCRAT = AMAX1(TEMP1,TEMP2)
0639:       IF(RLT:(TIMPCRAT,TCRATLIM)) GO TO 04900
0640: C
0641: C       IS SPEED GREATER THAN 600 RPM ?
0642: C
0643:       IF(RLE:( WS  ,600.))GO TO 04900
0644: C
0645: C       IS SPEED LESS THAN 3200 RPM ?
0646: C
0647:       IF(RGE:( WS  ,3200.))GO TO 04800
0648:       MES04(02)= .TRUE.
0649:       INSERT(11) = TIMPCRAT
0650:       GO TO 04701
0651: C
0652: C       IS MAIN BREAKER CLOSED ?
0653: C
0654: 04800 IF(MGB) GO TO 04700
0655: 04900 MES04(01)= .FALSE.
0656:       MES04(02)= .FALSE.
0657:       GO TO 04601
```

```
0658: 04700 MES04(01)= .TRUE.
0659: 04701 TTMPHOLD = .TRUE.
0660:       GO TO 04601
0661: C
0662: C     IS LOAD INCREASING ?
0663: C
0664: 04200 IF(RLE:(ODMD,REFDMD  ))GO TO 04210
0665: C
0666: C     LOAD DECREASING;IS HP/IP  ROTOR COOLING ?
0667: C
0668:       IF(RLT:(TEMP4,0.)) GO TO 04110
0669:       GO TO 04120
0670: C
0671: C     LOAD INCREASING;IS HP/IP ROTOR HEATING ?
0672: C
0673: 04210 IF(RGT:(TEMP4,0.)) GO TO 04110
0674:       GO TO 04120
0675: 04500 RTSTHOLD = .TRUE.
0676:       GO TO 04550
0677: C
0678: C     IS ABSOLUTE VALUE OF PRESENT HP/IP ROTOR(SURFACE-VOLUME AVG) TEMP
0679: C     GE 85% OF LIMIT VALUE ?
0680: C
0681: 04560 IF(RGT:(TEMP1,TEMP8    )) GO TO 04500
0682: 04565 RSREDRAT = .TRUE.
0683:       GO TO 04550
0684: C
0685: C     IF HP SET SAME RATE INDICATOR; IF IP RESET ROTOR STRESS INC. IND.
0686: C
0687: 04570 IF(FLAG) GO TO 04575
0688:       SAMERATE = .TRUE.
0689:       GO TO 04550
0690: C
0691: C     SET ROTOR STRESS INCREASE RATE INDICATOR
0692: C
0693: 04575 RSINCRAT = .FALSE.
0694:       GO TO 04550
0695:       END

  PROGRAM SIZE: 0634    DATA POOL SIZE: 0159    ERROR COUNT:  0000
0463:      1     EXCOTRLM       ,LPGLSHLM       ,LPGLSLLM       ,HPGSEWLM       ,
0464:      1     LPEXALIM       ,LPEXTRLM       ,H2PRMAX        ,H2PRMIN        ,
0465:      1     RATECUR        ,RPTRIP1        ,RPALRM1        ,IPSTMLIM
0466:       DIMENSION
0467:      1     RATCRICM(1)
0468:       EQUIVALENCE
0469:      1     (  RATCRICM(1) , CLDDIFLM )
0470: C
0471:       COMMON /MWCRTBF/MWCRTBF1,MWCRTBF2,MWCRTBUF(5,9)
0472: C
0473: C
0474: C
0475: C
0476: C
0477: C     P07 INTERNAL VARIABLES
0478:       REAL  ACCRATE(10),LRATE(10)
0479:       INTEGER  ALRMREG,CT3MININ,CT3MINRD,I,TRIPREG,TRIPPATT,ALRMPATT
0480:       LOGICAL  RTGTDEM, FIRSTIME,HOLDLDX,HOLDWSX,TURBTRIP
0481:       LOGICAL MES07(14)
0482:          EQUIVALENCE(MES07(01),MES(92))
0483: C     INITIALIZE THE FOLLOWING P07 INTERNAL VARIABLES USING DATA STATEMENTS
0484: C     ALRMREG,ACCRATE(10),LRATE(10),
0485:       DATA ACCRATE/50., 100., 150., 200., 250.,
0486:      1             300., 350., 400., 450., 500./
0487:       DATA LRATE/1.72,  3.43, 5.15,  6.87,  8.58,
0488:      1           10.30, 12.01, 13.73, 15.45, 17.16/
0489:       DATA ALRMREG,TRIPREG/3,3/
0490:       DATA ALRMPATT,TRIPPATT/20,40/
0491: C
0492: C     CLEAR ALL PER7 MESSAGES
0493: C
0494:       MES07(01) = .FALSE.
0495:       MES07(03) = .FALSE.
0496:       MES07(04) = .FALSE.
```

```
0497:        MES07(09) = .FALSE.
0498:        MES07(10) = .FALSE.
0499:        MES07(11) = .FALSE.
0500:        MES07(12) = .FALSE.
0501:        MES07(13) = .FALSE.
0502:        MES07(14) = .FALSE.
0503:        TURBACC = .FALSE.
0504:        TURBDEC = .FALSE.
0505:        HOLDWS = .FALSE.
0506:        HOLDLOAD = .FALSE.
0507:        LDEQDMD = .FALSE.
0508: C
0509: C      IS ANY CONDITION FROM ANOTHER SUBPROGRAM REQUIRE TURBINE TRIP ?
0510: C
0511:        TURBTRIP = VIT .OR. H2OTRIP .OR.BMTTRIP.OR. DET .OR. RPOSTRIP .OR.
0512:       1            TRTRIP
0513:        MES07(01)= TURBTRIP
0514: C
0515: C      IF TURBINE TRIP REQUIRED,CLOSE ALARM CCO
0516: C
0517:        IF (FIRSTIME .EQR. TURBTRIP) CALL M:CCO(1,TURBTRIP,ALRMREG,
0518:       1   ALRMPATT)
0519: C
0520: C      IF IN ATC CONTROL AND TURBINE TRIP REQUIRED,CLOSE TRIP CCO
0521: C
0522:        IF((FIRSTIME .AND. .NOT. TURBTRIP).OR. (TURBTRIP .AND. .NOT.
0523:       1 FIRSTIME .AND. ATS     )) CALL M:CCO(1,TURBTRIP,TRIPREG,TRIPPATT)
0524:        FIRSTIME = TURBTRIP
0525:        IF(TURBTRIP)RETURN
0526: C
0527: C      IS MAIN BREAKER CLOSED ?
0528: C
0529:        IF(MGB) GO TO 07800
0530: C
0531: C      IS TURBINE BLADE ALARM INDICATOR SET ?
0532: C
0533:        IF(TBALRM) GO TO 07650
0534:        MES07(02)= .FALSE.
0535: C
0536: C      IS VIBRATION ALARM INDICATOR SET
0537: C
0538: 07670 IF(VIBRATN) GO TO 07600
0539:        MES07(03)= .FALSE.
0540: C
0541: C      DOES TURBINE CONDITION REQUIRE A SPEED HOLD ?
0542: C
0543:        MES07(10)=METHOLD .OR. RTSTHOLD .OR. TIMPHOLD .OR. HIECEN .OR.
0544:       1           H2OHOLD .OR. BMETHI   .OR. VACCFLIM .OR. DEHOLD .OR.
0545:       2           ANDEHOLD .OR. RPOSHOLD
0546: C
0547: C      DOES GENERATOR CONDITION REQUIRE A SPEED HOLD ?
0548: C
0549:        MES07(11) = COOLGSHI
0550: C
0551: C      IS OVERRIDE SENSOR HOLD PERMISSIVE SET ?
0552: C
0553:        MES07(09)= SNOVPERM
0554:        HOLDWS = MES07(09).OR. MES07(10).OR. MES07(11)
0555: C
0556: C      HAS HOLD SPEED INDICATOR CHANGED STATE
0557: C
0558:        IF(.NOT. HOLDWS) GO TO 07580
0559:        IF(HOLDWSX) GO TO 07500
0560: C
0561: C      IS ATC IN CONTROL INDICATOR SET ?
0562: C
0563:        IF(.NOT. ATS     )RETURN
0564: C
0565: C      UPDATE PREVIOUS STORED STATE OF HOLD SPEED INDICATOR
0566: C
0567:        HOLDWSX = HOLDWS
0568: C
0569: C      SET CHECK SPEED EQUAL ACTUAL SPEED
0570: C
```

```
0571:          CHKSPD = WS
0572: 07250 DO 07260 I=1,LY
0573:          IF (RGT:(CHKSPD,RPM(I)) ,AND, RLT:(CHKSPD,RPMM(I))) GO TO 07270
0574: 07260 CONTINUE
0575:          MES07(04)= ,FALSE,
0576:          GO TO 07275
0577: 07270 MES07(04)= ,TRUE,
0578:          CHKSPD = REF(I)
0579: C
0580: C        SET "RESET TARGET DEMAND" INDICATOR
0581: C
0582: 07275 RTGTDEM = ,TRUE,
0583: C
0584: C        SET STORED TARGET DEMAND EQUAL DEH DEMAND
0585: C
0586:          STGTDEM = DEHDMD
0587:          DEHDMD  = CHKSPD
0588: C
0589: C        IS MAIN BREAKER CLOSED ?
0590: C
0591: 07500 IF(MGB) GO TO 07400
0592: C
0593: C        IS DEH DEMAND WITHIN 7 RPM OF ACTUAL SPEED ?
0594: C
0595:          TEMP1 = ABS(   WS - DEHDMD)
0596:          IF(RGT:(TEMP1,7,))GO TO 07300
0597: C
0598: C        CLEAR VIBRATION SPEED REFERENCE CHANGE NOT PERMITTED
0599: C
0600:          VSRCNP = ,FALSE,
0601:          RETURN
0602: C
0603: C        IS DEH DEMAND GT ACTUAL SPEED
0604: C
0605: 07300 TURBACC = RGT:(REFDMD,WS)
0606:          TURBDEC = ,NOT, TURBACC
0607:          RETURN
0608: C
0609: C        IS ADS CONTROL INDICATOR SET ?
0610: C
0611: 07400 IF(ADS     ) GO TO 07450
0612: C
0613: C        IS OPERATOR ENTERED DEMAND EQUAL ACTUAL LOAD ?
0614: C
0615:          IF((RNE:(DEMAND,REFDMD)),OR, HOLDLOAD,OR, ,NOT, ATS) GO TO 07450
0616: C
0617: C        SET"LOAD EQUAL DEMAN" INDICATOR ;RESET HI LOADING RATE INDICATOR
0618: C
0619:          LDEQDMD = ,TRUE,
0620:          HILORAT = ,FALSE,
0621:          RETURN
0622: 07450 LDEQDMD = ,FALSE,
0623:          RETURN
0624: C
0625: C        SET CHECK SPEED EQUAL VIBRATION SPEED REFERENCE
0626: C
0627: 07600 MES07(03)= ,TRUE,
0628:          CHKSPD = VIBSPDRF
0629:          GO TO 07250
0630: C
0631: C        IS TURBINE BLADE RUNBACK INDICATOR SET ?
0632: C
0633: 07650 IF(,NOT, TRRB) GO TO 07670
0634:          MES07(02)= ,TRUE,
0635: C
0636: C        IS ATC IN CONTROL INDICATOR SET ?
0637: C
0638:          IF(,NOT, ATS     ) GO TO 07670
0639:          TBRB = ,FALSE,
0640: C
0641: C        SET" RESET TARGET DEMAND" INDICATOR
0642: C
0643:          RTGTDEM = ,TRUE,
0644: C
```

```
0645: C      SET STORED TARGET DEMAND EQUAL DEH DEMAND
0646: C
0647:        STGTDEM = DEHDMD
0648: C
0649: C      SET DEH DMEAND EQUAL TRUBINE BLADE SPEED REFERENCE
0650: C
0651:        DEHDMD = TBSPDREF
0652:        GO TO 07500
0653: C
0654: C      CLEAR HOLD LOAD INDICATOR
0655: C
0656: C
0657: C      DOES ANY TURBINE CONDITION REQUIRE A LOAD HOLD ?
0658: C
0659: 07600 MES07(13)=METHOLD ,OR, RTSTHOLD ,OR, TIMPHOLD ,OR, HIECEN ,OR,
0660:       1          H2OHOLD ,OR, RMETHI   ,OR, VACOFLIM  ,OR, DEHOLD ,OR,
0661:       1          ANDEHOLD ,OR, RPOSHOLD ,OR,VIBRATN
0662: C
0663: C      DOES A GENERATOR CONDITION REQUIRE A LOAD HOLD ?
0664: C
0665:        MES07(14)=COOLGSHI ,OR, H2FAULT ,OR, GRCEXC  ,OR, GENANUN ,OR,
0666:       1          EXCMON  ,OR, GUFCEXC
0667: C
0668: C      IS OVERRIDE SENSOR HOLD INDICATOR SET ?
0669: C
0670:        MES07(12)= SNOVPERM
0671: C
0672: C      IS HOLD LOAD INDICATOR SET ?
0673: C
0674:        HOLDLOAD = MES07(12),OR, MES07(13),OR, MES07(14)
0675:        IF(,NOT, HOLDLOAD) GO TO 07700
0676: C
0677: C      IS HOLD LOAD INDICATOR DIFFERENT FROM STORED PREVIOUS STATE ?
0678: C
0679:        IF(HOLDLDX) GO TO 07500
0680: C
0681: C      UPDATE STORED PREVIOUS STATE
0682: C
0683:        HOLDLDX = HOLDLOAD
0684:        RUNLOGIC = ,TRUE,
0685: C
0686: C      IS ATC IN CONTROL INDICATOR SET ?
0687: C
0688:        IF(,NOT, ATS    )RETURN
0689: C
0690: C      IS ADS IN CONTROL INDICATOR SET ?
0691: C
0692:        IF(ADS    )RETURN
0693: C
0694: C      SET STORED TARGET DEMAND EQUAL DEH DEMAND;SET "RESET TGT DEMAND"
0695: C
0696:        STGTDEM = DEHDMD
0697:        RTGTDEM = ,TRUE,
0698: C
0699: C      SET DEH DEMAND EQUAL DEH REFERENCE
0700: C
0701:        DEHDMD = REFDMD
0702:        RETURN
0703: C
0704: C      UPDATE STORED PREVIOUS STATE
0705: C
0706: 07700 HOLDLDX = HOLDLOAD
0707: C
0708: C      IS HP STRESS INVALID OR IP STRESS INVALID INDICATOR SET ?
0709: C
0710: 07750 IF(HPSTINV ,OR, IPSTINV) GO TO 07800
0711: C
0712: C      IS ROTOR STRESS REDUCE RATE INDICATOR SET ?
0713: C
0714:        IF(RSREDRAT) GO TO 07900
0715: C
0716: C      SET 3-MINUTE REDUCE TIME COUNTER EQUAL ZERO
0717: C
0718:        CT3MINRD = 0
```

```
0719: C
0720: C      IS ROTOR STRESS INCREASE RATE INDICATOR SET ?
0721: C
0722:        IF(RSINCRAT) GO TO 07950
0723: C
0724: C      SET 3-MINUTE INCREASE TIME COUNTER EQUAL ZERO
0725: C
0726:        CT3MININ = 0
0727: C
0728: C      IS MAIN BREAKER CLOSED ?
0729: C
0730: 07910 IF(.NOT. MGB) GO TO 07920
0731: C
0732: C      SET TURBINE LOADING RATE EQUAL LOADRATE(RATEINDX)
0733: C
0734:        TLRATE = LRATE(RATEINDX)
0735:        MES07(06)= .FALSE.
0736:        MES07(08)= .FALSE.
0737: C
0738: C      SET LOADRATE EQUAL MIN OF TURB AND GEN LOADING RATES
0739: C
0740:        LOADRATE = AMIN1(TLRATE,GLRATE)
0741:        GO TO 07200
0742: C
0743: C      SET ATC ACCELERATION RATE EQUAL ACC RATE(RATEINDX)
0744: C
0745: 07920 ATCARAT = ACCRATE(RATEINDX)
0746:        MES07(05)= .FALSE.
0747:        MES07(07)= .FALSE.
0748: C
0749: C      IS RESET TARGET DEMAND INDICATOR SET ?
0750: C
0751: 07200 IF(.NOT. RTGTDEM)GO TO 07500
0752: C
0753: C      CLEAR RESET TARGET DEMAND
0754: C
0755:        RTGTDEM = .FALSE.
0756: C
0757: C      SET DEH DEMAND EQUAL STORED TARGET DEMAND
0758: C
0759:        DEHDMD = STGTDEM
0760:        GO TO 07500
0761: C
0762: C      IS RATE INDEX EQUAL ONE ?
0763: C
0764: 07900 IF(RATEINDX .EQ. 1) GO TO 07200
0765: C
0766: C      IS 3-MINUTE REDUCE TIME COUNTER LT 180 SECONDS ?
0767: C
0768:        IF(CT3MINRD .LT. 180) GO TO 07980
0769: C
0770: C      SET 3-MINUTE REDUCE TIME COUNTER EQUAL ZERO
0771: C
0772:        CT3MINRD = 0
0773: C
0774: C      REDUCE RATE INDEX BY 1
0775: C
0776:        RATEINDX = RATEINDX-1
0777:        IF(RATEINDX .LT. 1) RATEINDX =1
0778:        MES07(05)= .TRUE.
0779:        MES07(06)= .TRUE.
0780:        GO TO 07910
0781: C
0782: C      INCREMENT 3-MINUTE REDUCE TIME COUNTER BY 1 SECOND
0783: C
0784: 07980 CT3MINRD = CT3MINRD +1
0785:        GO TO 07200
0786: C
0787: C      IS RATE INDEX EQUAL 10 ?
0788: C
0789: 07950 IF(RATEINDX .EQ. 10) GO TO 07200
0790: C
0791: C      IS 3-MINUTE INCREASE TIME COUNTER LT 180 SECONDS ?
0792: C
```

```
0793:        IF(CT3MININ .LT. 180) GO TO 07990
0794: C
0795: C      SET 3-MINUTE INCREASE TIME COUNTER EQUAL ZERO
0796: C
0797:        CT3MININ = 0
0798: C
0799: C      INCREASE RATE INDEX BY 1
0800: C
0801:        RATEINDX = RATEINDX + 1
0802:        IF(RATEINDX .GT. 10) RATEINDX = 10
0803:        MES07(07)= .TRUE.
0804:        MES07(08)= .TRUE.
0805:        GO TO 07910
0806: C
0807: C      INCREMENT 3-MINUTE INCREASE TIME COUNTER BY 1 SECOND
0808: C
0809: 07990 CT3MININ = CT3MININ +1
0810:        GO TO 07200
0811: C
0812: C      UPDATE STORED PREVIOUS STATE OF HOLD SPEED INDICATOR
0813: C
0814: 07580 HOLDWSX = HOLDWS
0815:        GO TO 07750
0816:        END

  PROGRAM SIZE: 0593    DATA POOL SIZE: 0095    ERROR COUNT:  0000
0463:       1    EXCOTRLM       ,LPGLSHLM       ,LPGLSLLM       ,HPGSEWLM       ,
0464:       1    LPEXALIM       ,LPEXTRLM       ,H2PRMAX        ,H2PRMIN        ,
0465:       1    RATECUR        ,RPTRIP1        ,RPALRM1        ,IPSTMLIM
0466:        DIMENSION
0467:       1    RATCRICM(1)
0468:        EQUIVALENCE
0469:       1    (  RATCRICM(1) , CLODIFLM )
0470: C
0471:        COMMON /MWCRTBF/MWCRTBF1,MWCRTBF2,MWCRTBUF(5,9)
0472: C
0473: C
0474: C
0475: C
0476: C
0477: C      P09 INTERNAL VARIABLES
0478:        LOGICAL CCI(27),STH2OP1X,STH2OP2X,POWFLAG,CCCI(30)
0479:        LOGICAL MES09(49)
0480:         EQUIVALENCE(MES09(01),MES(136))
0481:        EQUIVALENCE(CCI(1),H2PRLO),(CCCI(22),MAXEXLIM)
0482:        REAL   DIST,  PFL(4),  PRCHKPT(4),
0483:       1       P9VAR1,P9VAR2,P9VAR3,P9VAR4,P9VAR5,P9VAR6,R(3,4),
0484:       1              XP9(3,4),   YP9(3,4)
0485: C      INITIALIZE THE FOLLOWING P09 INTERNAL VARIABLES USING DATA STATEMENTS
0486: C                     ,PFL,PRCHKPT(4),P9VAR1,P9VAR2,P9VAR3,P9VAR4,P9VAR5,
0487: C      P9VAR6,R(3,4)
0488:        DATA P9VAR1, P9VAR2, P9VAR3, P9VAR4, P9VAR5, P9VAR6
0489:       1    /50.   , 74.7  , 14.7  , 55.   , 60.   , 15./
0490:        DATA PFL/ .935.  ,.915.  ,.90.  ,.0/
0491:        DATA PRCHKPT/ 29.,  44.,  59.,  65./
0492:        DATA XP9/ 0.   ,0.   ,0.   ,0.   ,
0493:       1        1.81 ,2.11 ,2.36 ,0.   ,
0494:       1        79.5 ,106.63, 134. , 0./
0495:        DATA YP9/ 0.    ,0.     ,0.     ,0.     ,
0496:       1       -316.53,-343.39,-372.78,0.      ,
0497:       1       87.95  , 117.43, 149.58,0./
0498:        DATA R/ 320.  , 360.  ,400.   ,0.     ,
0499:       1        522.84, 588.12,653.66 ,0.     ,
0500:       1        292.74, 328.97,368.58 ,0./
0501: C
0502: C      CLEAR"COOLING GAS TEMP HIGH" AND "FAULTY H2 SYSTEM" INDICATORS
0503: C
0504:        COOLGSHI = .FALSE.
0505:        H2FAULT = .FALSE.
0506: C
0507: C      IS H2 COOLER DISCHARGE TEMP LT 48 C ?
0508: C
0509:        H2COOLH =AMAX1(H2COOL1,H2COOL2,H2COOL3,H2COOL4)
0510:        INSERT(31) = H2COOLH
```

```
0511:        MES09(01)= RGE:(H2COOLH,H2COOLHL)
0512: C
0513: C      IS ANY H2 COOLER DISCHARGE TEMP GT 25 C ?
0514: C
0515:        H2COOLL=AMIN1(H2COOL1,H2COOL2,H2COOL3,H2COOL4)
0516:        INSERT(32) = H2COOLL
0517:        MES09(02)= RLT:(H2COOLL,H2COOLLL)
0518: C
0519: C      IS (HIGHEST - LOWEST) GENERATOR STATOR COIL GAS TEMP LT 8 C ?
0520: C
0521:        HGTEMPH =AMAX1(HGTMP1,HGTMP2,HGTMP3,HGTMP4,HGTMP5,HGTMP6,HGTMP7,
0522:       1               HGTMP8,HGTMP9,HGTMPA,HGTMPB,HGTMPC)
0523:        HGTEMPL =AMIN1(HGTMP1,HGTMP2,HGTMP3,HGTMP4,HGTMP5,HGTMP6,HGTMP7,
0524:       1               HGTMP8,HGTMP9,HGTMPA,HGTMPB,HGTMPC)
0525:        STATDIF  = HGTEMPH - HGTEMPL
0526:        MES09(06) = RGE:(STATDIF ,8.)
0527: C
0528: C      IS H2 PRESSURE LT MAXIMUM LIMIT ?
0529: C
0530:        MES09(11) =(H2PRESS ,GE, H2PRMAX)
0531:        INSERT(40) = H2PRESS
0532: C
0533: C      IS H2 PRESSURE GT MINIMUM LIMIT ?
0534: C
0535:        MES09(12)= (H2PRESS ,LE, H2PRMIN)
0536: C
0537: C      IS H2 PURITY GT 90%
0538: C
0539:        MES09(15)=  RLT:(H2PUR,H2PURLL)
0540:        MES09(19)= (RLT:(H2PUR,90.) ,AND, ,NOT, MES09(15))
0541:        INSERT(41) = H2PUR
0542: C
0543: C      IS H2 SIDE SEAL OIL TEMP BETWEEN 80 F AND 120 F
0544: C
0545:        MES09(16)=(RLT:(H2SSOTMP,SOTLALIM ) ,OR, RGT:(H2SSOTMP,SOTHALIM))
0546:        INSERT(42) = H2SSOTMP
0547: C
0548: C      IS AIR SIDE SEAL OIL TEMP BETWEEN 80 F AND 120 F
0549: C
0550:        MES09(17)= (RLT:(SOATMP,80.) ,OR, RGT:(SOATMP,120.))
0551:        INSERT(43) = SOATMP
0552: C
0553: C      IS SEAL OIL MINUS H2 PRESSURE DIFFERENCE GT 4 PSIG ?
0554: C
0555:        MES09(18)= RLT:(H2SODIFP,4.)
0556: C
0557: C      CLEAR GENERATOR ANNUCIATOR INDICATOR
0558: C
0559:        GENANUN = .FALSE.
0560: C
0561: C      IS ANY CONTACT TO GENERATOR ANNUNCIATOR CLOSED ?
0562: C      CCI'S MUST BE ARRANGED SEQUENTIALLY ACCORDING TO MESSAGE NUMBERS
0563: C
0564:        DO 09200 I = 1,21
0565:        MES09(I+26)= CCI(I)
0566:        GENANUN = GENANUN .OR. CCI(I)
0567: 09200  CONTINUE
0568: C
0569: C      ARE BOTH #1 AND #2 STATOR WATER PUMPS OFF ?
0570: C
0571:        MES09(48)=       (STH2OP1 ,AND, STH2OP2)
0572:        IF(MES09(48))GO TO 09250
0573: C
0574: C      IS EITHER #1 OR #2 STATOR WATER PUMP STATUS DIFF FROM PREVIOUS
0575: C
0576:        IF(      ((STH2OP1 ,EOR, STH2OP1X),OR,(STH2OP2 ,EOR,STH2OP2X)))
0577:       1   GO TO 09255
0578: C
0579: C      IS STATOR COOLING WATER INLET TEMP BETWEEN 25C AND 60C ?
0580: C
0581: 09275  MES09(03)= (RLT:(STCINH2O,25.),OR, RGT:(STCINH2O,60.))
0582:        INSERT(33) = STCINH2O
0583: C
0584: C      IS(OUTLET - INLET) STATOR COOLING WATER TEMP DIFF GT 31C ?
```

```
0585: C
0586:        TEMP1     = STCOTH20  - STCINH20
0587:        INSERT(34) = TEMP1
0588:        MES09(04)= RGT1(TEMP1,31,)
0589: C
0590: C      IS EXCITER COOLER #1 AND #2 AIR OUT  LT 52 C ?
0591: C
0592:        INSERT(36) = EXCOOLO1
0593:        INSERT(37) = EXCOOLO2
0594:        MES09(07)= RGE1(EXCOOLO1,EXCOALIM)
0595:        MES09(08)= RGE1(EXCOOLO2,EXCOALIM)
0596: C
0597: C      IS(IN - OUT) EXCITER COOLER #1 AND #2 AIR TEMP DIFFERENCE LT 27 C?
0598: C
0599:        TEMP1 = EXCOOLI1 - EXCOOLO1
0600:        TEMP2 = EXCOOLI2 -EXCOOLO2
0601:        MES09(09)= RGE1(TEMP1,EXCOTRLM)
0602:        MES09(10)= RGE1(TEMP2,EXCOTRLM)
0603:        INSERT(38) = TEMP1
0604:        INSERT(39) = TEMP2
0605: C
0606: C      CLEAR"EXCITER MONITOR" INDICATOR
0607: C
0608:        EXCMON = .FALSE.
0609: C
0610: C      IS ANY MONITORING CONTACT TO EXCITER CONTROLLER CLOSED ?
0611: C      CCI'S MUST BE ARRANGED SEQUENTIALLY
0612: C
0613:        DO 09300  I = 22,26
0614:        MES09(I)  = CCCI(I)
0615:        EXCMON = EXCMON .OR.CCCI(I)
0616: 09300 CONTINUE
0617:        H2FAULT = MES09(11) .OR. MES09(12) .OR. MES09(15) .OR. MES09(18)
0618:        COOLGSHI = MES09(01) .OR. MES09(07) .OR. MES09(08)
0619: C
0620: C      IS MAIN BREAKER CLOSED ?
0621: C
0622:        IF(.NOT. MGB) RETURN
0623: C
0624: C      CALCULATE EXPECTED AND LIMIT OF GENERATOR STATOR COIL DISCHARGE
0625: C      GAS OR H20 TEMP RISE
0626: C
0627:        EXPECT  =  P9VAR1 *(P9VAR2/P9VAR3 + H2PRESS) *(RATECUR/STATCUR)**2
0628:        LIMIT   =  P9VAR4 +((P9VAR5 - H2PRESS)/P9VAR6)
0629: C
0630: C      THE ABOVE EQUATIONS CAN BE USED(BY INITIALIZING DATA STATEMENTS)
0631: C      FOR ALL TYPES OF GENERATORS EXCEPT THE TYPE WITH WATER COOLED
0632: C      STATOR COILS.
0633: C      IS GENERATOR STATOR COIL GAS TEMP - H2 COOLER DISCHARGE TEMP  LT
0634: C      CALCULATED EXPECTED RISE AND CALCULATED RISE LIMIT ?
0635: C
0636:        TEMP1 = HGTEMPH - H2COOLL
0637:        INSERT(35) = TEMP1
0638:        MES09(05)= RGE1(TEMP1,LIMIT)
0639:        MES09(20)= RGE1(TEMP1,EXPECT)
0640: C
0641: C      CLEAR "GEN REACTIVE CAPABILITY EXCEEDED","UNDER FREQUENCY CAPACITY
0642: C      EXCEEDED" INDICATORS
0643: C
0644:        GRCEXC = .FALSE.
0645:        GUFCEXC= .FALSE.
0646: C
0647: C      CALCULATE MVA, POWER FACTOR, AND ALLOWABLE MVA AT PRESENT FREQ
0648: C
0649:        MVA = SQRT(MVAR**2 + MW**2)
0650:        PF = MW/MVA
0651:        MAXMVA = RMMVA *(1.- .0004167 * (WR - WS))
0652: C
0653: C      IS PRESENT MVA LT ALLOWABLE MAX MVA ?
0654: C
0655:        MES09(14) =  RGT1(MVA,MAXMVA)
0656:        GUFCEXC= MES09(14)
0657: C
0658: C      IS H2 PRESSURE WITHIN OPERATION LIMITS ?
```

```
C
      IF(MES09(11),OR, MES09(12)) RETURN
C
C     SELECT APPROPRIATE GEN CAPABILITY CURVE SET BASED ON PRESENT H2 PRES
C
      DO 09400 I = 1,4
      IF(RGE:(H2PRESS,PRCHKPT(I)),AND, RLE:(H2PRESS,PRCHKPT(I+1)))N = I
09400 CONTINUE
      J = 1
C
C     IS POWER FACTOR LAGGING AND ROTOR WINDING LIMITING
C
      POWFLAG = RGT:(MVAR,0.)
      IF(POWFLAG ,AND, RLE:(PF,PFL(N)))J = 2
C
C     IS POWER FACTOR LEADING AND POWER FACTOR LT .95 ?
C
      IF(.NOT. POWFLAG ,AND, RLT:(PF,.95)) J = 3
C
C     CALCULATE DISTANCE BETWEEN GEN OPERATING POINT TO CIRCULAR ARC
C     CENTER OF SELECTED LIMITING REGION
C
      DIST = SQRT((MW - XP9(N,J))**2 + (MVAR + ABS(YP9(N,J)))**2)
C
C     IS SELECTED REGION RADIUS GT CALCULATED DISTANCE
C
      INSERT(44) = H2PUR
      MES09(21)= RLE:(R(N,J),DIST)
      GRCEXC = MES09(21)
      RETURN
C
C     UPDATE PREVIOUS STATES OF BOTH #1 AND #2 STATOR WATER PUMPS
C
09250 GENANUN = .TRUE.
09255 STH2OP1X = STH2OP1
      STH2OP2X = STH2OP2
      MES09(13)= .TRUE.
      GO TO 09275
      END

  PROGRAM SIZE: 0653    DATA POOL SIZE: 0219    ERROR COUNT:  0000
      1     EXCOTRLM      ,LPGLSHLM      ,LPGLSILM      ,HPGSFWLM      ,
      1     LPEVALIM      ,LPEXTRLM      ,H2PRMAX       ,H2PRMIN       ,
      1     RATECUR       ,PPTRTP1       ,RPALRM1       ,TPSTMLIM
      DIMENSION
      1     RATCRTCM(1)
      EQUIVALENCE
      1     (  RATCRTCM(1) , CLDDTFLM )
C
      COMMON /MWCRTBF/MWCRTBF1,MWCRTBF2,MWCRTBUF(5,9)
C
C
C
C
C
C     P14 INTERNAL VARIABLES
      REAL  IPRTBORI,SOAKSPD
      INTEGER  CT10MIN,CT10MINA,CT10MINB,CT10MINC
      LOGICAL  SOAKFLAG
      LOGICAL MES14(7)
         EQUIVALENCE(MES14(01),MES(212))
C     INITIALIZE THE FOLLOWING P14 INTERNAL VARIABLES USING DATA STATEMENTS
C     SOAKSPD
      INSERT(53) = IPROTBOR
C
C     IS"HEAT SOAK COMPLETE" INDICATOR SET ?
C
      IF(SOAKDUN) RETURN
C
C     IS"TP STRESS INVALID" INDICATOR SET ?
C
      IF(TPSTINV) GO TO 14900
C
C     IS"HEAT SOAK IN PROGRESS" INDICATOR SET ?
```

```
0496: C
0497:        IF(.NOT. SOAKFLAG) GO TO 14200
0498: C
0499: C      IS (IP ROTOR BORE TEMP + MARGIN #1) GT 250F
0500: C
0501: 14250 TEMP1 = IPROTBOR + MARGIN1
0502:        IF(RLF:(TEMP1,250.)) GO TO 14300
0503:        MFS14(01) = .FALSE.
0504: C
0505: C      IS"IP METAL TEMP SENSOR FAIL" INDICATOR SET
0506: C
0507:        IF(IPMTFAIL) GO TO 14700
0508:        MFS14(05) = .FALSE.
0509: C
0510: C      IS IP BLADE RING METAL TEMP GT (250F + MARGIN #2)
0511: C
0512:        TEMP1 = 250. +MARGIN2
0513:        IF(RLF:(IPBRT,TEMP1)) GO TO 14600
0514:        MFS14(08) = .TRUE.
0515:        MFS14(09) = .TRUE.
0516: C
0517: C      SET"HEAT SOAK COMPLETE"INDICATOR
0518: C
0519: 14500 SOAKDUN = .TRUE.
0520: C
0521: C      CLEAR"HEAT SOAK IN PROGRESS"IND.
0522: C
0523:        SOAKFLAG = .FALSE.
0524:        RETURN
0525: C
0526: C      IS REMAINING SOAK TIME GT 0 ?
0527: C
0528: 14600 IF(SOAKTIME .GT. 0) GO TO 14640
0529: C
0530: C      IS 10-MINUTE COUNTERC LT 10 MINUTES ?
0531: C
0532:        IF(CT10MINC .LT. 10) GO TO 14620
0533: C
0534: C      SET 10-MINUTE COUNTERC = 0
0535: C
0536:        CT10MINC = 0
0537:        INSERT(54) = IPBRT
0538:        MFS14(04) = .TRUE.
0539:        RETURN
0540: C
0541: C      INCREMENT 10-MINUTE COUNTERC BY 1 MINUTE
0542: C
0543: 14620 CT10MINC = CT10MINC + 1
0544:        RETURN
0545: C
0546: C      DECREMENT REMAINING HEAT SOAK TIME BY 1 MINUTE
0547: C
0548: 14640 SOAKTIME = SOAKTIME - 1
0549:        RETURN
0550: C
0551: C      IS"ATC IN CONTROL"INDICATOR SET ?
0552: C
0553: 14700 IF(.NOT. ATS   ) GO TO 14740
0554:        MFS14(05) = .TRUE.
0555:        MFS14(06) = .TRUE.
0556: C
0557: C      HAS"OVERRIDE"PUSHBUTTON BEEN PUSHED ?
0558: C
0559:        IF(OVRIDPB) GO TO 14720
0560:        OVRIDIND = .TRUE.
0561:        RETURN
0562: 14720 MFS14(07) = .TRUE.
0563: C
0564: C      CLEAR"OVERRIDE"PUSHBUTTON INDICATOR
0565: C
0566: 14740 OVRIDIND = .FALSE.
0567:        GO TO 14500
0568: 14300 MFS14(01) = .TRUE.
0569: C
```

```
0570: C       IS"HEAT SOAK RETIMED" INDICATOR SET ?
0571: C
0572:         IF(SOAKRET) GO TO 14320
0573: C
0574: C       IS 10-MINUTE COUNTERA = 0 ?
0575: C
0576:         IF(CT10MINA .EQ. 0) GO TO 14800
0577: C
0578: C       INCREMENT 10-MINUTE COUNTERA BY ONE MINUTE
0579: C
0580:         CT10MINA = CT10MINA +1
0581: C
0582: C       IS 10-MINUTE COUNTERA LT 10 MINUTES ?
0583: C
0584:         IF(CT10MINA .LT. 10) RETURN
0585: C
0586: C       ESTIMATE REQUIRED HEAT SOAK TIME BASED ON STORED AND PRESENT IP
0587: C       ROTOR BORE TEMPS
0588: C
0589:         SOAKTIME=((250. + MARGIN1 - IPROTBOR)/(IPROTBOR - IPRTBORL))* 10.
0590:         INSERT(59) = SOAKTIME
0591:         MFS14(02) = .TRUE.
0592: C
0593: C       SET"HEAT SOAK RETIMED" INDICATOR
0594: C
0595:         SOAKRET = .TRUE.
0596: C
0597: C       SET 10-MINUTE COUNTERB & COUNTERC EQUAL 10
0598: C
0599:         CT10MINB = 10
0600:         CT10MINC = 10
0601:         RETURN
0602: C
0603: C       IS REMAINING HEAT SOAK TIME GT 0 ?
0604: C
0605: 14320 IF(SOAKTIME .GT. 0) GO TO 14330
0606: C       IS 10-MINUTE COUNTERB LT 10 MINUTES ?
0607:         IF(CT10MINB .LT. 10)GO TO 14360
0608: C
0609: C       SET 10-MINUTE COUNTERB EQUAL 0 ?
0610: C
0611:         CT10MINB = 0
0612:         MFS14(03) = .TRUE.
0613:         RETURN
0614: C
0615: C       DECREMENT REMAINING HEAT SOAK TIME BY 1 MINUTE
0616: C
0617: 14330 SOAKTIME = SOAKTIME - 1
0618:         RETURN
0619: C
0620: C       INCREMENT 10-MINUTE COUNTERB BY 1 MINUTE
0621: C
0622: 14360 CT10MINB = CT10MINB + 1
0623:         RETURN
0624: C
0625: C       STORE IP ROTOR BORE TEMP
0626: C
0627: 14800 IPRTBORL = IPROTBOR
0628: C
0629: C       INCREMENT 10-MINUTE COUNTER "A" BY 1-MINUTE
0630: C
0631:         CT10MINA = CT10MINA + 1
0632:         RETURN
0633: C
0634: C       CLEAR"HEAT SOAK IN PROGRESS" INDICATOR
0635: C
0636: 14900 SOAKFLAG = .FALSE.
0637:         RETURN
0638: C
0639: C       IS ACTUAL SPEED LT HEATSOAK SPEED ?
0640: C
0641: 14200 IF(PLT:(WS,SOAKSPD)) GO TO 14280
0642: C
0643: C       SET HEAT SOAK IN PROGRESS INDICATOR
```

```
0644: C
0645:        SOAKFLAG = .TRUE.
0646:        GO TO 14250
0647: C
0648: C      SET 10-MINUTE COUNTERS EQUAL ZERO
0649: C
0650: 14280 CT10MINA = 0
0651:        RETURN
0652:        END

  PROGRAM SIZE: 0231    DATA POOL SIZE: 0036    ERROR COUNT: 0000
0463:      1     EXCOTRLM       ,LPGLSHLM       ,LPGLSLLM       ,HPGSEWLM       ,
0464:      1     LPEXALIM       ,LPEXTRLM       ,H2PRMAX        ,H2PRMIN        ,
0465:      1     RATECUR        ,RPTRIP1        ,RPALRM1        ,IPSTMLIM
0466:        DIMENSION
0467:      1     RATCRICM(1)
0468:        EQUIVALENCE
0469:      1     (  RATCRICM(1) , CLDDIFLM )
0470: C
0471:        COMMON /MWCRTBF/MWCRTBF1,MWCRTBF2,MWCR18UF(5,9)
0472: C
0473: C
0474: C
0475: C
0476: C
0477: C      P15 INTERNAL VARIABLES
0478:        REAL  C(3),CSTSP1,CSTSP2,CSTSP3,STCINET,T(3),TGTSPD,TIMP
0479:        INTEGER  ASREG,CT10MIN,CT10MINA,CT10MINB,CT2MIN,I,N,NUM,PATT,
0480:      1          REGBRKR,RSBREG,TRANSREG
0481:        LOGICAL  AFLAG,BFLAG,CFLAG,DFLAG,EFLAG,INITLD,SEQRESET,SUPRHEAT,
0482:      1          SYNCPROG,TVGVINIT,L15TEMP
0483:        LOGICAL MES15(33)
0484:           EQUIVALENCE(MES15(01),MES(221))
0485: C      INITIALIZE THE FOLLOWING PER15 INTERNAL VARIABLES USING DATA STATEMENTS
0486: C      CSTSP1,CSTSP2,CSTSP3,REGBRKR,RSBREG,C(3),T(3),TRANSREG
0487:        DATA CSTSP1,CSTSP2,CSTSP3/850.,1900.,2400./
0488:        DATA C/.294,.1714,.0863/
0489:        DATA T/400.,504.6,666./
0490:        DATA REGBRKR/3/
0491:        DATA BRKRPATT/$0080/
0492:        DATA I1,I2,I3,I4/1,2,3,4/
0493:        L15TEMP = HOLDWS .OR. TBALRM .OR. VIBRATN
0494: C
0495: C      IS MAIN BREAKER CLOSED ?
0496: C
0497:        IF(MGB) GO TO 15760
0498: C
0499: C      IS"ATC IN CONTROL" INDICATOR SET?
0500: C
0501:        IF(ATS     ) GO TO 15760
0502: C
0503: C      IS"SEQ RESET" INDICATOR SET ?
0504: C
0505:        IF(SEQRESET) GO TO 15120
0506: C
0507: C      SET"SEQ RESET" INDICATOR
0508: C
0509:        SEQRESET = .TRUE.
0510: C
0511: C      CLEAR ALL MESSAGES, FLAGS, AND LIGHT INDICATORS
0512: C
0513:        DO 15100 I =1,33
0514:        MES15(I) = .FALSE.
0515: 15100 CONTINUE
0516:        TGINOP = .FALSE.
0517:        SYNCPROG = .FALSE.
0518:        TVGVINIT   =  .FALSE.
0519:        ATSVPLPB  = .FALSE.
0520:        ATSASPB = .FALSE.
0521:        OVRIDIND   =  .FALSE.
0522:        OVRIDPB    =  .FALSE.
0523:        EFLAG      =  .FALSE.
0524: C
0525: C      CLEAR P15MG1 AND"INITIAL LOAD SELECTED"INDICATOR
```

```
0526: C
0527: 15120 MES15(01) = .FALSE.
0528:       INITLD    = .FALSE.
0529: C
0530: C     IS TURBINE LATCHED ?
0531: C
0532:       MES15(06) =(.NOT. ASL)
0533:       IF(ASL) GO TO 15122
0534:       DEMDMD = 0.
0535:       RETURN
0536: 15122 CONTINUE
0537: C
0538: C     IS TURBINE ON TURNING GEAR ?
0539: C
0540:       IF(TURBONTG) GO TO 15900
0541: C
0542: C     CLEAR "TG IN OPERATION" LIGHT INDICATOR, RUN P03 FLAG, AND"E" FLAG
0543: C
0544:       TGINOP = .FALSE.
0545:       RUNP03 = .FALSE.
0546:       EFLAG  = .FALSE.
0547: C
0548: C     IS SPEED GT 580 RPM ?
0549: C
0550:       IF(RLE:(WS,580.)) GO TO 15962
0551: C
0552: C     IS "SUPERHEAT CHECKED" INDICATOR SET ?
0553: C
0554:       IF(SUPRHEAT) GO TO 15125
0555: C
0556: C     CALCULATE THROTTLE STM SATURATION TEMP AT EXISTING THROT PRESSURE
0557: C
0558:       SATTMP = 357.87 + PO*(.271428 + PO*(-.10866E-3 + PO*(.264638E-7 +
0559:      1          PO*(-.263101E-11))))
0560: C
0561: C     .IS(THROTTLE STEAM - CALCULATED SAT TEMP) GT 100F
0562: C
0563:       TTH = AMAX1(TVSTM(1), TVSTM(2), TVSTM(3), TVSTM(4))
0564:       TEMP1 = TTH- SATTMP
0565:       IF(RGT:(TEMP1,100.)) GO TO 15129
0566:       MES15(33) = .TRUE.
0567:       INSERT(57) = SATTMP + 100.
0568: C
0569: C     IS "ATC IN CONTROL" INDICATOR SET ?
0570: C
0571:       IF(.NOT. ATS    ) GO TO 15127
0572: C
0573: C        HAS  "OVERRIDE PUSHBUTTON" BEEN PUSHED ?
0574: C
0575:       IF(      OVRIDPB) GO TO 15128
0576: C
0577: C     SET"OVERRIDE PUSHBUTTON INDICATOR"
0578: C
0579:       OVRIDIND = .TRUE.
0580:       RETURN
0581: 15129 MES15(33) = .FALSE.
0582:       GO TO 15127
0583: 15128 MES15(15) = .TRUE.
0584: C
0585: C     CLEAR" OVERRIDE PUSHBUTTON INDICATOR"
0586: C
0587: 15127 OVRIDIND = .FALSE.
0588: C
0589: C     SET "SUPERHEAT CHECKED" INDICATOR
0590: C
0591:       SUPRHEAT = .TRUE.
0592: C
0593: C     IS SPEED GT 2150 RPM ?
0594: C
0595: 15125 IF(RLE:(WS,2150.)) GO TO 15720
0596: C
0597: C     IS "HEAT SOAK COMPLETE" OR "IP STRESS INVALID" INDICATOR SET
0598: C
0599:       IF(.NOT.(IPSTINV .OR. SOAKDUN)) GO TO 15700
0600:       MES15(12) = .FALSE.
```

```
0601: C
0602: C       IS SPEED GT 3260 RPM
0603: C
0604:         IF(RLE:(WS,3360,)) GO TO 15740
0605: C
0606: C       IS TURBINE ON GOVERNOR VALVE CONTROL ?
0607: C
0608:         IF(,NOT, GC) GO TO 15500
0609: C
0610: C       CLEAR"TV-GV INIT" INDICATOR
0611: C
0612:         TVGVINIT = ,FALSE,
0613:         MES15(19) = ,TRUE,
0614: C
0615: C       IS SPEED BETWEEN 3550 AND 3610 ?
0616: C
0617:         IF(RLE:(WS,3550,) ,OR, RGE:(WS,3610,))GO TO 15600
0618:         MES15(20) = ,FALSE,
0619: C
0620: C       SET "SYNC IN PROGRESS" LIGHT INDICATOR
0621: C
0622:         SYNCPROG = ,TRUE,
0623: C
0624: C       IS "A" INDICATOR SET ?
0625: C
0626:         IF(,NOT, AFLAG) GO TO 15200
0627: C
0628: C       OPEN CCO TO REG, SUPPLY BREAKER IF IN ATC CONTROL
0629: C
0630:         IF(ATS     ) CALL MICCO(1,0,REGBRKR,BRKRPATT)
0631:
0632: C       IS REG SUPPLY BREAKER CLOSED ?
0633: C
0634:         MES15(21) = ,NOT, RSBRCL
0635:         IF(,NOT, RSBRCL) RETURN
0636: C
0637: C       IS GENERATOR TERMINAL VOLTAGE WITHIN 10% OF RATED VALUE ?
0638: C
0639:         MES15(22) = ,NOT, GENTERM
0640:         IF(MES15(22)) RETURN
0641: C
0642: C       IS VOLTAGE REGULATOR ON ?
0643: C
0644:         MES15(23) = ,NOT, VOLTREGO
0645:         IF(MES15(23)) RETURN
0646: C
0647: C       IS AUTO SWITCH ON AUTOMATIC ?
0648: C
0649:         MES15(25) = ASONAUTO
0650:         MES15(24) =(,NOT, ASONAUTO)
0651:         IF(MES15(24)) RETURN
0652: C
0653: C       CLOSE CCO TO GIVE CONTROL TO AUTO SYNC IF IN ATC CONTROL
0654: C
0655:         ATSASPB = ,TRUE,
0656:         RUNLOGIC = ,TRUE,
0657:         RETURN
0658: C
0659: C       IS "B" INDICATOR SET ?
0660: C
0661: 15200 IF(,NOT, BFLAG) GO TO 15220
0662: C
0663: C       IS"COOLING GAS TEMP HIGH" OR"FAULTY H2 SYSTEM" INDICATOR SET ?
0664: C       IS"EXCITER MONITOR" OR"GENERATOR ANNUNCIATOR"INDICATOR SET ?
0665: C
0666:         MES15(26) =COOLGSHI,OR, H2FAULT ,OR, EXCMON ,OR, GENANUN
0667:         IF(MES15(26))RETURN
0668: C
0669: C       HAS THE EXCITER RUNBACK BEEN PRE-POSITIONED ?
0670: C
0671:         MES15(27) = ,NOT, GNADJPRE
0672:         IF(MES15(27))RETURN
0673: C
0674: C       CLOSE CCO TO REGULATOR SUPPLY BREAKER
0675: C
```

```
0676:        CALL M:CCO(1,GNADJPRE,RFGBRKR,BRKRPATT)
0677: C
0678: C      SET "A" INDICATOR
0679: C
0680:        AFLAG = .TRUE.
0681:        RETURN
0682: C
0683: C      IS THE "C" INDICATOR SET
0684: C
0685: 15220 IF(.NOT. CFLAG) GO TO 15290
0686: C
0687: C      REGULATOR SUPPLY BREAKER - IS CONTROL SWITCH UNLOCKED ?
0688: C
0689:        MES15(28) = .NOT. RSBRCSW
0690:        IF(MES15(28)) RETURN
0691: C
0692: C      IS MAIN BREAKER CONTROL SWITCH UNLOCKED ?
0693: C
0694:        MES15(29) = .NOT. MGBCSW
0695:        IF(MES15(29))RETURN
0696: C
0697: C      IS VOLTAGE REGULATOR SWITCH IN ON POSITION ?
0698: C
0699:        MES15(30) = .NOT. VREGSWON
0700:        IF(MES15(30)) RETURN
0701: C
0702: C      IS"VIBRATION ALARM" INDICATOR SET ?
0703: C
0704:        IF(VIBRATN) GO TO 15240
0705: 15260 MES15(31) = .FALSE.
0706: C
0707: C      CLEAR THE OVERRIDE INDICATOR
0708: C
0709:        OVRIDIND = .FALSE.
0710: C
0711: C      SET THE "B" INDICATOR
0712: C
0713: 15260 BFLAG = .TRUE.
0714:        RETURN
0715: 15240 MES15(31) = .TRUE.
0716: C
0717: C      IS"ATC IN CONTROL"INDICATOR SET
0718: C
0719:        IF(.NOT. ATS     ) GO TO 15260
0720: C
0721: C      HAS THE OVERRIDE PB BEEN PUSHED ?
0722: C
0723:        IF(OVRIDPB) GO TO 15270
0724: C
0725: C      SET OVERRIDE PUSHBUTTON INDICATOR
0726: C
0727:        OVRIDIND = .TRUE.
0728:        RETURN
0729: 15270 MES15(15) = .TRUE.
0730:        GO TO 15280
0731: C
0732: C      IS HP ROTOR(SURFACE - VOLUME AVG) TEMP LT 75% OF LIMIT VALUE ?
0733: C
0734: 15290 IF(RLT:(TDIF ,HPALM75P)) GO TO 15300
0735: C
0736: C      IS FIRST STAGE STEAM TEMP LT HP ROTOR VOKUME AVG TEMP ?
0737: C
0738:        TIMP = AMIN1(TIMP1,TIMP2)
0739:        IF(RLT:(TIMP,TAVG)) GO TO 15300
0740: C
0741: C      OUTPUT MESSAGE R15M32 EVERY 10 MINUTES
0742: C
0743:        MES15(32) =(CT:0MINA .GE. 60)
0744:        INSERT(57) = TIMP
0745:        IF(MES15(32)) CT10MINA =0
0746:        CT10MINA = CT10MINA + 1
0747: C
0748: C      IS ATC IN CONTROL INDICATOR SET ?
0749: C
```

```
0750:          IF(.NOT. ATS     ) GO TO 15320
0751: C
0752: C        HAS OVERRIDE PB BEEN PUSHED ?
0753: C
0754:          IF(OVRIDPB) GO TO 15299
0755: C
0756: C        SET THE OVERIDE PUSHBUTTON INDICATOR
0757: C
0758:          OVRIDIND = .TRUE.
0759:          RETURN
0760: 15299 MES15(15) = .TRUE.
0761: 15300 MES15(32) = .FALSE.
0762: C
0763: C        CLEAR OVERRIDE PB INDICATOR
0764: C
0765:          OVRIDIND = .FALSE.
0766: C
0767: C        SET "C" INDICATOR
0768: C
0769: 15320 CFLAG = .TRUE.
0770:          RETURN
0771: 15500 MES15(19) = .FALSE.
0772: C
0773: C        IS TV-GV TRANSFER INITIATED INDICATOR SET ?
0774: C
0775:          IF(.NOT. TVGVINIT) GO TO 15520
0776:          MES15(13) = .FALSE.
0777: C
0778: C        IS 2-MINUTE COUNTER GE 120 SECONDS ?
0779: C
0780:          MES15(13) =(CT2MIN .GE. 120)
0781:          IF(MES15(13)) RETURN
0782: C
0783: C        INCREMENT 2-MINUTE COUNTER BY 10 SECONDS
0784: C
0785:          CT2MIN = CT2MIN +10
0786:          RETURN
0787: C
0788: C        IS "D" INDICATOR SET ?
0789: C
0790: 15520 IF(DFLAG) GO TO 15540
0791: C
0792: C        CALCULATE THROTTLE STEAM SATURATION TEMP AT EXISTING PRESSURE
0793: C
0794:          SATTMP = 357.87 + PO*(.271428 + PO*(-.0866E-3 + PO*(.264636E-7 +
0795:        1          PO*(-.263101E-11))))
0796: C
0797: C        SET "D" INDICATOR AND SET 10-MINUTE COUNTER EQUAL ZERO
0798: C
0799:          DFLAG = .TRUE.
0800:          CT10MIN  = 0
0801: C
0802: C        IS LEFT STEAM CHEST INNER METAL GT RIGHT STEAM CHEST INNER METAL ?
0803: C
0804: 15540 STCIMET  = AMIN1(LSCTI,RSCTI)
0805:          IF(RLT:(STCIMET,SATTMP)) GO TO 15580
0806:          MES15(14) = .FALSE.
0807:          MES15(15) = .FALSE.
0808: C
0809: C        IS VIBRATION ALARM INDICATOR SET ?
0810: C
0811:          IF(.NOT. VIBRATN) GO TO 15545
0812:          MES15(14) = .TRUE.
0813: C
0814: C        IS ATC IN CONTROL INDICATOR SET ?
0815: C
0816:          IF(.NOT. ATS     ) RETURN
0817: C
0818: C        HAS OVERRIDE PUSHBUTTON BEEN PUSHED ?
0819: C
0820:          OVRIDIND =(.NOT. OVRIDPB)
0821:          IF(OVRIDIND) RETURN
0822:          MES15(15) = .TRUE.
0823: 15545 OVRIDIND = .FALSE.
```

```
0824: C
0825: C       IS ATC IN CONTROL ?
0826: C
0827:         IF(.NOT. ATS     ) RETURN
0828:         MES15(18) = .TRUE.
0829: C
0830: C       SET TV-GV INITIATED INDICATED
0831: C
0832:         TVGVINIT = .TRUE.
0833: C
0834: C       SET 2-MINUTE COUNTER EQUAL ZERO
0835: C
0836:         CT2MIN = 0
0837: C
0838: C       CLEAR THE D-INDICATOR
0839: C
0840: 15560 DFLAG = .FALSE.
0841:         RETURN
0842: C
0843: C       IS 10-MINUTE COUNTER EQUAL ZERO ?
0844: C
0845: 15580 IF(CT10MIN .NE. 0) GO TO 15590
0846: C
0847: C       CALCULATE RECOMMENDED THROTTLE STEAM TEMPERATURE
0848: C
0849:         N = 1
0850:         IF(RGT:(PO,CSTSP1)) N = 2
0851:         IF(RGT:(PO,CSTSP2)) N = 3
0852:         RECTHRTM = T(N) + C(N) * PO
0853:         MES15(16) = .TRUE.
0854:         INSERT(55) = RECTHRTM
0855: C
0856: C       INCREMENT 10-MINUTE COUNTER
0857: C
0858: 15590 CT10MIN = CT10MIN +1
0859: C
0860: C       IS 10-MINUTE COUNTER GE 10 MINUTES
0861: C
0862:         IF(CT10MIN .LT. 60) RETURN
0863:         MES15(17) = .TRUE.
0864:         INSERT(56) = STCTMET
0865: C
0866: C       SET 10-MINUTE COUNTER EQUAL ZERO
0867: C
0868:         CT10MIN = 0
0869:         GO TO 15560
0870: C
0871: C       SET TARGET SPEED EQUAL 3600 RPM
0872: C
0873: 15600 IF(L15TEMP) RETURN
0874:         DEMDMD = 3600.
0875:         MES15(20) = .TRUE.
0876: C
0877: C       CLEAR A,B,&C INDICATORS;CLEAR SYNC IN PROGRESS LIGHT INDICATOR ?
0878: C
0879:         AFLAG = .FALSE.
0880:         BFLAG = .FALSE.
0881:         CFLAG = .FALSE.
0882:         SYNCPROG = .FALSE.
0883:         RETURN
0884: C
0885: C       IS INITIAL LOAD SELECTED INDICATOR SET ?
0886: C
0887: 15780 IF(INITLD) RETURN
0888: C
0889: C       SET INITIAL LOAD SELECTED INDICATOR
0890: C
0891:         INITLD = .TRUE.
0892: C
0893: C       CLEAR SYNC IN PROGRESS LIGHT AND TV-GV TRANSFER INITIATED
0894: C
0895:         SYNCPROG = .FALSE.
0896:         TVGVINIT = .FALSE.
0897:         MES15(01) = .TRUE.
```

```
0898: C
0899: C       IS PRESENT HP OR IP ROTOR(SURFACE + VOL AVG) TEMP DIFF GT 90% LIM
0900: C
0901:         TEMP1 = ABS(TDIF)
0902:         TEMP2 = ABS(IPTDIF)
0903:         IF(RGE:(TEMP1,HPALM90P) ,OR, RGE:(TEMP2,IPALM90P)) GO TO 15660
0904: C
0905: C       IS PRESENT HP OR IP ROTOR(SURFACE + VOL AVG) TEMP DIFF GT 75% LIM
0906: C
0907:         IF(RGE:(TEMP1,HPALM75P) ,OR, RGE:(TEMP2,IPALM75P)) GO TO 15640
0908: C
0909: C       IS PRESENT HP OR IP ROTOR(SURFACE + VOL AVG) TEMP DIFF GT 50% LIM
0910: C
0911:         IF(RGE:(TEMP1,HPALM50P) ,OR, RGE:(TEMP2,IPALM50P)) GO TO 15620
0912: C
0913: C       SET MES P15M05 AND RATEINDX EQUAL I4
0914: C
0915:         MES15(05) = .TRUE.
0916:         RATEINDX  = I4
0917:         RETURN
0918: C
0919: C       SET MES P15M04 AND RATEINDX EQUAL I3
0920: C
0921: 15620 MES15(04) = .TRUE.
0922:         RATEINDX = I3
0923:         RETURN
0924: C
0925: C       SET MES P1503 AND RATEINDX = I2
0926: C
0927: 15640 MES15(03) = .TRUE.
0928:         RATEINDX  = I2
0929:         RETURN
0930: C
0931: C       SET MES P1502 AND RATEINDX = I1
0932: C
0933: 15660 MES15(02) = .TRUE.
0934:         RATEINDX = I1
0935:         RETURN
0936: C
0937: C       SET TG IN OPERATION LIGHT INDICATOR
0938: C
0939: 15900 TGINOP = .TRUE.
0940:         DEMDMD = 0.
0941: C
0942: C       IS ATC IN CONTROL INDICATOR SET ?
0943: C
0944:         IF(.NOT. ATS*    ) RETURN
0945: C
0946: C       IS THE E INDICATOR SET ?
0947: C
0948:         IF(.NOT.EFLAG) GO TO 15920
0949: C
0950: C       IS VALVE POSITION GT 105% ?
0951: C
0952: 15960 MES15(07) = RLT:(VPOSL,120.)
0953:         ATSVPLPB = MES15(07)
0954:         RUNLOGIC = ATSVPLPB
0955:         IF(ATSVPLPB) RETURN
0956: C
0957: C       SET TARGET SPEED EQUAL 605 RPM; ACCELERATION RATE EQUAL 200 RPM/MIN
0958: C
0959: 15961 IF(L15TEMP) RETURN
0960:         DEMDMD = 605.
0961:         RATEINDX = 4
0962:         RETURN
0963: 15962 IF((DEMDMD .EQ. 605.) .OR.L15TEMP) RETURN
0964:         GO TO 15960
0965: C
0966: C       IS RUNP03 INDICATOR SET ?
0967:
0968: 15920 IF(RUNP03) GO TO 15940
0969: C
0970: C       SET RUNP03 AND ESTIMATE ROLL TIME INDICATORS
0971: C
```

```
0972:          RUNP03 = .TRUE.
0973:          ESTROTIM = .TRUE.
0974:          DEHOMD = 0.
0975: C
0976: C        CLEAR COMPLETION OF TG OPERATION
0977: C
0978:          TGCOM = .FALSE.
0979:          RETURN
0980: C
0981: C        IS COMPLETION OF TG OPERATION INDICATOR SET ?
0982: C
0983: 15940 IF(.NOT. TGCOM) RETURN
0984: C
0985: C        IS ROLL OFF TG NOT PERMITTED INDICATOR SET ?
0986: C
0987:          IF(ROTGNP) GO TO 15980
0988: C
0989: C        CLEAR P1508 THRU P15M11
0990: C
0991:          MES15(08) = .FALSE.
0992: C
0993: C        IS REQUIRE OVERRIDE TO ROLL OFF TG INDICATOR SET ?
0994: C
0995:          MES15(09) = ROTROTG
0996:          MES15(10) = ROTROTG .AND. OVRIDPB
0997:          MES15(11) = .NOT. ROTROTG
0998:          OVRIDIND  = MES15(09) .AND. (.NOT. MES15(10))
0999:          IF(OVRIDIND) RETURN
1000:          SUPRHEAT = .FALSE.
1001: C
1002: C        SET THE E-INDICATOR
1003: C
1004:          EFLAG = .TRUE.
1005:          GO TO 15960
1006: 15980 MES15(08) = .TRUE.
1007: C
1008: C        CLEAR OVERRIDE PUSHBUTTON INDICATOR ?
1009: C
1010:          OVRIDIND = .FALSE.
1011:          RETURN
1012: C
1013: C        SET TARGET SPEED EQUAL 2200 RPM
1014: C
1015: 15700 MES15(12) = .TRUE.
1016: 15720 IF(L15TEMP)RETURN
1017:          DEHOMD = 2200.
1018:          RETURN
1019: C
1020: C        SET TARGET SPEED EQUAL 3300 RPM
1021: C
1022: 15740 IF(L15TEMP)RETURN
1023:          DEHOMD = 3425.
1024:          DFLAG = .FALSE.
1025:          RETURN
1026: C
1027: C        CLEAR SEQ RESET INDICATOR
1028: C
1029: 15760 SEQRESET = .FALSE.
1030:          GO TO 15120
1031:          END

  PROGRAM SIZE: 0937    DATA POOL SIZE: 0165    ERROR COUNT:  0000
0463:        1     EXCOTRLM       ,LPGLSHLM       ,LPGLSLLM       ,HPGSEWLM       ,
0464:        1     LPEXALIM       ,LPEXTRLM       ,H2PRMAX        ,H2PRMIN        ,
0465:        1     RATECUR        ,RPTRIP1        ,RPALRM1        ,IPSTMLIM
0466:          DIMENSION
0467:        1     RATCRICM(1)
0468:          EQUIVALENCE
0469:        1     (  RATCRICM(1) , CLODIFLM )
0470: C
0471:          COMMON /MWCRTBF/MWCRTBF1,MWCRTBF2,MWCRTBUF(5,9)
0472: C
0473: C
0474: C
```

```
0475: C
0476: C
0477: C      P16 INTERNAL VARIABLES
0478:        REAL  C(5,12),CONDPRES,Q(22),G,IPHTC1,IPHTC2,IPHTC3,IPTDFSUM,
0479:       1      IPTDIFT(15),KA(3),RHSTMTMP,T(12),TA(4),TAB4(4),TB4(12),
0480:       1      TIPINLH(6),TIPINRH(6),TTOT,VTOT,IPCF,V(12)
0481:        INTEGER  FIVMINCT,I,IAVCT,I1,I2,I3,I4,J,K,ONEMINCT,RHSTMCT,CT2MIN
0482:        LOGICAL MES16(4)
0483:           EQUIVALENCE(MES16(01),MES(254))
0484: C      INITIALIZE THE FOLLOWING PER16 INTERNAL VARIABLES USING DATA STATEMENTS
0485: C      Q(22),C(12,5),IPHTC1,IPHTC2,IPHTC3,I1,I2,I3,I4,VTOT
0486:        DATA Q1,Q2,Q3,Q4,Q5,Q6,Q7,Q8,Q9,Q10,Q11,Q12,Q13,Q14,Q15,Q16,Q17,
0487:       1   Q18,Q19,Q20,Q21,Q22
0488:       1      /75,8       ,7,058       ,.2455E-2    ,0,          ,-.2625E-3   ,
0489:       1       .91768E-7 ,.84332E-6   ,.46975E-2   ,.5673       ,.5324       ,
0490:       1       9,23       ,.3713       ,.7688       ,.93107      ,-31,71      ,
0491:       1       .89912     ,-46,4       ,3,57        ,.104E-1     ,.456E-1     ,
0492:       1       .8E-2      ,.1927E-1/
0493:        DATA C/.604E-3    ,0,          ,.9572       ,.1547E-1    ,.2731E-1    ,
0494:       1       .661E-3    ,.1693E-1    ,.939        ,.2083E-1    ,.2327E-1    ,
0495:       1       .661E-3    ,.2083E-1    ,.956        ,0,          ,.2327E-1    ,
0496:       1       .2992E-1   ,0,          ,.9307       ,.1430E-1    ,.2503E-1    ,
0497:       1       .2996E-1   ,.1838E-1    ,.9056       ,.2099E-1    ,.2502E-1    ,
0498:       1       .2996E-1   ,.2099E-1    ,.924        ,0,          ,.2502E-1    ,
0499:       1       .936E-2    ,.728E-2     ,.728E-2     ,.9564       ,.1968E-1    ,
0500:       1       .2249E-1   ,.9594       ,.1611E-1    ,0,          ,0,          ,
0501:       1       .1868E-1   ,.9678       ,.1357E-1    ,0,          ,0,          ,
0502:       1       .1516E-1   ,.9739       ,.1099E-1    ,0,          ,0,          ,
0503:       1       .1505E-1   ,.9737       ,.1128E-1    ,0,          ,0,          ,
0504:       1       .1998E-1   ,.96         ,0,          ,0,          ,0,          /
0505:        DATA V/.211    ,.1928    ,.1928    ,.1926    ,.1498    ,.1498    ,
0506:       1       .5145    ,.4505    ,.4367    ,.3912    ,.2854    ,.1611/
0507:        DATA VTOT/3,3282/
0508:        DATA I1,I2,I3,I4/1,2,3,4/
0509:        DATA IPCF/.3086E-5/
0510:        CONDPRES =AMAX1(CONDPR1,CONDPR2,CONDPR3)
0511:        RHSTMTMP =(IPINRH + IPINLH)/2,
0512: C
0513: C      IS IP STRESS INVALID INDICATOR SET ?
0514: C
0515:        IF(IPSTINV) GO TO 16900
0516: 16000 MES16(04) = .FALSE.
0517: C
0518: C      IS TURBINE ON TURNING GEAR ?
0519: C
0520: 16120 IF(TURBONTG) GO TO 16150
0521: C
0522: C      IS MAIN BREAKER CLOSED ?
0523: C
0524:        IF(.NOT. MGB) GO TO 16160
0525: C
0526: C      COMPUTE IP ROTOR AMBIENT STEAM TEMP
0527: C
0528:        TA(1) = Q14 * RHSTMTMP + Q15
0529:        TA(2) = TA(1)
0530:        TA(3) = Q16 * RHSTMTMP + Q17
0531: C
0532: C      COMPUTE IP ROTOR STEAM-TO-SURFACE HEAT TRANSFER COEFFICIENT
0533: C
0534:        G = FOEM
0535:        IPHTC1 = Q1 *G**0,7
0536:        IPHTC2  = Q2 * G**0,8
0537:        IPHTC3 = IPHTC2
0538: C
0539: C         IS THE IP RTR SURFACE GT IP VOLUME AVG ?
0540: C
0541:        IF(RGT:(IPROTSUR,IPTAVG))GO TO 16170
0542: C
0543: C      IP ROTOR(SURFACE - VOL AVG) EFFECTIVE TEMP DIFF LIMIT = IP RTR
0544: C      LOADING TEMP DIFF LIMIT
0545: C
0546:        IPTDIFLM = IPNDIFLM
0547: C
0548: C      COMPUTE IP ROTOR SURFACE TEMP; IP VOLUME AVG TEMP; & THEIR DIFFERENCE
0549: C        1. CALCULATE IP RTR HEAT CONDUCTANCE TO AMBIENT STEAM - P16,2
```

```
0550: C
0551: 16210 KA(1)=1./(Q18/IPHTC1 + Q19)
0552:       KA(2)=1./ ((Q20/ALOG(1.+ Q21 * IPHTC2)) + Q22)
0553:       KA(3)=KA(2)
0554: C
0555: C       2. CALCULATE IP ROTOR SURFACE TEMPERATURE - P16.4A
0556: C
0557:       DO 16100 J =1,3
0558:            T(J) = C(1,J) *KA(J) *(TAB4(J) - TB4(J))+
0559:      1              C(2,J) * TB4(J-1) +
0560:      1              C(3,J) * TB4(J) +
0561:      1              C(4,J) * TB4(J+1) +
0562:      1              C(5,J) * TB4(J+3)
0563: 16100 CONTINUE
0564: C
0565: C       3. CALCULATE SECOND IP LAYER TEMP
0566: C
0567:       DO 16300 J = 4,6
0568:          T(J)= C(1,J) * TB4(J-3) -
0569:      1          C(2,J) * TB4(J-1) +
0570:      1          C(3,J) * TB4(J) +
0571:      1          C(4,J) * TB4(J+1) +
0572:      1          C(5,J) * TB4(7)
0573: 16300 CONTINUE
0574: C
0575: C       4. CALCULATE THIRD IP LAYER TEMP
0576: C
0577:       T(7) = C(1,7) * TB4(4)    +
0578:      1        C(2,7) * TB4(5) +
0579:      1        C(3,7) * TB4(6) +
0580:      1        C(4,7) * TB4(7)    +
0581:      1        C(5,7) * TB4(8)
0582: C
0583: C       5. CALCULATE LAYERS 4 THRU 8 TEMPS
0584: C
0585:         DO 16400 J = 8,12
0586:          T(J) = C(1,J) *TB4(J-1) + C(2,J) * TB4(J) +  C(3,J) * TB4(J+1)
0587: 16400 CONTINUE
0588:       IPROTBOR = T(12)
0589:       IPROTSUR = T(2)
0590: C
0591: C     COMPUTE THE IP ROTOR VOLUME AVERAGE TEMP
0592: C
0593:       TTOT = 0.
0594:       DO 16450  I = 1,12
0595:       TTOT = TTOT + T(I)*V(I)
0596:       TB4(I) = T(I)
0597:       IF(I .LE. 4) TAB4(I) = TA(I)
0598: 16450 CONTINUE
0599:       IPTAVG = TTOT/VTOT
0600: C
0601: C     CALCULATE IP(ROTOR SURFACE - VOLUME AVG) EFFECTIVE TEMP
0602: C
0603:       IPTDIF = IPTAVG - T(2) + IPCF * WS**2
0604: C
0605: C     IS 1-MINUTE COUNTER GE 60 SECONDS ?
0606: C
0607:       IF(ONEMINCT .GE. 12) GO TO 16600
0608:       ONEMINCT = ONEMINCT +1
0609: C
0610: C     IS IP STRESS INVALID INDICATOR SET
0611: C
0612: 16670 IF(IPSTINV) GO TO 16310
0613: C
0614: C     IS ABSOLUTE VALUE OF IP ROTOR EFFECTIVE TEMP DIFF LT IP EFFECTIVE LIMIT
0615: C
0616:       IF(CT2MIN .GE. 24)CT2MIN =0
0617:       CT2MIN = CT2MIN + 1
0618:       IF(CT2MIN .LT. 24) GO TO 16310
0619:       MES16(01) =( RGF:(IPTDIF,IPTDIFLM))
0620:       INSERT(58) = IPTDIFLM
0621: C
0622: C     IS REHEAT STEAM TEMP DIFFERENCE BETWEEN #1 AND #2 SENSORS LT 25C
0623: C
```

```
16310 TEMP1 = ABS(IPINRH - IPINLH)
      MES16(03) = PGE:(TEMP1,25.)
C
C     IS MAIN BREAKER CLOSED ?
C
      IF(.NOT. MGB) RETURN
C
C     IS LOAD LESS THAN 20% ?
C
      IF(LOADPER .LT. 20) GO TO 16330
C
C     IS 5-MINUTE COUNTER LESS THAN 5 MINUTE
C
      IF(FIVMINCT .LT. 60) GO TO 16320
      FIVMINCT = 0
C
C     IS NUMBER OF STORED REHEAT STEAM TEMPS GE 6 ?
C
      IF(RHSTMCT .LT. 6) GO TO 16370
C
C     FRS IS ANY STORED REHEAT STEAM TEMP MINUS THE PRESENT VALUE GT 150F
C
16180 DO 16200 I = 1,6
      TEMP1 = ABS(TIPINRH(I) - IPINRH)
      TEMP2 = ABS(TIPINLH(I) - IPINLH)
      IF(RGT:(TEMP1,150.)) GO TO 16250
      IF(RGT:(TEMP2,150.)) GO TO 16250
16200 CONTINUE
      MES16(02) = .FALSE.
      GO TO 16255
16250 MES16(02) = .TRUE.
C
C     UPDATE STORED LATEST SIX VALUES OF REHEAT STEAM #1 & #2
C
16255 IF(K .EQ. 6) K =0
      K= K+1
      TIPINRH(K) = IPINRH
      TIPINLH(K) = IPINLH
      RETURN
C
C     SET SPEED EQUAL ZERO;AMBIENT STM TEMP EQUAL IP BLADE RING TEMP
C
16150 SPEED = 0.
      TA(1) = IPERT
      TA(2) = TA(1)
      TA(3) = TA(1)
C
C     CLEAR HEAT SOAK COMPLETE AND HEAT SOAK RETIMED INDICATORS
C
      SOAKDUN = .FALSE.
      SOAKRET = .FALSE.
      SOAKFLAG = .FALSE.
C
C     COMPUTE IP ROTOR HEAT TRANSFER COEF AS A FUNCTION OF SPEED & PRESS
C
      G = Q3 *CONDPRES + Q4 * SPEED + Q5 * CONDPRES**2 + Q6 * SPEED**2
     1    +Q7*CONDPRES*SPEED + Q8
16155 IPHTC1 = Q1*G**0.7
      IPHTC2 = Q2*G**0.8
      IPHTC3 = IPHTC2
C
C     IS IP RTR SURFACE GT IP RTR VOL AVG ?
C
      IF(RGT:(IPROTSUR,IPTAVG)) GO TO 16170
C
C     SET IP ROTOR SURFACE - VOL AVG TEMP DIFF LIMIT EQUAL ROLLING
C     TEMP DIFF LIMIT
C
      IPTDIFLM = IPCLDDFL
      GO TO 16210
C
C     SET SPEED EQUAL ACTUAL SPEED; CALCULATE IP RTR AMBIENT STEAM TEMP
C
16160 SPEED = WS
```

```
0698:        G = Q3 * CONDPRES + Q4*SPEED + Q5 * CONDPRES **2 + Q6 * SPEED**2
0699:       1     + Q7*CONDPRES*SPEED + Q8
0700:        TA(4) = Q9 * RHSTMTMP + Q10 * IPEXHSTM
0701:        TA(2)=((Q11 * G - .5 * KA(1)) * TA(4) + KA(1) * TB4(1))/
0702:       1      (Q11 *G + .5 * KA(1))
0703:        TA(1) = .5 *(TA(4) + TA(2))
0704:        TA(3) = Q12 * RHSTMTMP + Q13 * IPEXHSTM
0705:        GO TO 16155
0706: C
0707: C      SET IP ROTOR(SURFACE - VOL AVG) EFFECTIVE TEMP DIFF LIMIT EQUAL IP
0708: C      ROTOR HEATING TEMP LIMIT
0709: C
0710: 16170 IPTDIFLM = IPHILDTL
0711:        GO TO 16210
0712: C
0713: C      SET IP ROTOR(SURFACE - VOLUME AVG) TEMP DIFF LIMIT EQUAL IP HOT
0714: C      TEMP LIMIT
0715: C
0716: 16900 MES16(04) = .TRUE.
0717: C
0718: C      IS "REHEAT STEAM SENSOR FAIL" INDICATOR SET ?
0719: C
0720:        IF(RHFAIL) GO TO 16970
0721: C
0722: C      IS IP 2-HOUR COUNTER GE 7200 SECONDS ?
0723: C
0724:        IF(IPICOL  .GE. 7200) GO TO 16990
0725: C
0726: C      IS IP 2-HOUR COUNTER EQUAL ZERO ?
0727: C
0728:        IF(IPICOL .NE. 0) GO TO 16980
0729: C
0730: C      IS "IP METAL TEMP SENSOR FAIL" INDICATOR SET ?
0731: C
0732:        IF(IPMTFAIL) GO TO 16310
0733: C
0734: C      INITIALIZE IP ROTOR TEMP EQUAL IP BLADE RING METAL TEMP
0735: C
0736:        DO 16950 I = 1,12
0737:        TB4(I) = IPBRT
0738:        T(I) = IPBRT
0739: 16950 CONTINUE
0740: C
0741: C      INCREMENT IP 2-HOUR COUNTER BY 5-SECONDS
0742: C
0743: 16980 IPICOL = IPICOL +5
0744:        GO TO 16120
0745: C
0746: C      CLEAR "IP STRESS INVALID" INDICATOR
0747: C
0748: 16990 IPSTINV = .FALSE.
0749:        GO TO 16000
0750: C
0751: C      SET IP 2-HOUR COUNTER EQUAL ZERO
0752: C
0753: 16970 IPICOL = 0
0754:        RETURN
0755: C
0756: C      SET ONE MINUTE COUNTER EQUAL ZERO
0757: C
0758: 16600 ONEMINCT = 0
0759: C
0760: C      EXTRAPOLATE 15 - MINUTE ANTICIPATED VALUE OF IP ROTOR(SURFACE -
0761: C      VOL AVG) EFFECTIVE TEMP DIFF
0762: C
0763:        IPTDFSUM = 0.
0764:        DO 16650 I = 1,15
0765:        IPTDFSUM = IPTDFSUM + IPTDIFT(I)
0766: 16650 CONTINUE
0767:        IPATDIF  = 2.875 * IPTDIF - .125 * IPTDFSUM
0768: C
0769: C      UPDATE LATEST 15 VALUES OF IP ROTOR(SURFACE - VOL AVG) EFFECTIVE TEMPS
0770: C
0771:        IAVCT = IAVCT+1
```

```
0772:          IF(IAVCT .GE. 16) IAVCT =1
0773:          IPTDIFT(IAVCT) = IPTDIF
0774:          GO TO 16670
0775: C
0776: C        SET NUMBER OF STORED REHEAT STEAM TEMP EQUAL ZERO; 5-MINUTE COUNTER
0777: C        EQUAL 300 SECONDS
0778: C
0779: 16330 RHSTMCT = 0
0780:          FIVMINCT = 60
0781:          RETURN
0782: C
0783: C        INCREMENT 5-MINUTE COUNTER BY 5 SECONDS
0784: C
0785: 16320 FIVMINCT = FIVMINCT + 1
0786:          RETURN
0787: C
0788: C        INCREMENT NUMBER OF STORED REHEAT STEAM TEMP BY 1
0789: C
0790: 16370 RHSTMCT = RHSTMCT + 1
0791:          K = RHSTMCT
0792:          GO TO 16255
0793:          END

PROGRAM SIZE: 1173    DATA POOL SIZE: 0500    ERROR COUNT: 0000
```

What we claim is:

1. An electric power generating system, comprising:
a steam turbine having a high pressure section and a reheat turbine section;
an electric generator rotated by said turbine to produce electric power when connected to a load;
steam inlet valve means to govern the flow of steam to the turbine;
means to detect the temperature of the steam at predetermined locations within the steam turbine;
means to detect the temperature of stationary turbine metallic parts at predetermined locations within the steam turbine;
means governed by the detection means to generate data relating to thermal stress of the high pressure and reheat turbine rotors;
means governed by the detection means to generate data relating to temperature adjacent the axis of the reheat turbine rotor;
means to generate a signal governing the acceleration of the turbine in accordance with the generated data relating to thermal stress;
means governed by the generated data relating to the reheat rotor temperature to generate a signal governing the turbine to hold its speed at a predetermined speed at times when the generated data relating to the reheat temperature is below a predetermined value irrespective of the generated data relating to thermal stress; and
means governed by the generated hold signal and the acceleration rate signal to control the steam inlet valves to govern the flow of steam to the turbine.

2. A system according to claim 1 wherein the means to generate data relating to thermal stress, temperature, and acceleration at least are structured within a programmed digital computer means.

3. A system according to claim 1 wherein the predetermined speed is the heat soak speed of the turbine.

4. A system according to claim 3 further comprising:
means governed by the detection means to hold the speed of the turbine at the heat soak speed at times when the temperature of a predetermined metal temperature location of the reheat turbine is below a predetermined temperature; and
means governed by the temperature of the predetermined metal temperature and the reheat rotor temperature to generate a signal to accelerate the turbine at a predetermined rate in accordance with the generated data relating to thermal stress of the high pressure and reheat turbine rotors.

5. A system according to claim 4 wherein the generated temperature data for the reheat turbine rotor is the bore of said rotor.

6. A system according to claim 5 wherein the reheat predetermined metal temperature is the temperature of the blade ring metal.

7. A system according to claim 5 wherein thermal stress data generating means for the reheat turbine rotor comprises:
means to generate a data value relating to the volume average temperature of the reheat rotor including means to calculate data values relating to temperature at a plurality of axially spaced locations in the rotor; and
means to calculate data values relating to temperature at a plurality of radially spaced locations in the bore.

8. A system according to claim 7 wherein the rotor bore temperature data generating means includes means to calculate the temperature a predetermined distance radially in the rotor at a predetermined location.

9. A system according to claim 1 further comprising:
means to generate data relating to electrical generator capability;
means to generate a signal governing the rate of electrical loading of the generator in accordance with the generated data relating to thermal stress and the generated data relating to electrical generator capability; and
means to govern the loading of the generator in accordance with the load rate governing signal.

10. An electric power generating system, comprising:
a steam turbine having a high pressure section and a reheat turbine section;
an electric generator rotated by said turbine;
steam inlet valve means to control the flow of steam through the turbine;

means to detect the temperature of the hot reheat steam entering the reheat turbine section;

means to detect the temperature of the steam exhausting from the reheat turbine section;

means to generate data relating to the temperature of ambient steam at opposite sides of each of a pair of adjacent rotating and stationary turbine blades in accordance with the detected steam temperature;

means to generate data relating to the temperature of ambient steam at a location intermediate the ambient steam temperatures calculated on opposite sides of said stationary blade between the seal strips and the surface of the rotor;

means to generate data relating to temperature at a plurality of locations within the rotor mass spaced axially with at least two of the locations being aligned radially with a respective adjacent stationary and rotating blade;

means to generate data relating to temperature at locations spaced radially in the reheat rotor;

means to generate data relating to the volume average temperature of the rotor in accordance with the generated data at the axially and radially spaced rotor locations;

means to generate data relating to thermal stress of the reheat turbine rotor in accordance with the generated data relating to volume average temperature;

means governed by the generated rotor stress data of the reheat turbine to control the flow of steam to the turbine.

11. A system according to claim 10 wherein the means to generate data relating to temperature and thermal stress at least are structured within a programmed digital computer means.

12. A system according to claim 10 further comprising:

means to generate data relating to the temperature of the rotor bore;

means to generate a signal to hold the turbine at a predetermined heat soak speed during the time when the temperature of the rotor bore is below a predetermined value.

13. A system according to claim 12 further comprising:

means to detect the temperature of metal on which the stationary blades of the reheat turbine is mounted, and the calculating means further includes means governed by the metal temperature to generate a signal to hold the turbine at heat soak speed during the time that the metal temperature is below a predetermined value.

14. An electric power generating system, comprising:

a steam turbine having at least a high pressure section;

an electric generator rotated by the turbine to produce electric power when connected to a load;

steam inlet valve means to govern the flow of steam to the turbine;

means to generate data relating to the rotor stress of the turbine;

means to generate data relating to the loading capability of the generator;

means to compare the rotor stress data and the capability data;

means to increase the rate of generator load at predetermined periodic intervals; and means responsive to the compared data to limit the rate of change of the electrical load on the generator.

15. An electric power generating system, comprising:

a steam turbine having a high pressure section and a reheat turbine section;

an electric generator related by said turbine to produce electric power when connected to a load;

valve means to control the flow of steam to the turbine;

means to control the electrical load on the generator;

means to govern the generator control means to selectively hold the load at its present rate of generation, increase its rate of generation, or decrease its rate of generation;

means to generate an electrical signal to selectively reduce the turbine rotor stress rate, increase the turbine rotor stress rate, or hold the turbine stress at its present rate;

means to generate data values relating to the present and anticipated thermal stress of the high pressure turbine rotor and reheat turbine rotor;

means to generate data values relating to the reactive capability of the electrical generator; and means governed by the reactive load capability data and the thermal stress data to control the generator load control means.

16. A system according to claim 15 wherein the means for generating data values relating to thermal stress, reactive capability, at least are structured within a programmed digital computer means.

* * * * *